US012757927B2

(12) United States Patent
Lee et al.

(10) Patent No.: US 12,757,927 B2
(45) Date of Patent: Oct. 13, 2026

(54) SMOKING ARTICLE COMPRISING NOVEL FLAVORING AGENT

(71) Applicant: KT&G CORPORATION, Daejeon (KR)

(72) Inventors: Changgook Lee, Daejeon (KR); Dong Hyun Kim, Daejeon (KR); Ho Rim Song, Daejeon (KR); Geon Chang Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 775 days.

(21) Appl. No.: 18/252,935

(22) PCT Filed: Nov. 17, 2022

(86) PCT No.: PCT/KR2022/018214
§ 371 (c)(1),
(2) Date: May 15, 2023

(87) PCT Pub. No.: WO2023/090898
PCT Pub. Date: May 25, 2023

(65) Prior Publication Data

US 2024/0365845 A1 Nov. 7, 2024

(30) Foreign Application Priority Data

Nov. 18, 2021 (KR) ..... 10-2021-0159820
May 16, 2022 (KR) ..... 10-2022-0059744

(51) Int. Cl.
*A24D 1/00* (2020.01)
*A24B 15/16* (2020.01)
*A24D 1/04* (2006.01)

(52) U.S. Cl.
CPC ..... *A24D 1/002* (2013.01); *A24B 15/16* (2013.01); *A24D 1/045* (2013.01)

(58) Field of Classification Search
CPC ..... A24D 1/002; A24B 15/16
See application file for complete search history.

(56) References Cited

U.S. PATENT DOCUMENTS 5,139,034 A 8/1992 Chan

FOREIGN PATENT DOCUMENTS

| | | | |
|---|---|---|---|
| CN | 1123001 | A | 5/1996 |
| CN | 102286035 | A | 12/2011 |
| CN | 102311464 | A | 1/2012 |
| CN | 102311465 | A | 1/2012 |
| CN | 102336789 | A | 2/2012 |

(Continued)

OTHER PUBLICATIONS

International Search Report for PCT/KR2022/018214 dated Feb. 22, 2023 [PCT/ISA/210].

(Continued)

*Primary Examiner* — Michael H. Wilson
*Assistant Examiner* — Courtney G Culbert
(74) *Attorney, Agent, or Firm* — Sughrue Mion, PLLC

(57) ABSTRACT

The present disclosure relates to a smoking article including a novel flavoring agent, and more particularly, to a smoking article including a flavoring agent, which is a novel compound that includes a moiety derived from a sugar compound and a moiety derived from a flavoring compound in a basic backbone and is pyrolyzed into a lactone compound, a sugar compound, and a flavoring compound upon pyrolysis.

17 Claims, 32 Drawing Sheets

(56) References Cited

FOREIGN PATENT DOCUMENTS

| | | | |
|---|---|---|---|
| CN | 116887705 | A | 10/2023 |
| JP | 2023554576 | A | 12/2023 |
| KR | 10-2011-0106221 | A | 9/2011 |

OTHER PUBLICATIONS

Chinese Office Action dated Nov. 12, 2025 for the corresponding CN Application No. 202280008131.7.
Communication dated Aug. 6, 2024 issued by the Japanese Patent Office in application No. 2023-526150.

| Example 4 | No. | Applied amount of flavoring agent (sample g/100 kg of cut tobacco) | Flavoring agent application site (A) |
|---|---|---|---|
| Sample 1 | 1 | 7.4 |  |
| | 2 | 30.0 |  |
| | 3 | 30.0 |  |
| Sample 2 | 1 | 7.4 |  |
| | 2 | 30.0 |  |
| | 3 | 30.0 |  |

| | | | |
|---|---|---|---|
| Sample 3 | 1 | 7.4 |  |
| | 2 | 30.0 |  |
| | 3 | 30.0 |  |
| Sample 4 | 1 | 7.4 |  |
| | 2 | 30.0 |  |
| | 3 | 30.0 |  |

| Example 5 | No. | γ-Undecalactone content g developed during pyrolysis/cut tobacco 100 kg) | Flavoring agent application site (A) |
|---|---|---|---|
| Sample 5 | 1 | 2.56g |  |
| | 2 | 12.51g |  |

| Example 6 | No. | Cigarette paper/filter part application site (A) (cigarette paper) | γ-Undecalactone 2.56 g developed during pyrolysis/cut tobacco 100 kg) |
|---|---|---|---|
| Sample 6 | 1 | 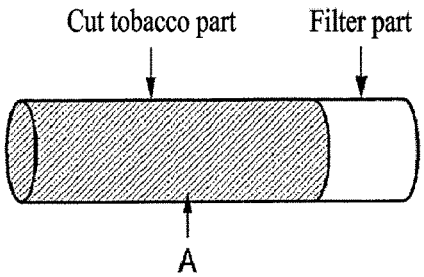 | Applied on entire cigarette paper |
| | 2 | 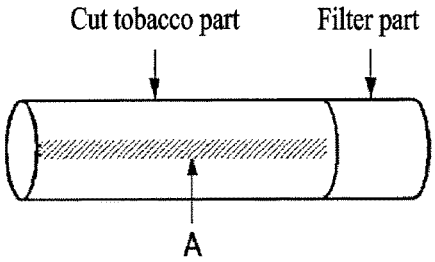 | Applied linearly (transversely) according to cigarette rod |
| | 3 | 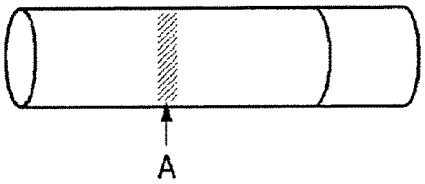 | Applied in strip (axis) on cigarette rod (center area), which changes atomosphere of sidestream smoke during smoking (when smoking in the middle) |
| | 4 | 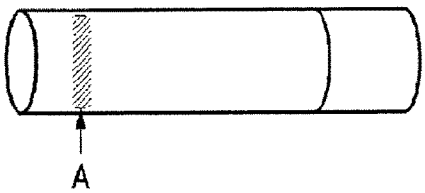 | Applied in strip (axis) on cigarette rod (lighterning start portion), which changes atmosphere of sidesteam smoke during early smoking |
| | 5 | 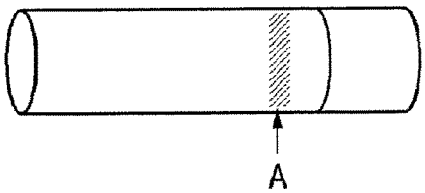 | Applied in strip (axis) on cigarette rod (lighterning start portion), which changes atmosphere of sidestream smoke during last puffing |

FIG. 31

SMOKING ARTICLE COMPRISING NOVEL FLAVORING AGENT

TECHNICAL FIELD

The present disclosure relates to a smoking article including a novel flavoring agent from which flavoring components are released by heating.

BACKGROUND ART

Flavoring agents may be added to a smoking article to further enhance the taste. Smoke or aerosol generated from the smoking article moves from upstream to downstream and is delivered to a smoker so as to feel the satisfaction of smoking. There are many factors that determine smoking satisfaction, but the most important factor is the cigarette taste that the smoker feels. Smokers want to enjoy a variety of tobacco tastes in one smoking article, and thus cigarette manufacturers add flavoring substances (e.g., flavoring agents) to satisfy smokers' desires so that the smokers can feel various flavors or tastes.

In existing flavoring agents, the possibility of decomposition of chemical structures is high at room temperature during long-term storage of smoking media, and flavor components are volatilized, so that it is difficult to develop sufficient flavor to enhance the tobacco taste during smoking or the persistence of the flavor is weak or the tobacco taste changes as the smoking time elapses. It is necessary to develop flavoring agents capable of increasing smoking satisfaction during smoking. In addition, when tobacco is manufactured and/or stored, it is frequently that the flavoring agent is decomposed or the flavor component is volatilized and released and disappears. Thus, there is a need for developing a flavoring agent capable of increasing the storage life by preventing or delaying the release of volatile flavors and expressing sufficient flavor when used by a user (e.g., during smoking) and a smoking article using the same.

DISCLOSURE OF THE INVENTION

Technical Goals

Existing compounds having a flavoring agent function have low chemical and structural stability at room temperature (rt) or a temperature close thereto, so that structural transformation or decomposition may occur to volatilize flavor components. An object of the present disclosure is to provide a smoking article containing a novel flavoring agent, from which flavor components are released by pyrolysis when heat is applied.

However, technical objects of the present disclosure are not limited to the aforementioned purpose and other objects which are not mentioned may be clearly understood by those skilled in the art from the following description.

Technical Solutions

According to an embodiment of the present disclosure, there is provided a smoking article including a flavoring agent that is a compound represented by Formula 1 below.

[Formula 1]

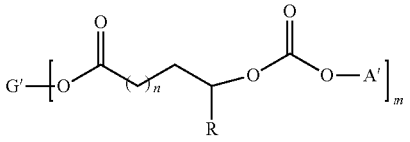

(In Formula 1 above, n is an integer of 1 or 2,

R is a straight or branched-chain alkyl group having 1 to 30 carbon atoms, a moiety A' is a moiety derived from a flavoring compound having at least one of an aromatic ring, an aliphatic ring, and an aliphatic chain having a hydroxyl group (—OH), in which the hydroxyl group participates in a carbonate linkage

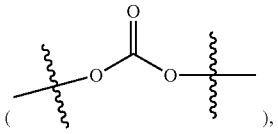

and the moiety A' corresponds to a flavoring compound excluding the hydroxyl group participating in the carbonate linkage, and a moiety G' is a moiety derived from a sugar compound, in which at least one of hydroxyl groups (—OH) linked to a ring of the sugar compound participates in an ester linkage

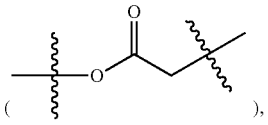

G' corresponds to a sugar compound excluding the hydroxyl group participating in the ester linkage, and m is the number of

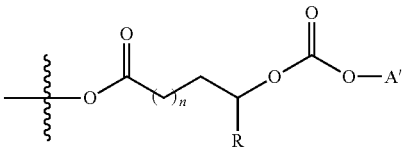

linked to the moiety G' by the ester linkage, and an integer of 1 to 8.).

Effects

According to embodiments of the present disclosure, the smoking article including the flavoring agent may improve an acrid smell of sidestream smoke as the flavoring component is developed during smoking, and improve the tobacco taste and constantly maintain the tobacco taste because the flavoring component is released during pyrolysis by heating.

According to embodiments of the present disclosure, the smoking article including the flavoring agent according to the present disclosure may control and improve tobacco taste, atmosphere, etc. by variously utilizing and/or modifying an application method, an application site, and the like.

BRIEF DESCRIPTION OF DRAWINGS

FIG. 31 illustrates an application site of a flavoring agent in a cigarette product of Example 6, according to an embodiment of the present disclosure.

BEST MODE FOR CARRYING OUT THE INVENTION

Figure 1:
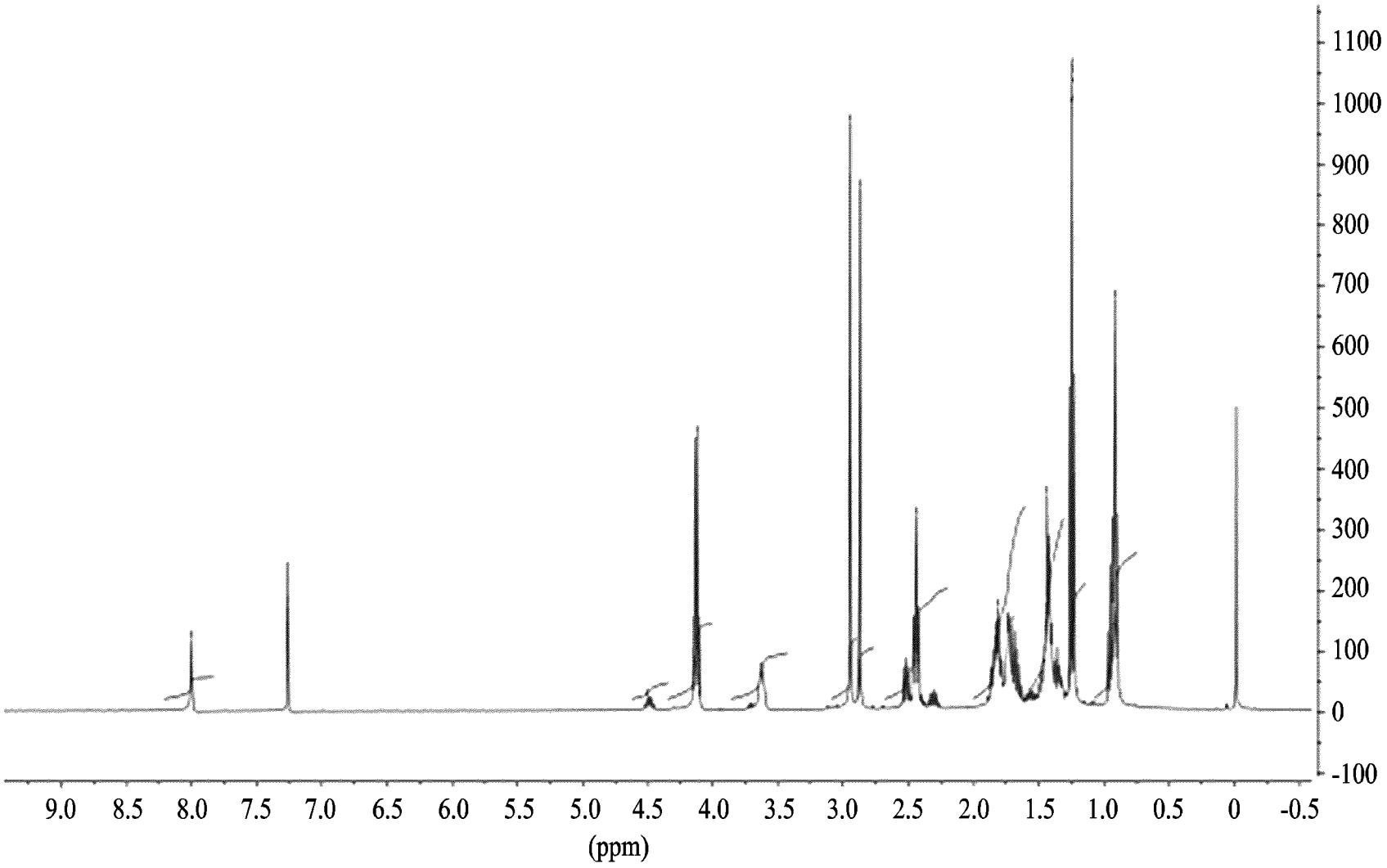
FIG. 1 illustrates results of NMR analysis of ethyl 4-hydroxyheptanoate (2*a*) prepared in examples, according to an embodiment of the present disclosure.
Figure 2:
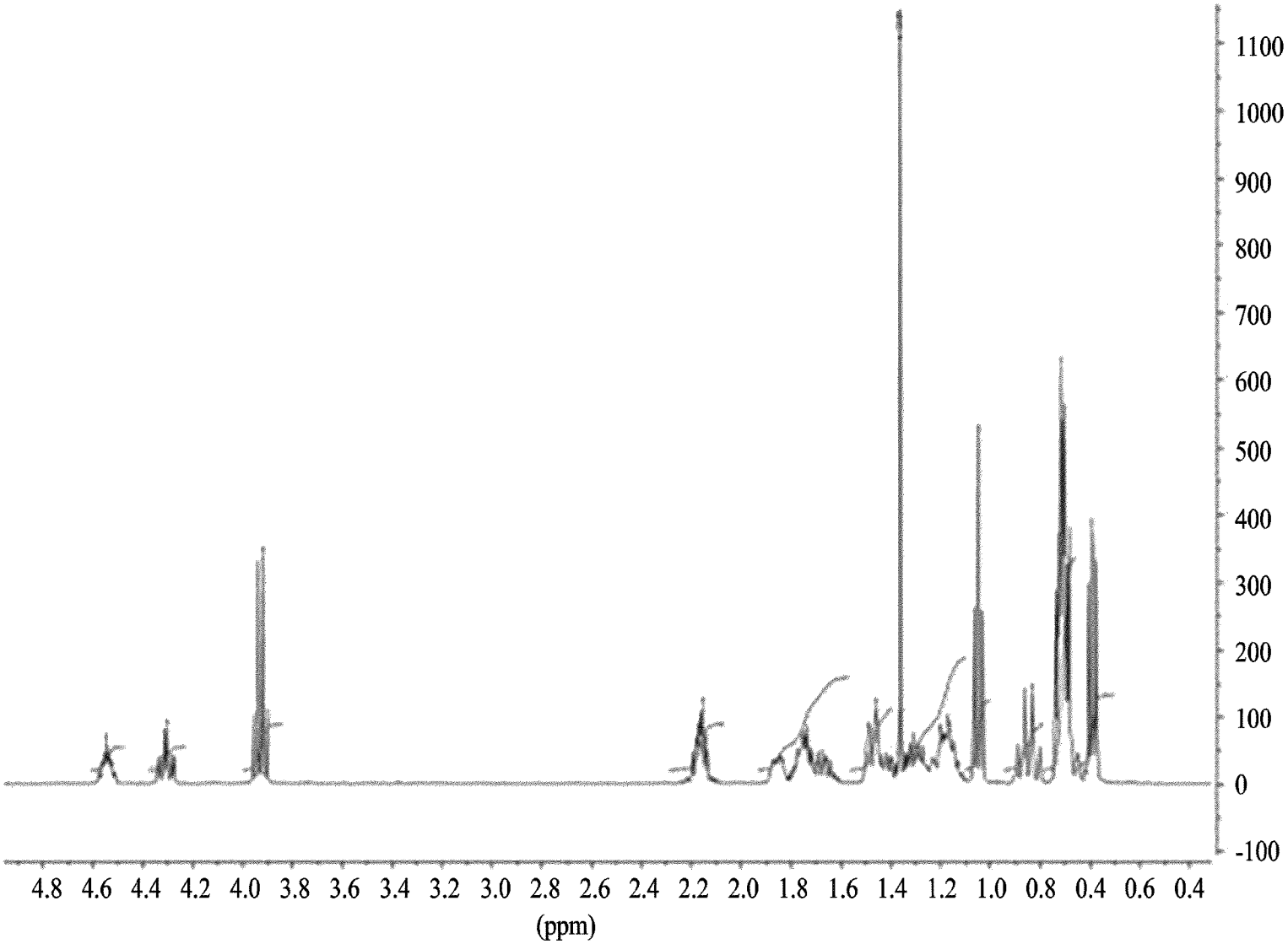
FIG. 2 illustrates results of NMR analysis of ethyl 4-(mentylcarbonyloxy)heptanoate (3*a*) prepared in examples, according to an embodiment of the present disclosure.
Figure 3:
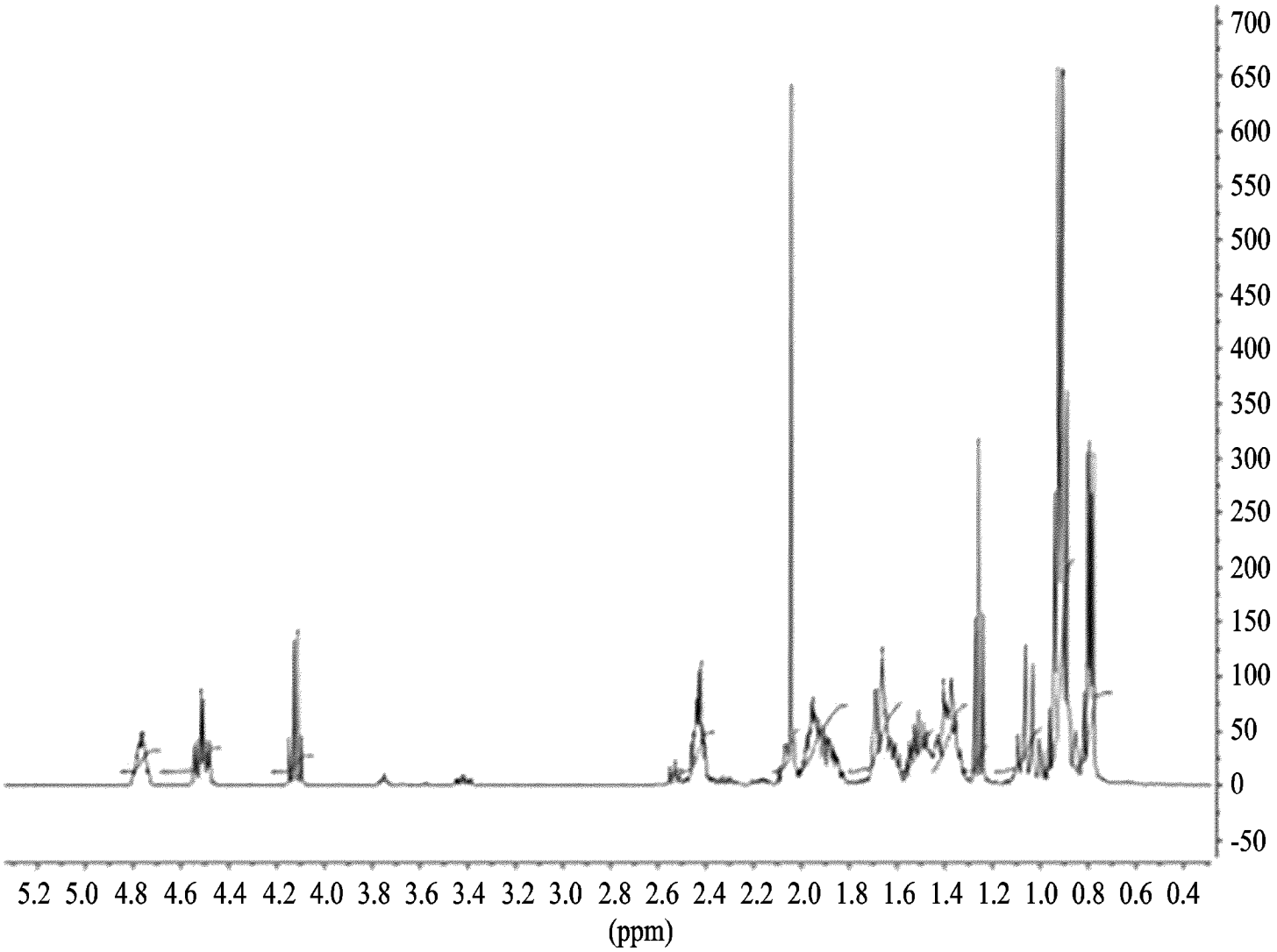
FIG. 3 illustrates results of NMR analysis of 4-(mentylcarbonyloxy)heptanoic acid (4*a*).
Figure 4:
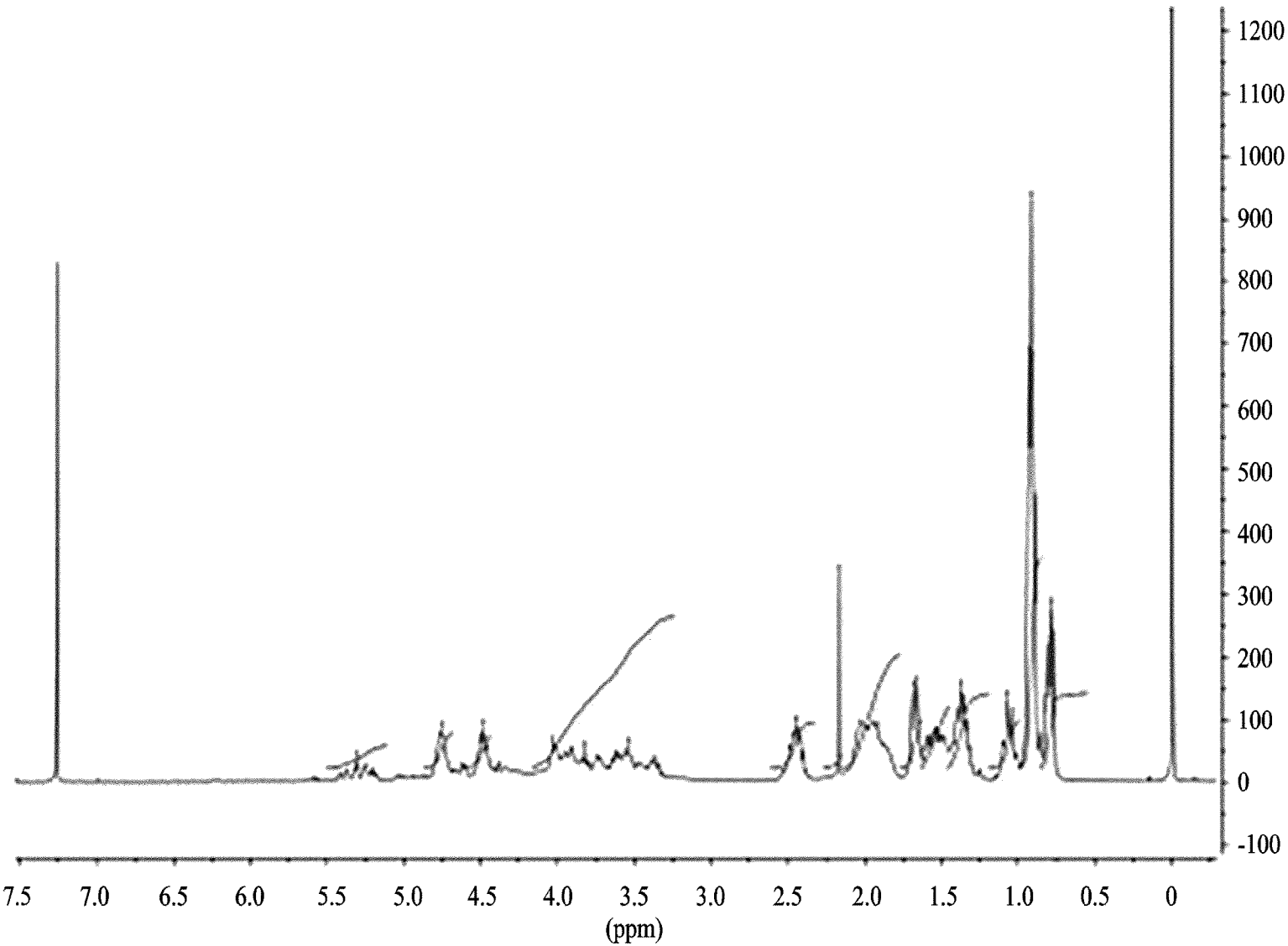
FIG. 4 illustrates results of NMR analysis of glucosyl-(4-mentylcarbonyloxy)heptanoate (5*a*) prepared in examples, according to an embodiment of the present disclosure.
Figure 5:
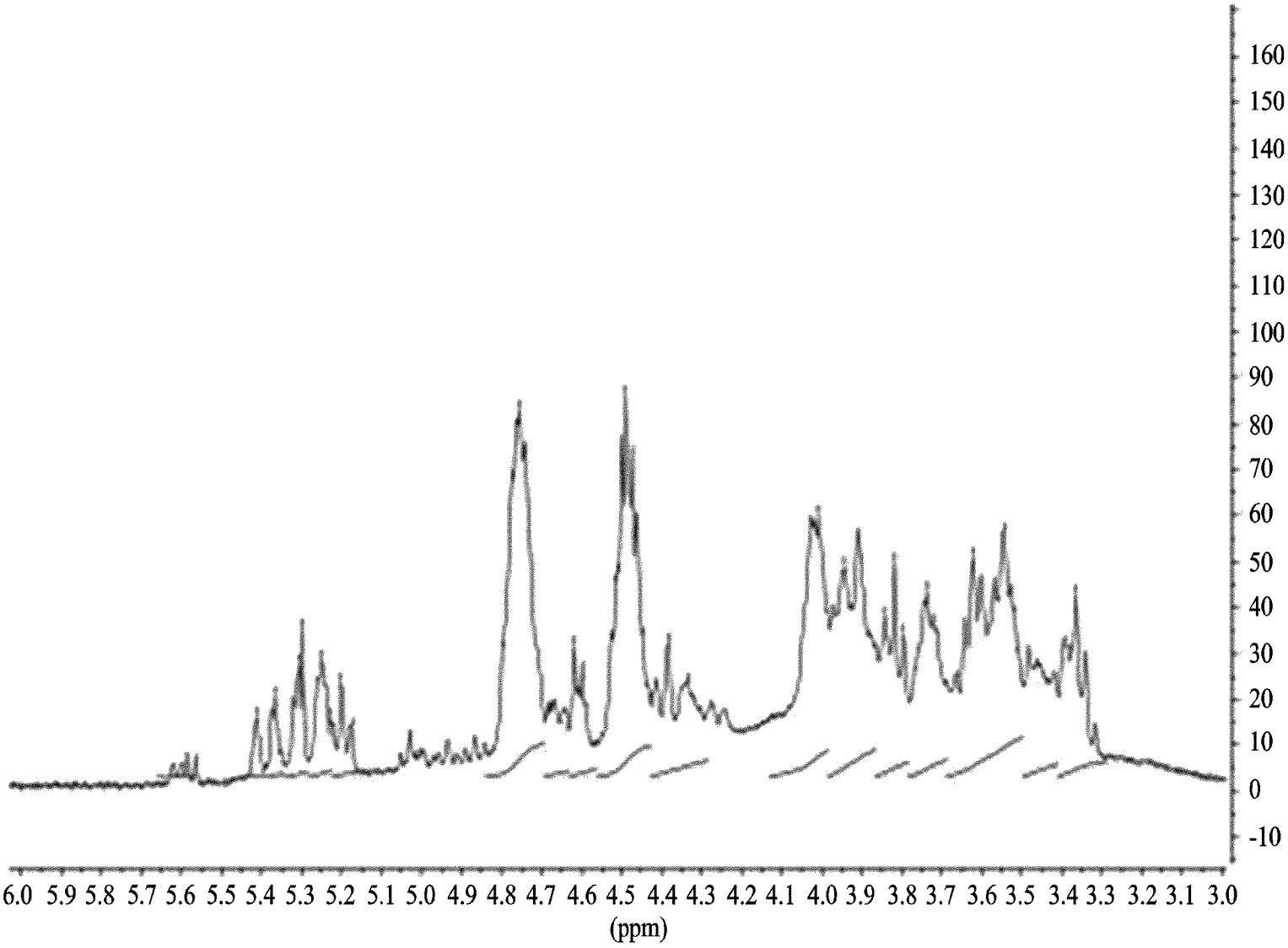
FIG. 5 illustrates results of NMR analysis of glucosyl-(4-mentylcarbonyloxy)heptanoate (5*a*) prepared in examples, according to an embodiment of the present disclosure.
Figure 6:
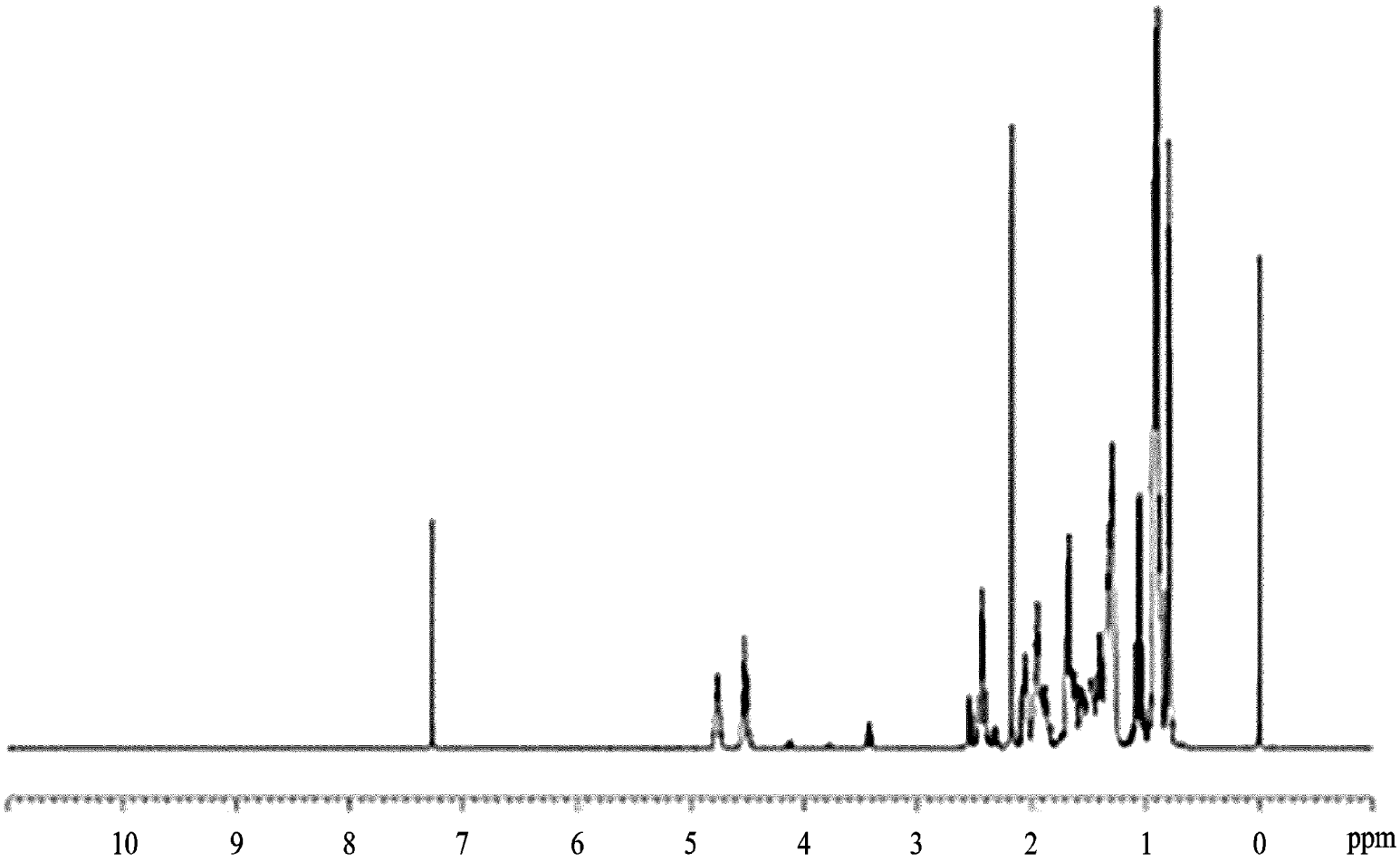
FIG. 6 illustrates results of NMR analysis of 4-(mentylcarbonyloxy)nonanoic acid (4*b*) prepared in examples, according to an embodiment of the present disclosure.
Figure 7:
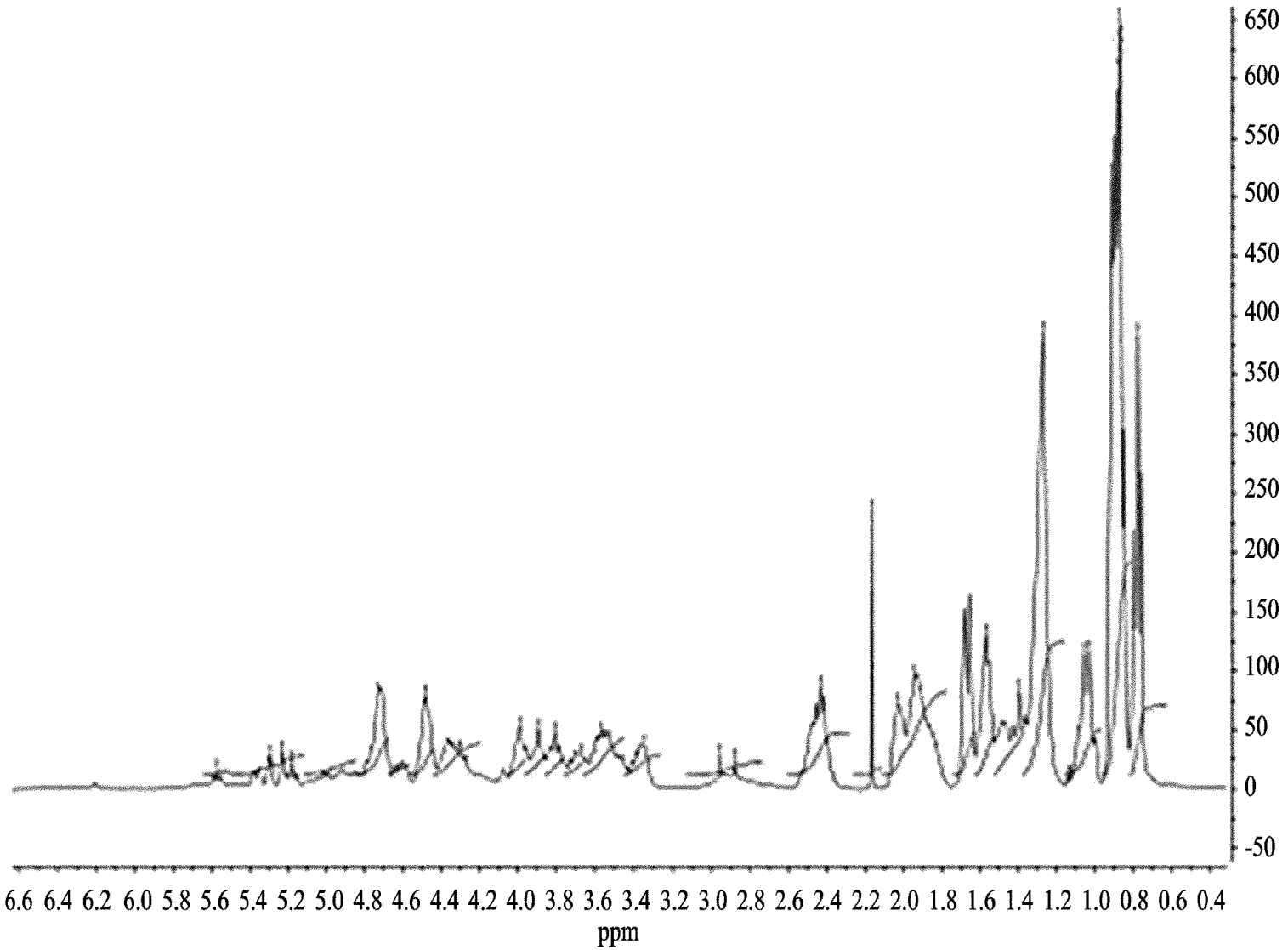
FIG. 7 illustrates results of NMR analysis of glucosyl-(4-mentylcarbonyloxy)nonanoate (5*b*) prepared in examples, according to an embodiment of the present disclosure.
Figure 8:
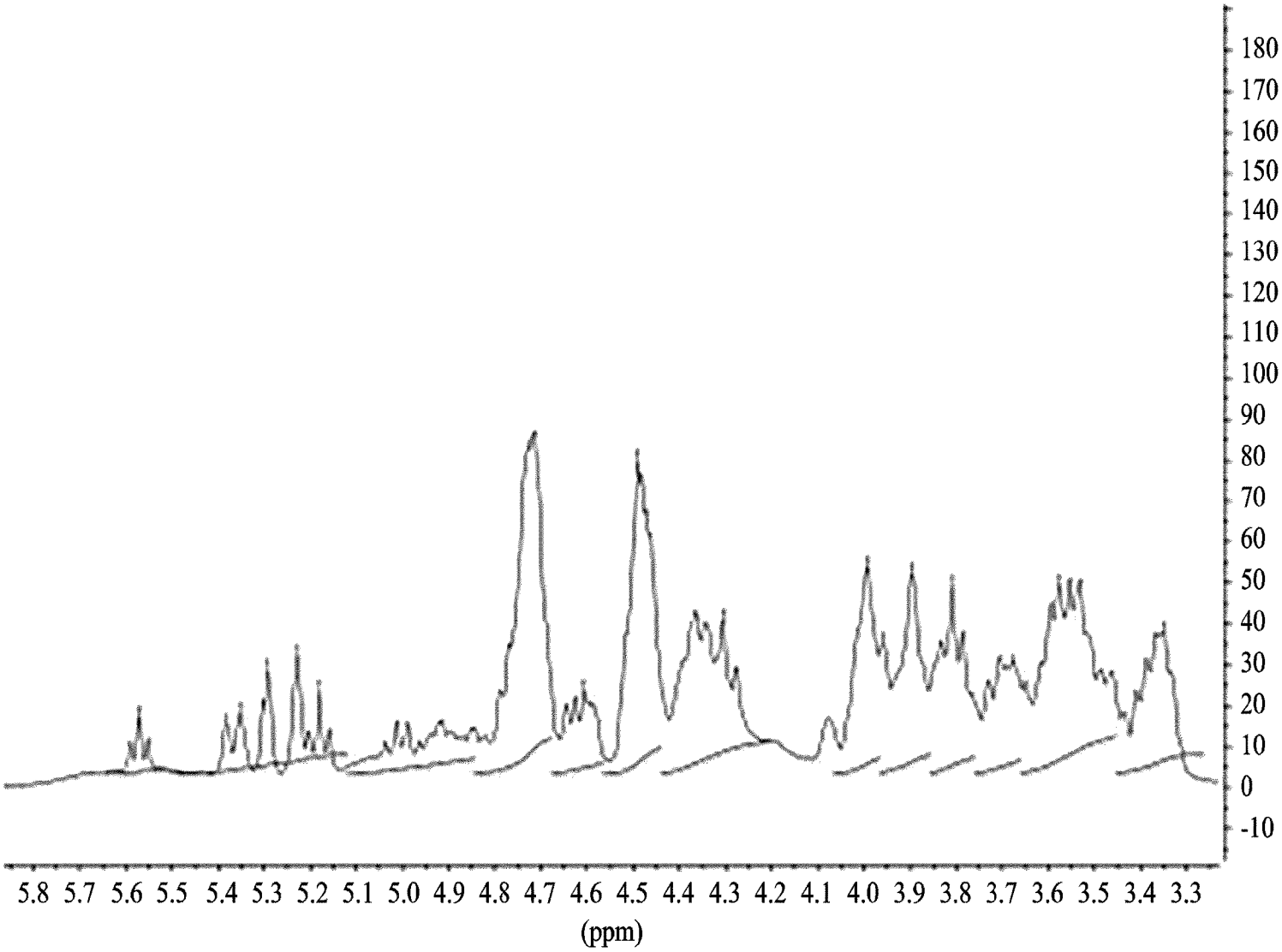
FIG. 8 illustrates results of NMR analysis of glucosyl-(4-mentylcarbonyloxy)nonanoate (5*b*) prepared in examples, according to an embodiment of the present disclosure.
Figure 9:
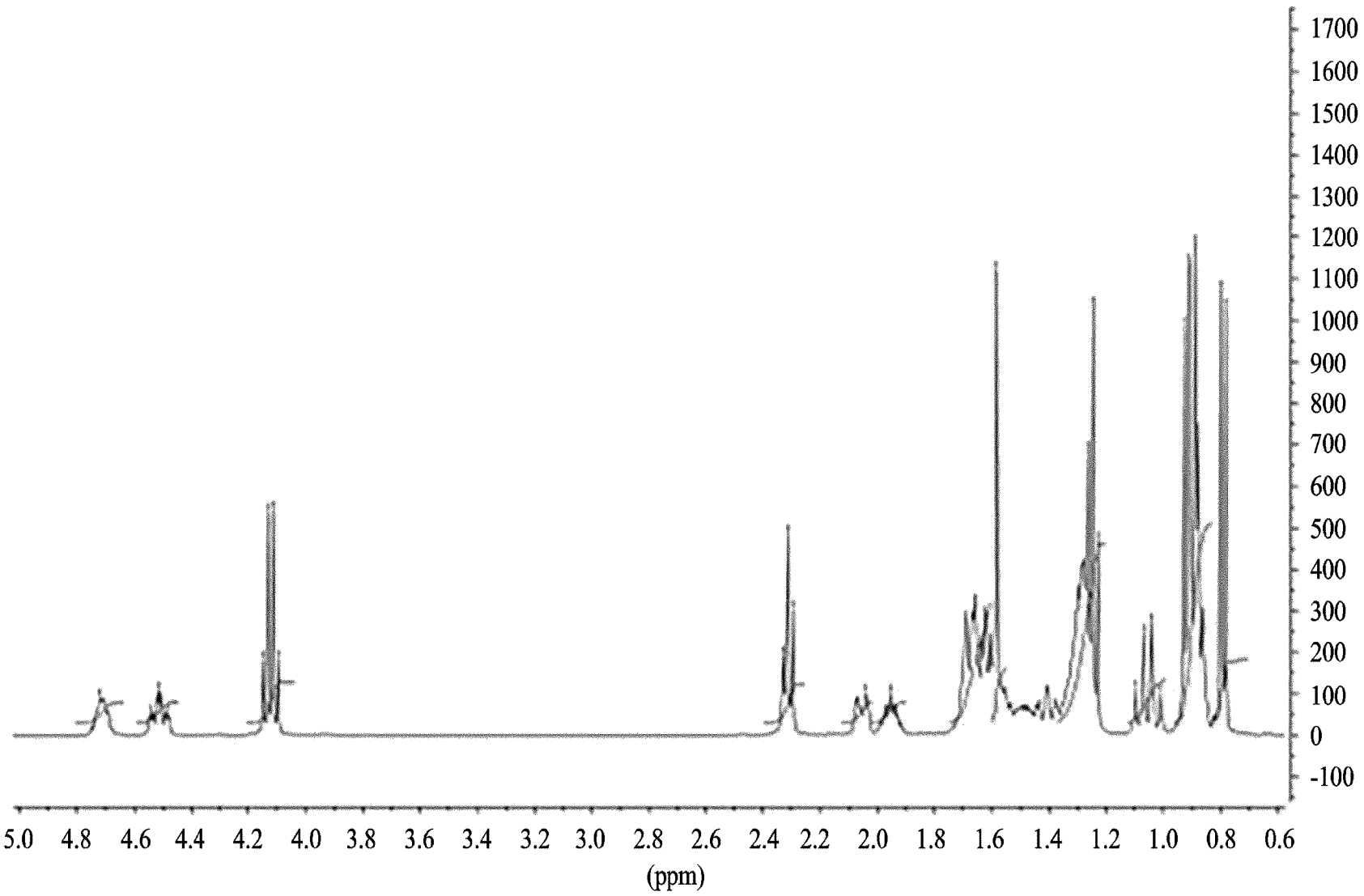
FIG. 9 illustrates results of NMR analysis of ethyl 5-(mentylcarbonyloxy) decanoate (3*c*) prepared in examples, according to an embodiment of the present disclosure.
Figure 10:
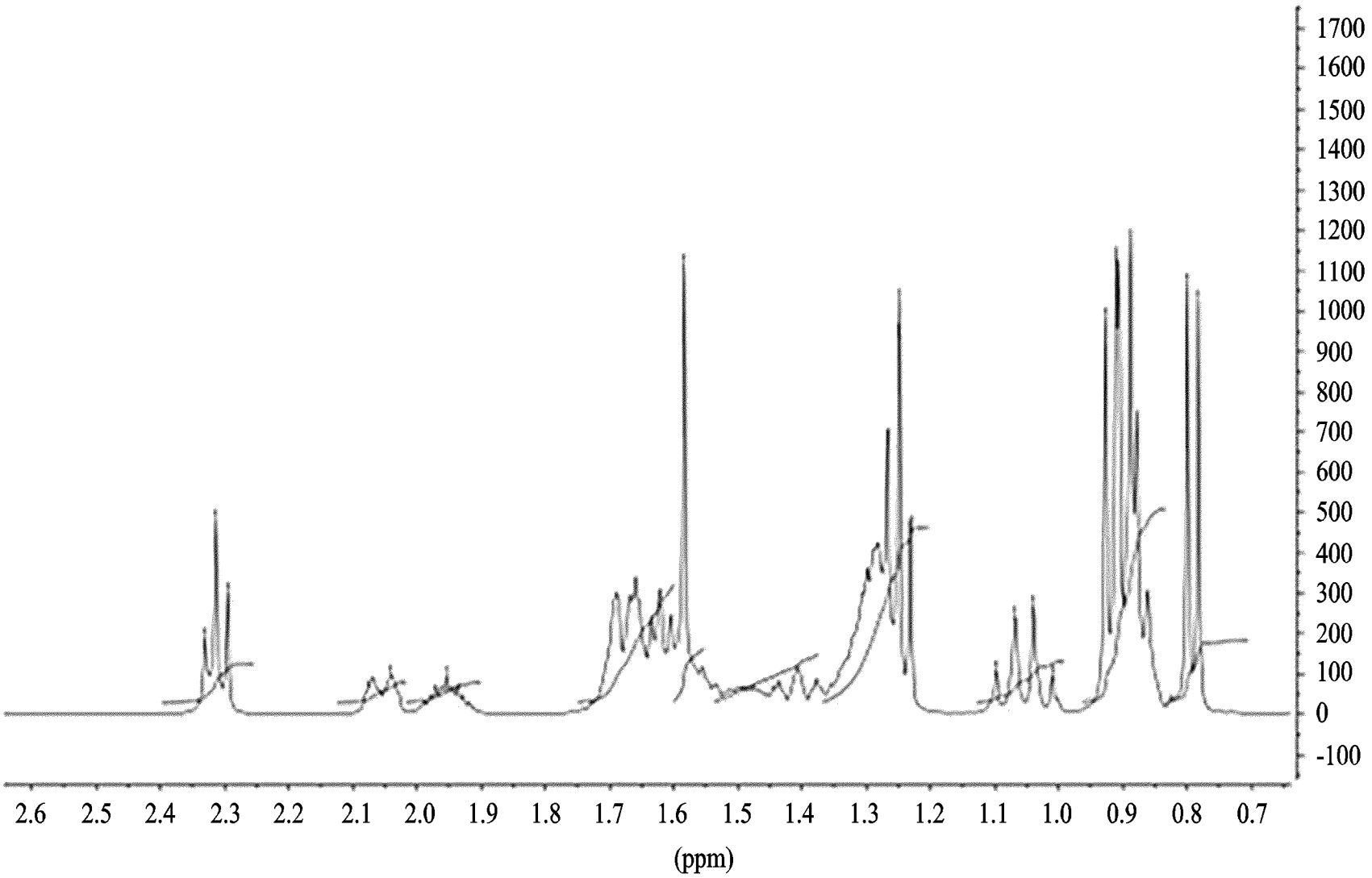
FIG. 10 illustrates results of NMR analysis of ethyl 5-(mentylcarbonyloxy) decanoate (3*c*) prepared in examples, according to an embodiment of the present disclosure.
Figure 11:
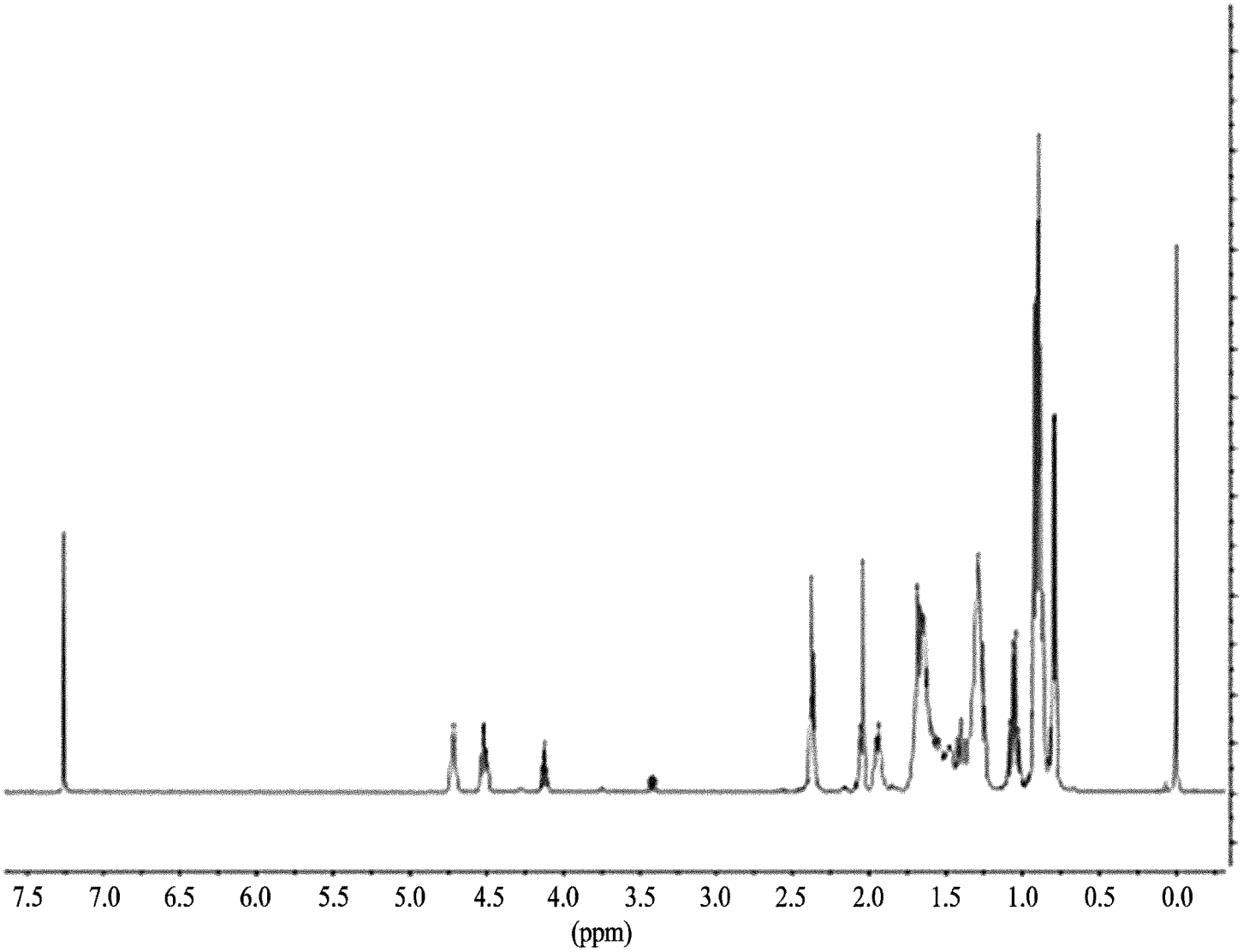
FIG. 11 illustrates results of NMR analysis of 5-(mentylcarbonyloxy) decanoic acid (4*c*) prepared in examples, according to an embodiment of the present disclosure.
Figure 12:
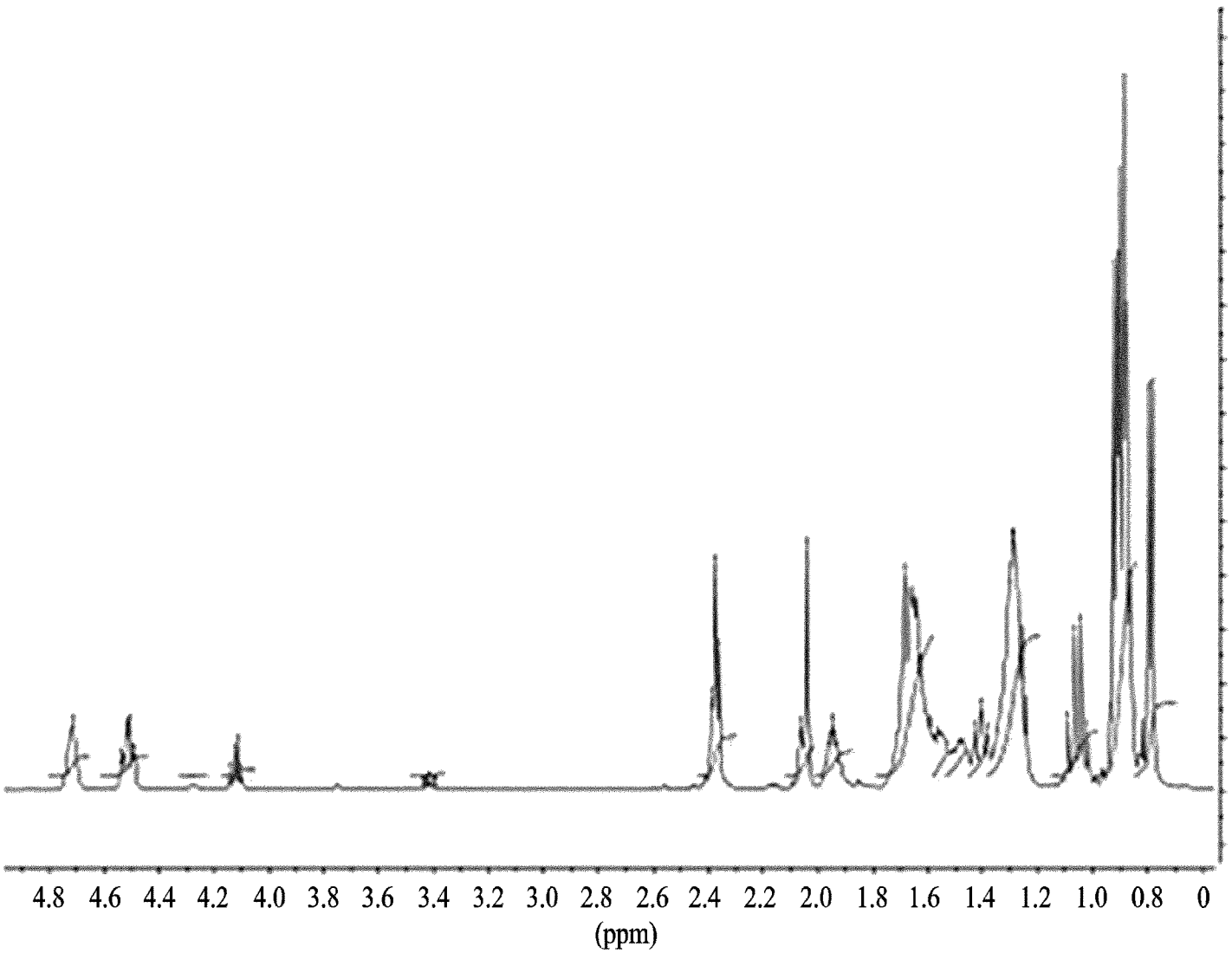
FIG. 12 illustrates results of NMR analysis of 5-(mentylcarbonyloxy) decanoic acid (4*c*) prepared in examples, according to an embodiment of the present disclosure.
Figure 13:
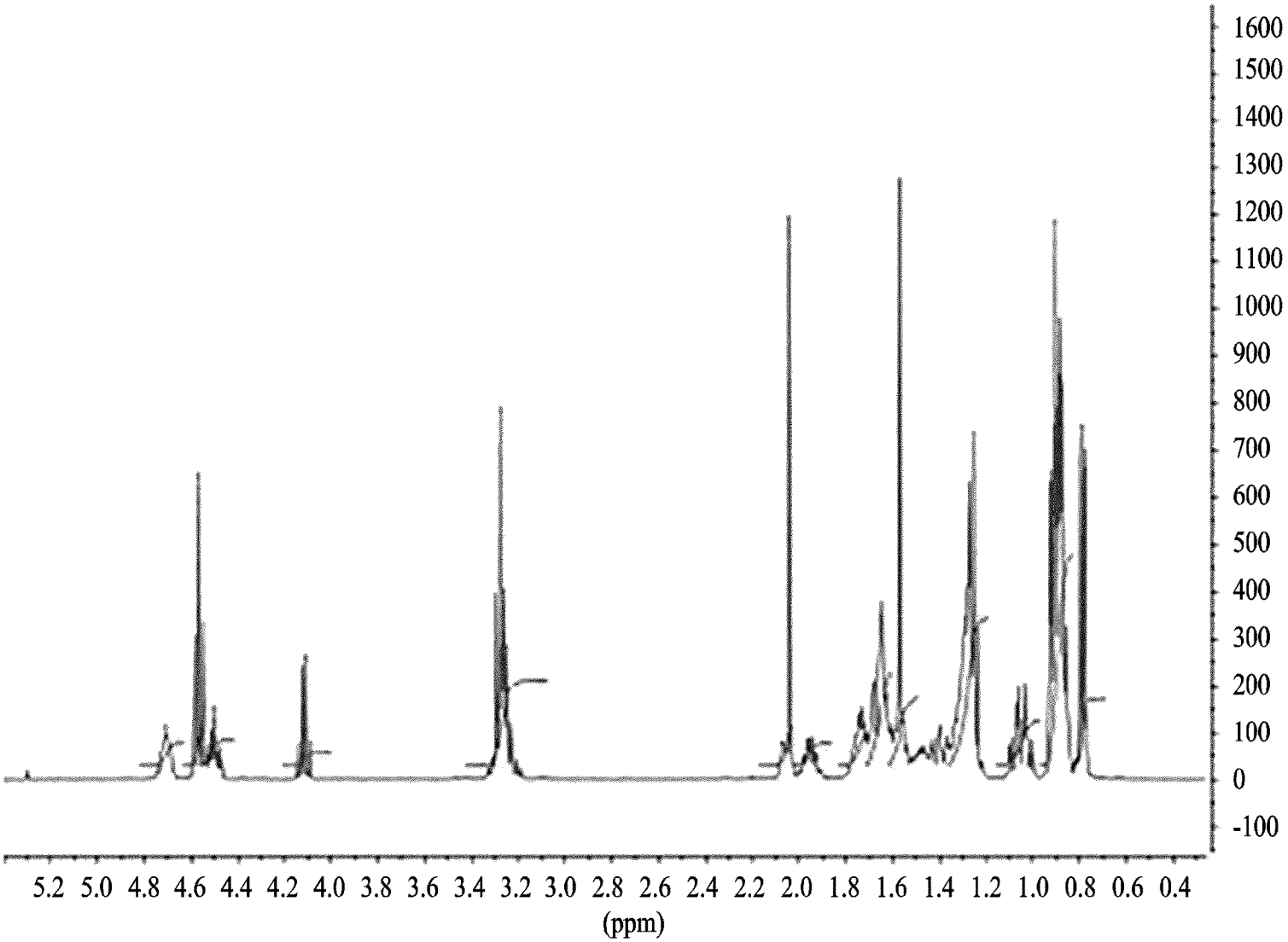
FIG. 13 illustrates results of NMR analysis of 5-isopropyl-2-methylcycloexyl-(1-oxo-1-(2-thioxothiazolidin-3-yl) decan-5-yl) carbonate (5*c*) prepared in examples, according to an embodiment of the present disclosure.
Figure 14:
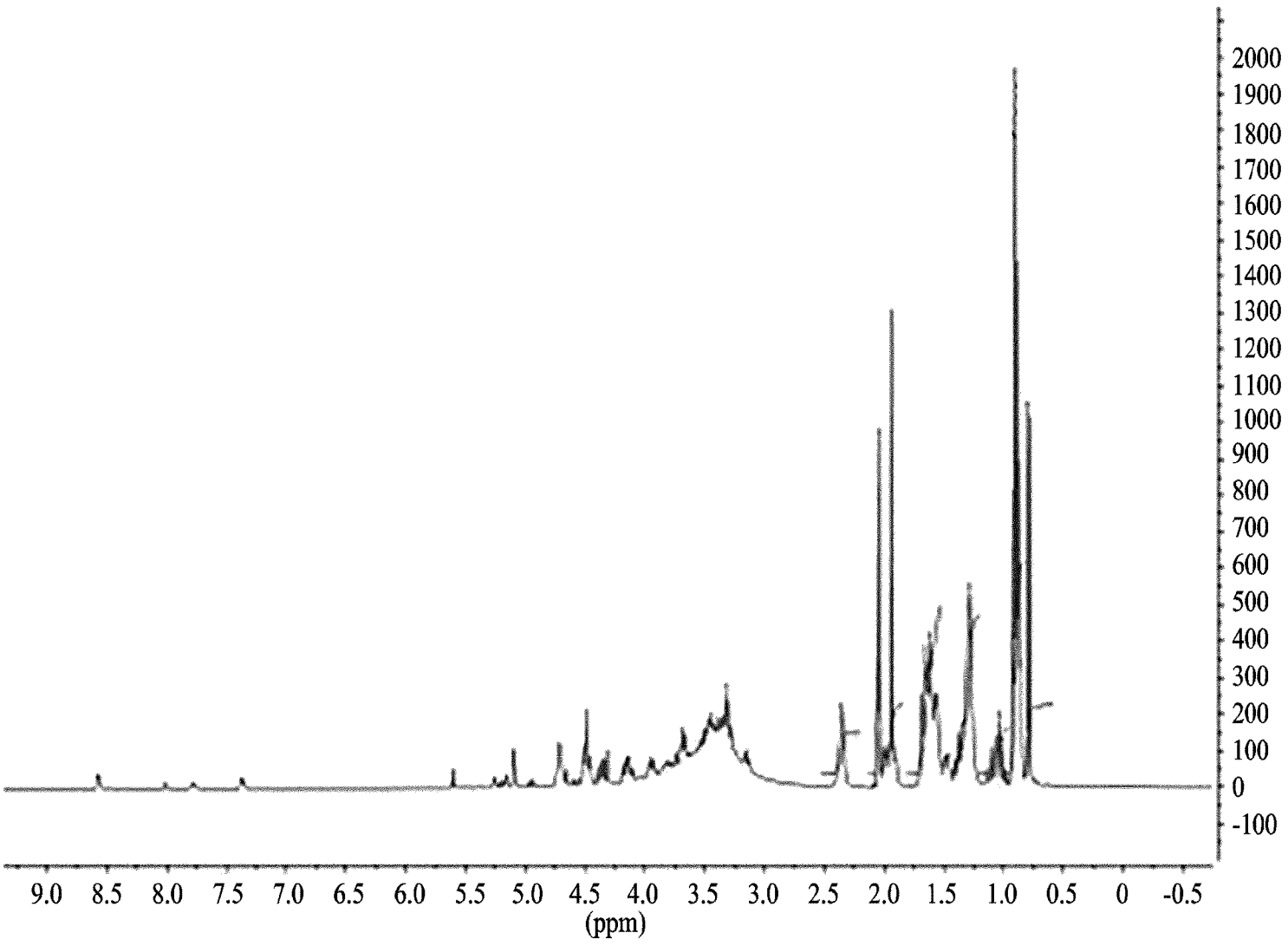
FIG. 14 illustrates results of NMR analysis of glucosyl-(5-mentylcarbonyloxy) decanoate (6*c*) prepared in examples, according to an embodiment of the present disclosure.
Figure 15:
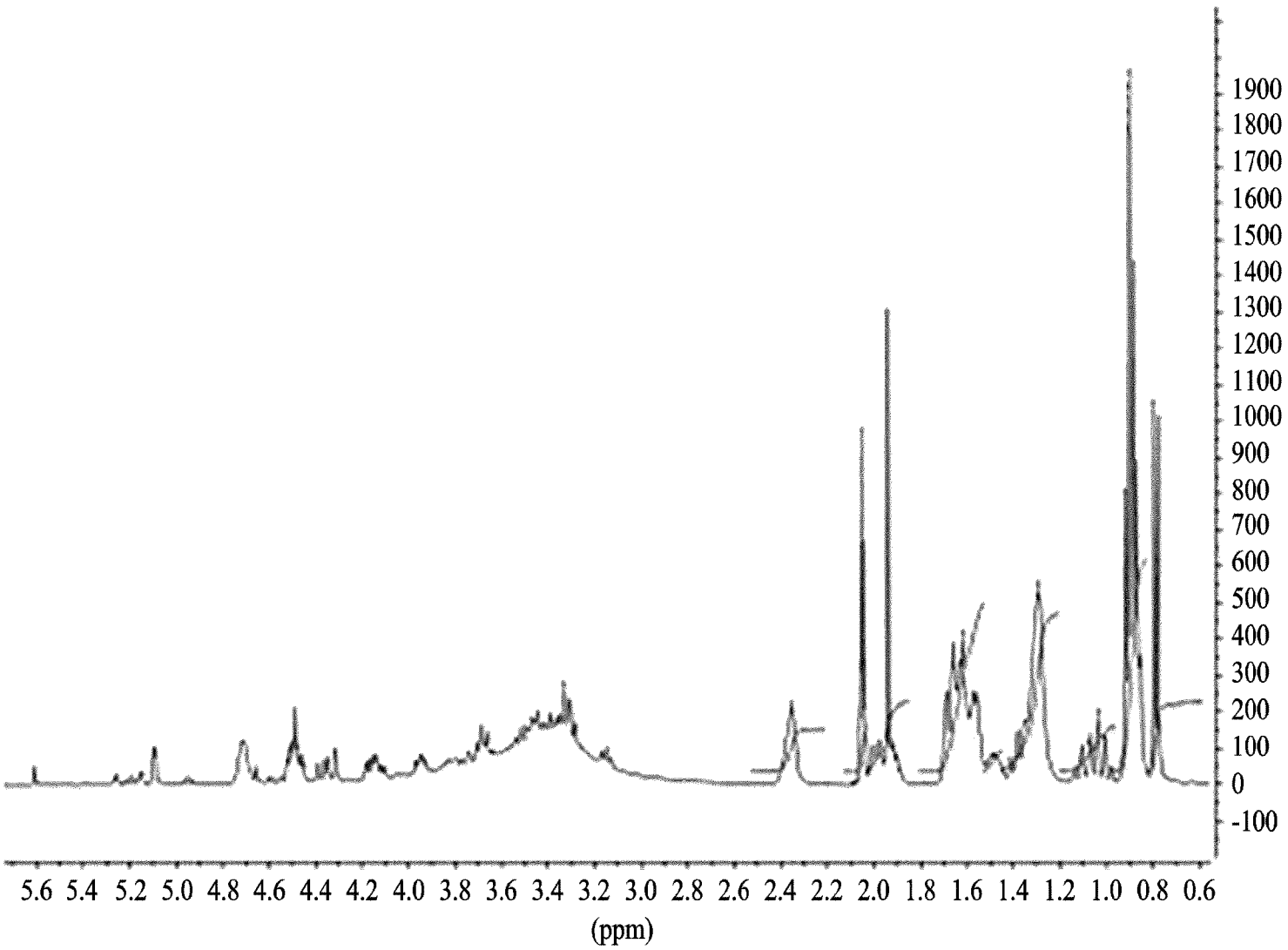
FIG. 15 results illustrates of NMR analysis of glucosyl-(5-mentylcarbonyloxy) decanoate (6*c*) prepared in examples, according to an embodiment of the present disclosure.
Figure 16:
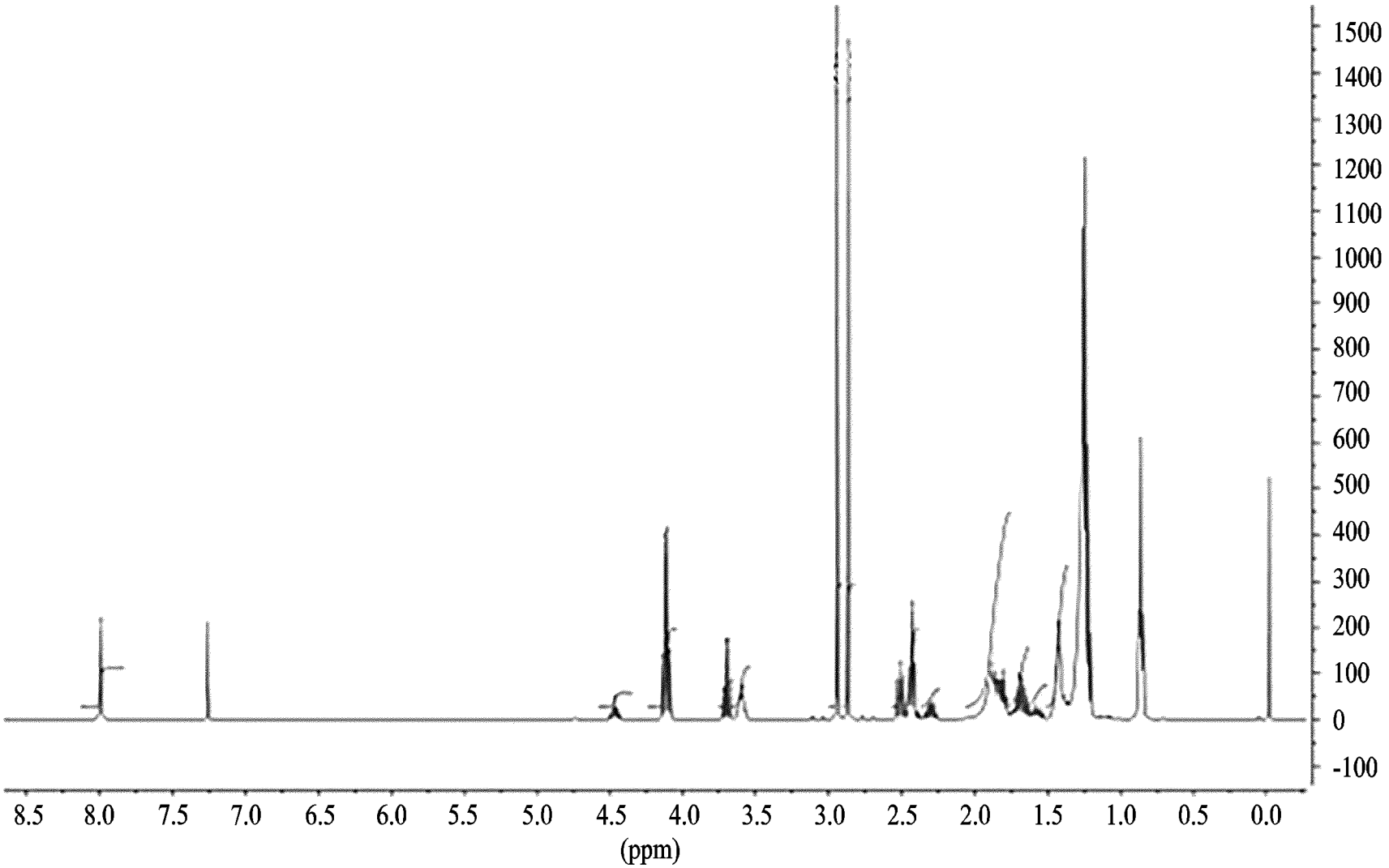
FIG. 16 illustrates results of NMR analysis of ethyl 4-hydroxyundecanoate (2*d*) prepared in examples, according to an embodiment of the present disclosure.
Figure 17:
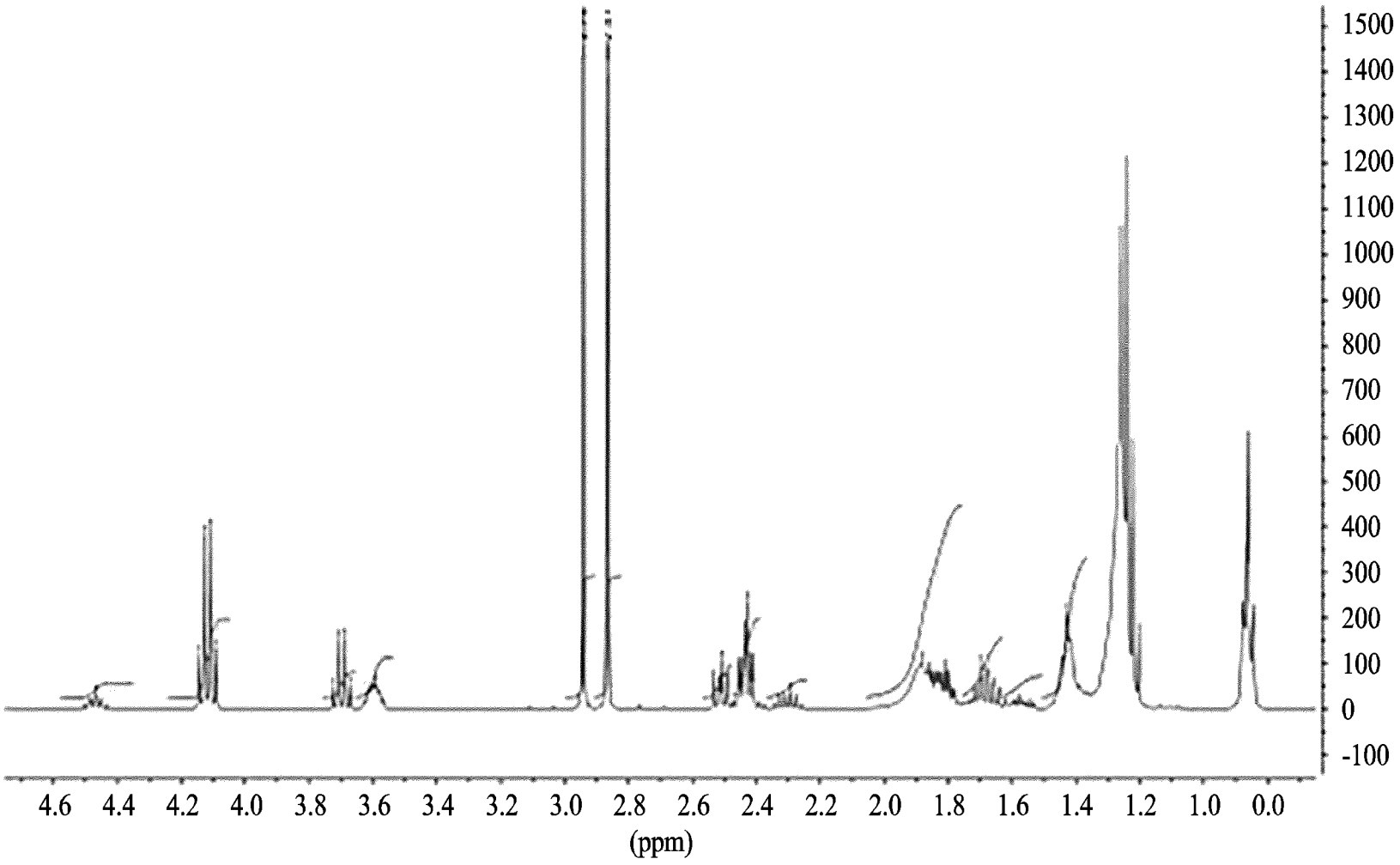
FIG. 17 illustrates results of NMR analysis of ethyl 4-hydroxyundecanoate (2*d*) prepared in examples, according to an embodiment of the present disclosure.
Figure 18:
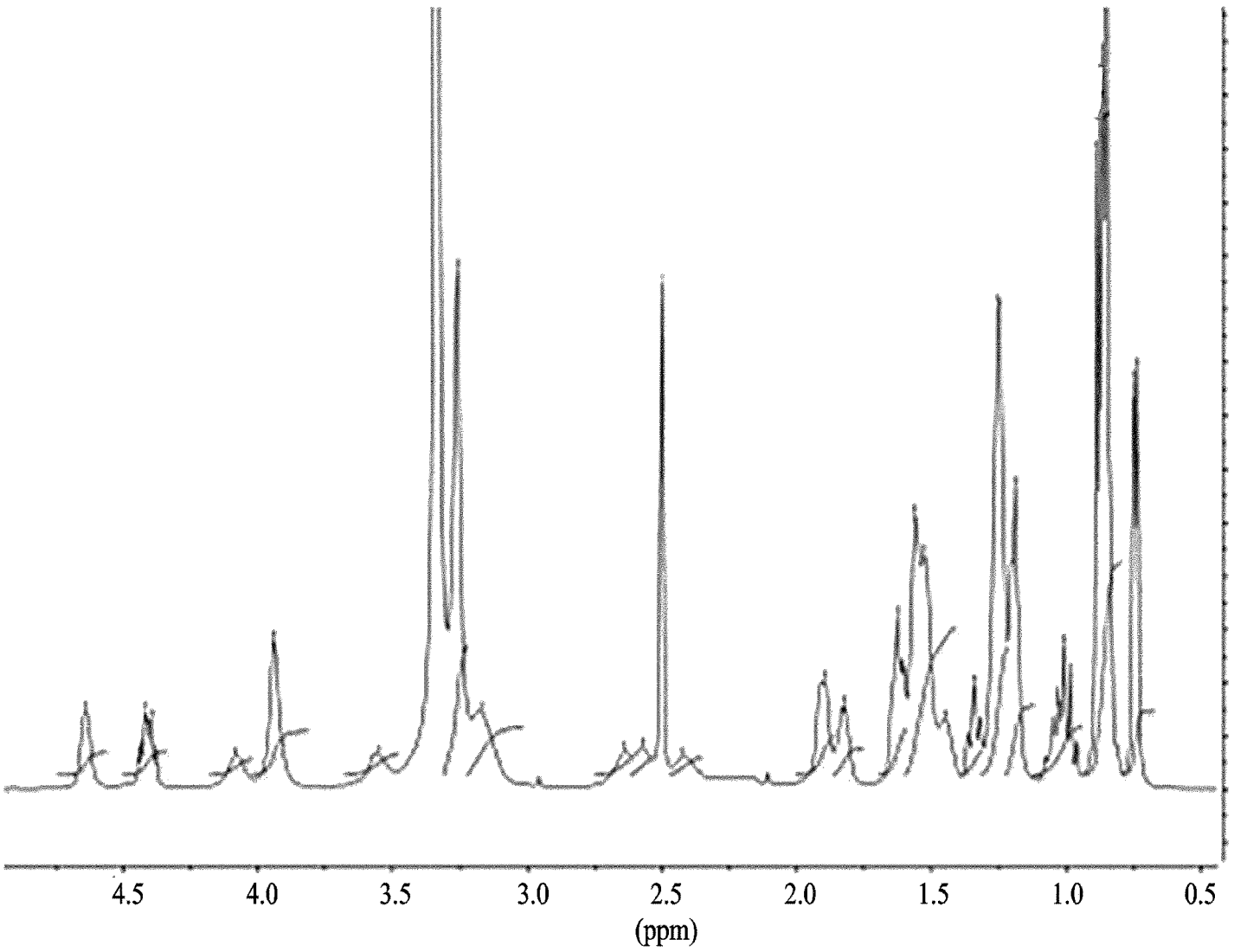
FIG. 18 illustrates results of NMR analysis of ethyl 4-(mentylcarbonyloxy)undecanoate (3*d*) prepared in examples, according to an embodiment of the present disclosure.
Figure 19:
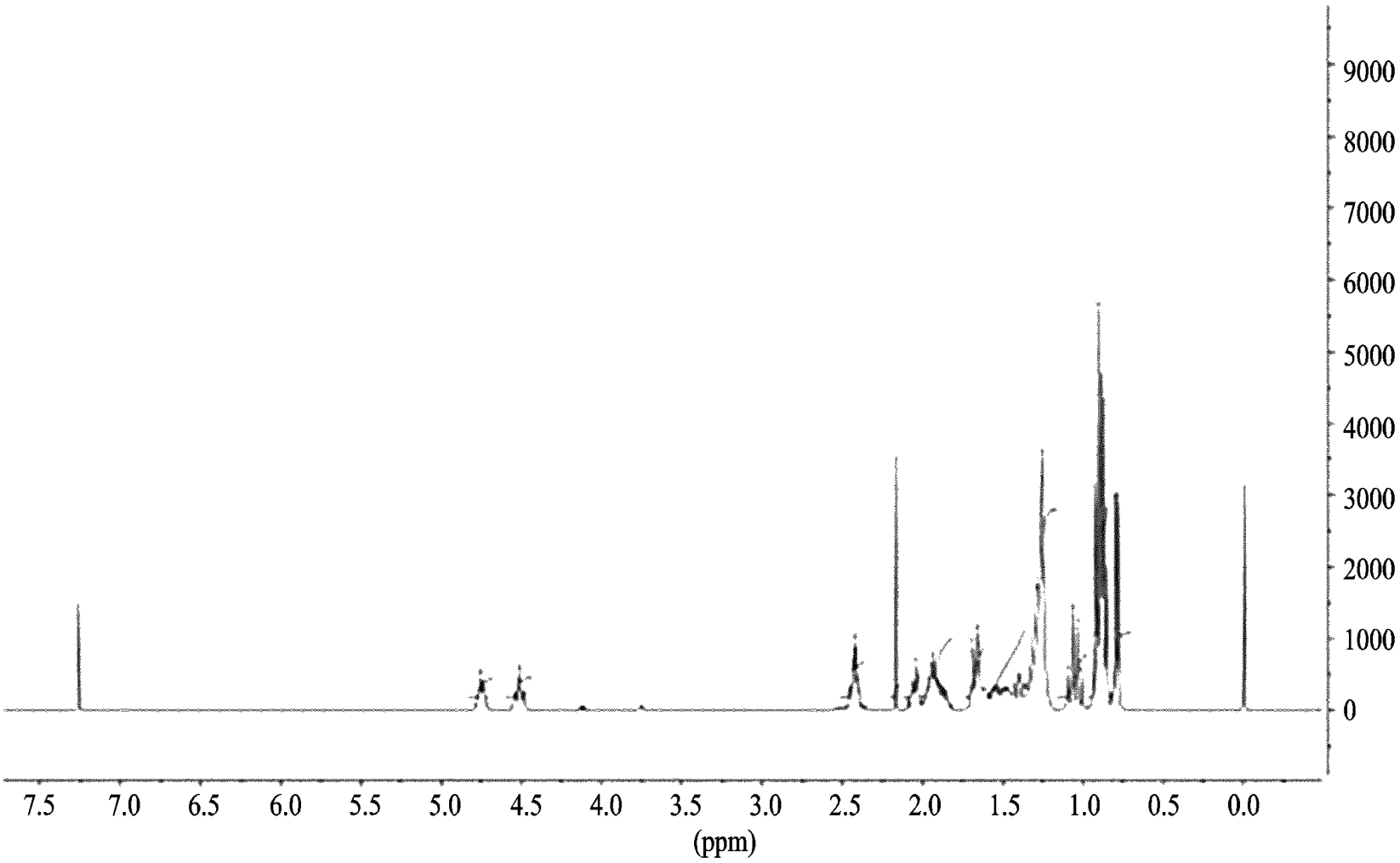
FIG. 19 illustrates results of NMR analysis of 4-(mentylcarbonyloxy)undecanoic acid (4*d*) prepared in examples, according to an embodiment of the present disclosure.
Figure 20:
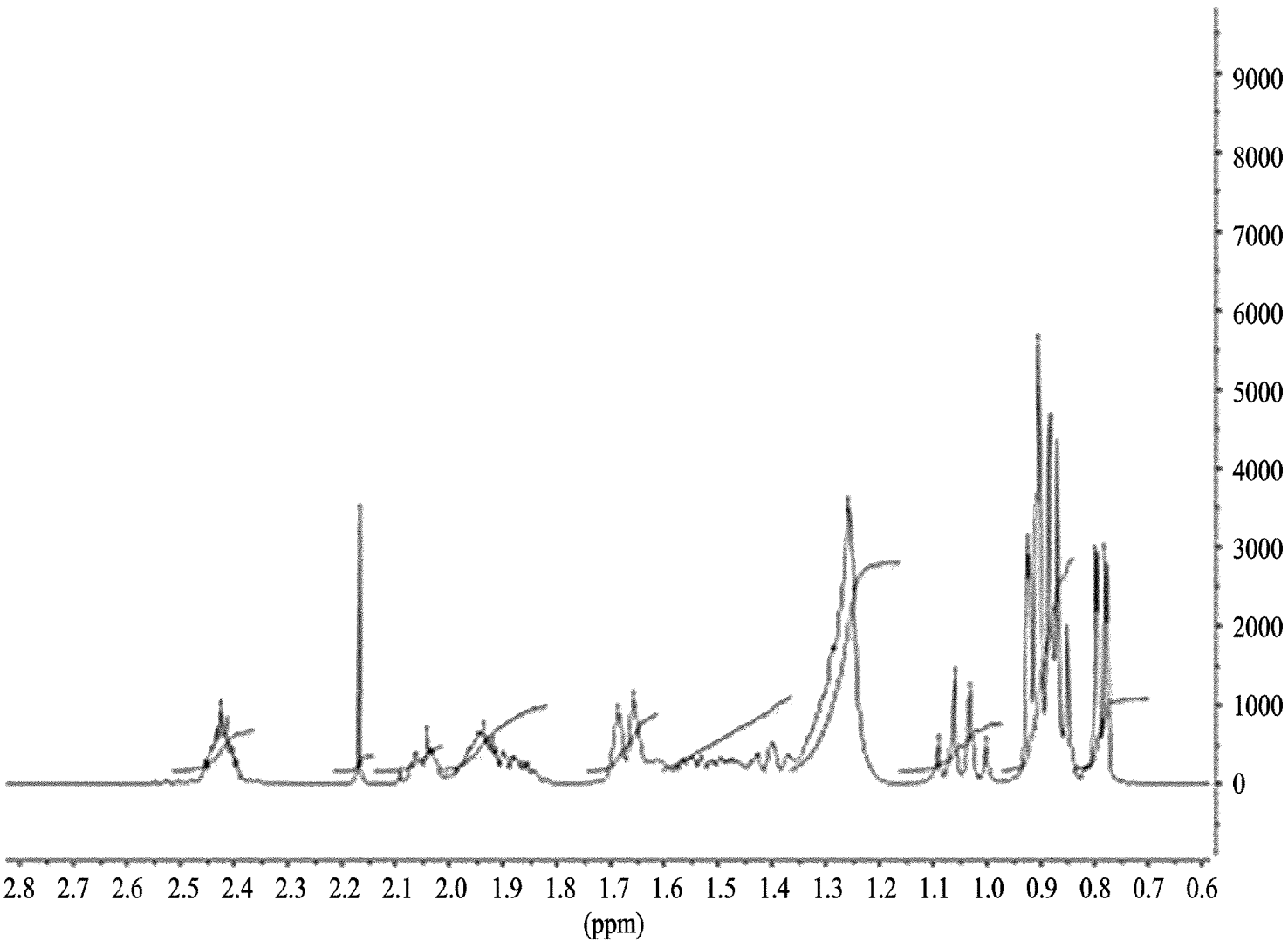
FIG. 20 illustrates results of NMR analysis of 4-(mentylcarbonyloxy)undecanoic acid (4*d*) prepared in examples, according to an embodiment of the present disclosure. 5
Figure 21:
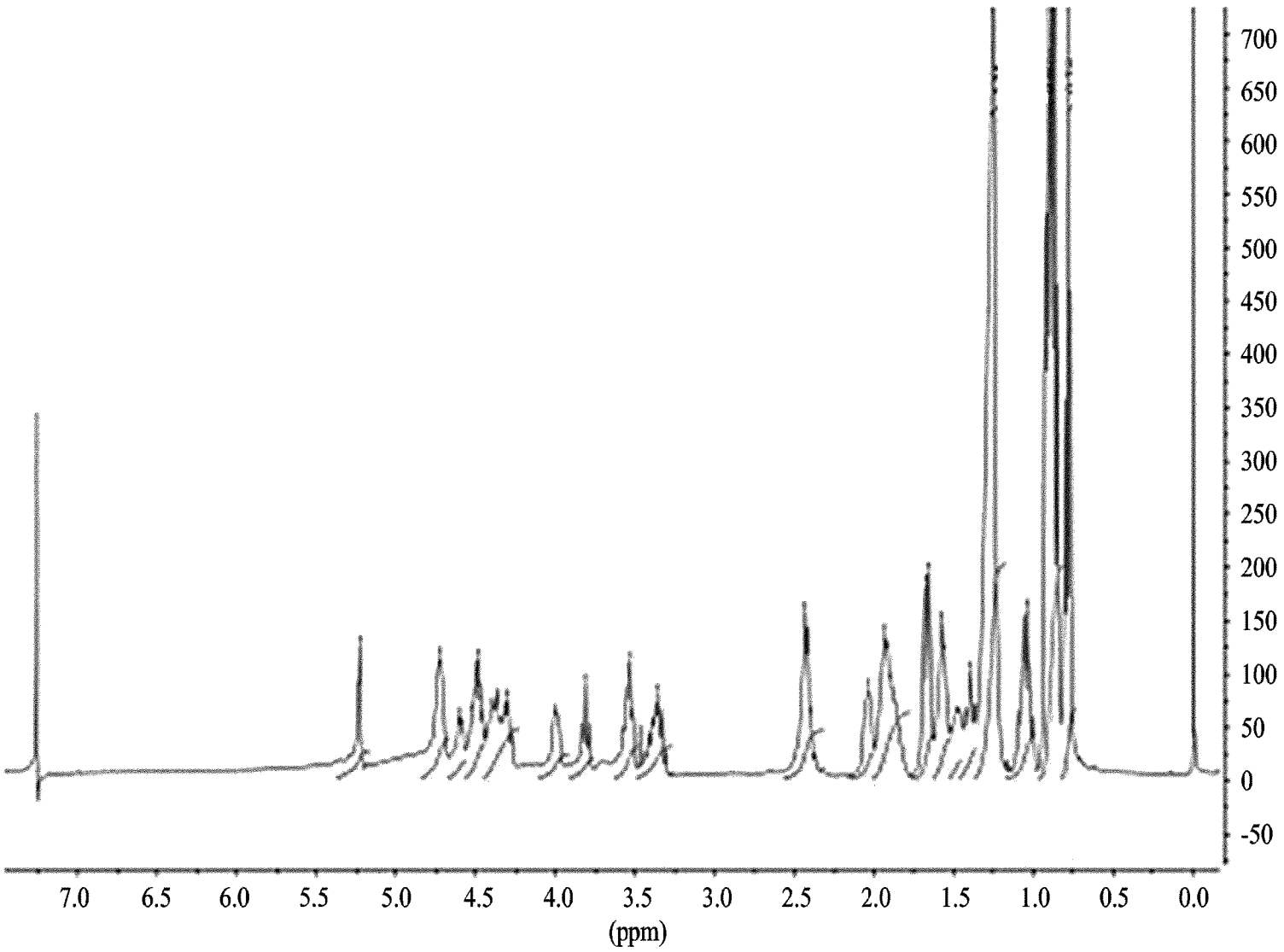
FIG. 21 illustrates results of NMR analysis of glucosyl-(4-mentylcarbonyloxy)undecanoate (6*d*) prepared in examples, according to an embodiment of the present disclosure.
Figure 22:
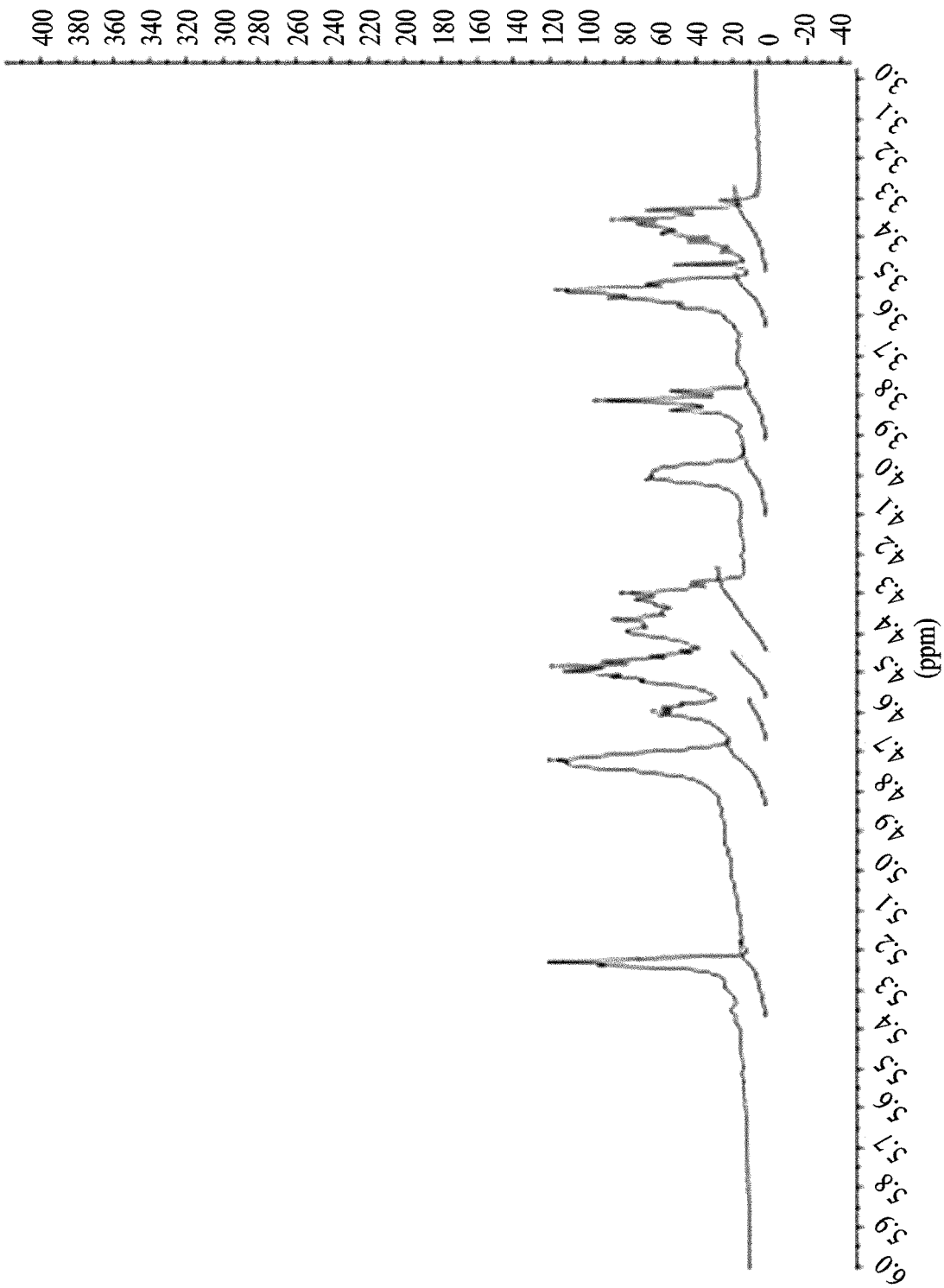
FIG. 22 illustrates results of NMR analysis of glucosyl-(4-mentylcarbonyloxy)undecanoate (6*d*) prepared in examples, according to an embodiment 10 of the present disclosure.
Figure 23:
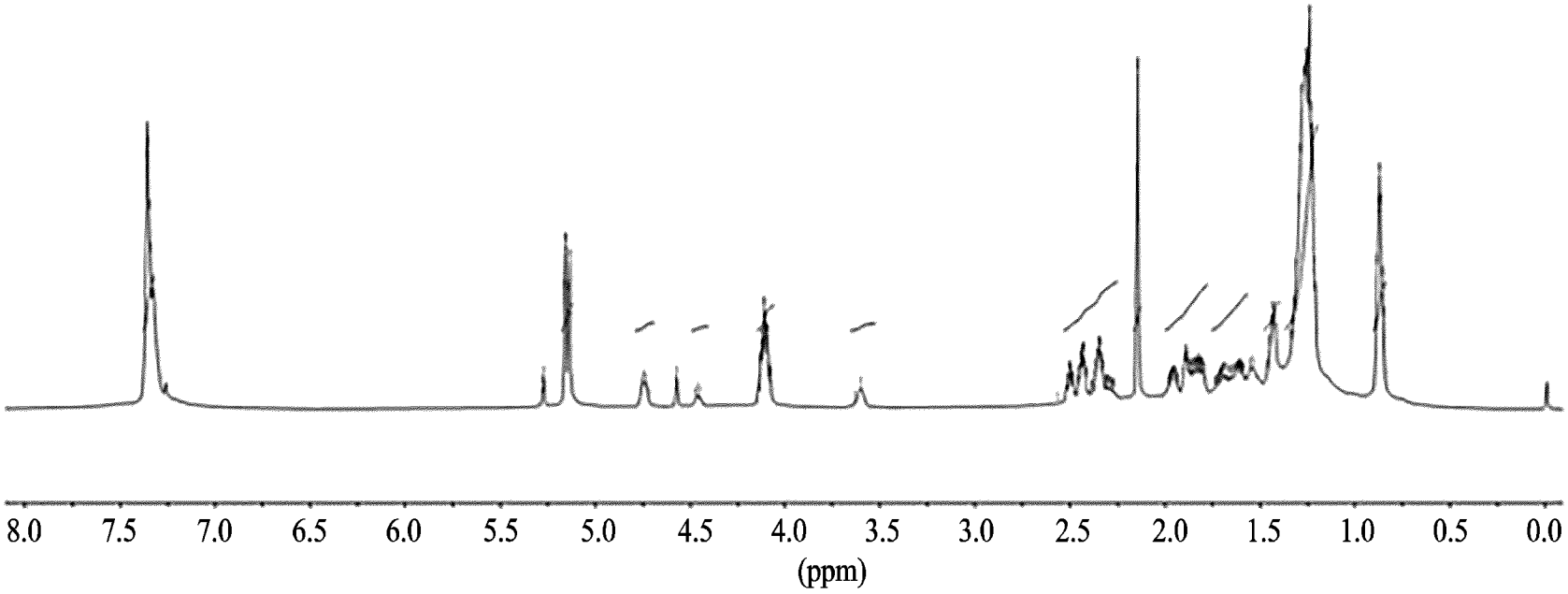
FIG. 23 illustrates results of NMR analysis of ethyl 4-(benzyloxycarbonyloxy)undecanoate (3*e*) prepared in examples, according to an embodiment of the present disclosure.

However, hereinafter, embodiments of the present disclosure will be described in detail with reference to the accompanying drawings. In describing the embodiment of the present disclosure, a detailed description of known functions or constitutions will be omitted if it is determined that they unnecessarily make the gist of the present disclosure unclear. Terminologies used herein are terminologies used to properly express preferred embodiments of the present disclosure, which may vary according to a user, an operator's intention, or customs in the art to which the present disclosure pertains. Therefore, definitions of these terminologies will have to be made based on the content throughout this specification. Like reference numerals presented in each drawing indicate like elements.

Throughout this specification, it will be understood that when a member is referred to as being "on" another member, it can be directly on the other member or intervening members may also be present.

Throughout the specification, when a certain part "comprises" a certain component, it will be understood to imply the inclusion of stated elements but not the exclusion of any other elements.

Hereinafter, the present disclosure will be described in detail with reference to embodiments and drawings for a smoking article including a novel flavoring agent. However, the present disclosure is not limited to these embodiments and drawings.

The present disclosure relates to a smoking article including a novel flavoring agent that develops flavor components upon pyrolysis, and according to an embodiment of the present disclosure, the flavoring agent develops volatile flavoring components by pyrolysis when heat is applied, and may enhance the tobacco taste and its durability.

That is, synthetic compounds (e.g., flavoring agents) that develop the flavoring components upon pyrolysis are applied to components (e.g., cigarette paper) of cigarettes to develop flavoring components (e.g., lactones or menthol) by heat during tobacco burning, particularly during smouldering, by heat, thereby providing an effect of improving the acrid smell of sidestream smoke. In addition, when the synthetic compounds are applied to a medium of a heated cigarette stick, the taste persistence of the flavoring components may be imparted. For example, in the heated cigarette, the flavoring components contained in the medium are exhausted from initial puffing by static heating, but synthetic compounds that develop the flavoring components upon pyrolysis are developed only when decomposed by heat. Accordingly, even if the puffing lasts, the flavoring components are generated even in the last puff, so that the tobacco taste may be maintained constantly.

According to an embodiment of the present disclosure, the flavoring agent may be a compound represented by Formula 1 below.

[Formula 1]

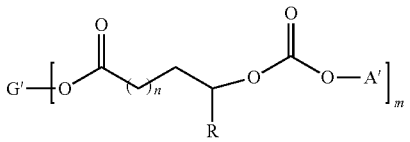

As an example of the present disclosure, Formula 1 includes a sugar compound-derived moiety G' and a flavoring compound-derived moiety A', in Formula 1, the flavoring compound is covalently bound with a carbonate linkage, and the sugar compound may be bound with an ester linkage

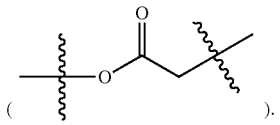

When heat is applied, the compound of Formula 1 is pyrolyzed to be decomposed and released into flavoring components of the sugar compound, the flavoring compound, and a lactone compound. For example, the compound of Formula 1 may be synthesized by reacting with a hydroxyl group (—OH) of the sugar compound to be linked to an ester linkage, and reacting with a hydroxyl group of the flavoring compound to be linked to a carbonate linkage

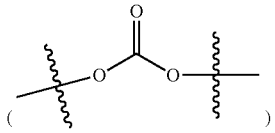

by a ring opening mechanism of the lactone compound. That is, the compound of Formula 1 has structural stability at approximately room temperature or a temperature close thereto and low volatility, and is decomposed into the sugar compound G, the lactone compound, and the flavoring compound A because the carbonate linkage and the ester linkage are broken by a ring closing mechanism when the heat is applied, so that the flavor is released and carbon dioxide harmless to the human body may be generated during the decomposition process. Since the carbonate linkage is broken by heat, the compound of Formula 1 is decomposed into the flavoring compound to generate carbon dioxide, and then since the ester linkage is broken by closing the ring, the compound of Formula 1 is decomposed into the sugar compound and the lactone compound to develop the flavor.

According to an embodiment of the present disclosure, the moiety A' in Formula 1 may be a moiety derived from a flavoring compound having at least one of an aromatic ring having a hydroxyl group, an aliphatic ring having a hydroxyl group, and an aliphatic chain having a hydroxyl group. The hydroxyl group includes a ring, a chain, or at least one (e.g., one or two) of both, and may correspond to a substituent, a basic backbone, and/or a moiety having a hydroxyl group. The hydroxyl group participates in a covalent bond of the carbonate linkage in Formula 1, and the moiety A' may correspond to a flavoring compound excluding the hydroxyl group. That is, since the hydroxyl group of the flavoring compound in the moiety A' is protected with the carbonate linkage, a decomposition reaction due to ring-closing at room temperature may be prevented.

According to an embodiment of the present disclosure, the flavoring compound may be selected from the group consisting of a cyclic monoterpene-based compound having a hydroxyl group, an acyclic monoterpene-based compound having a hydroxyl group, an aromatic compound of 6 to 10 carbon atoms having a hydroxyl group, and non-aromatic rings of 5 to 10 carbon atoms; or 5 to 6 carbon atoms having a hydroxyl group and isomers thereof. For example, the flavoring compound may be a compound which is selected from the following compounds, and produced when the carbonate linkage of Formula 1 is broken during pyrolysis.

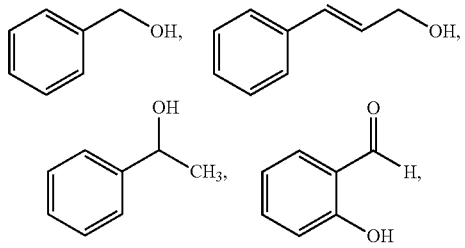

-continued
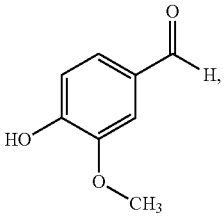
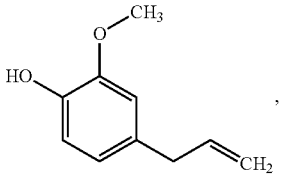
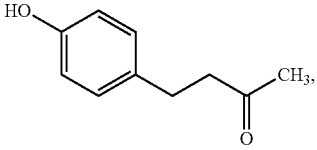
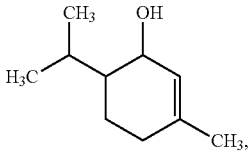
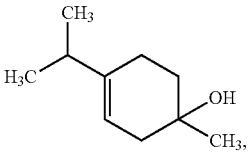
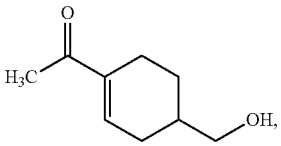
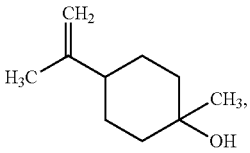
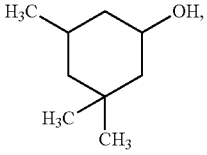
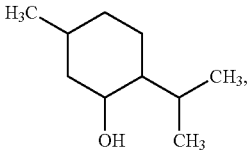
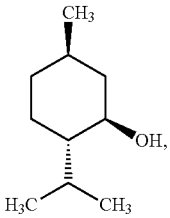
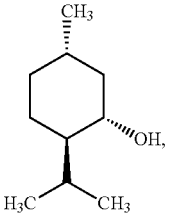
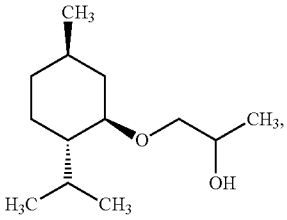
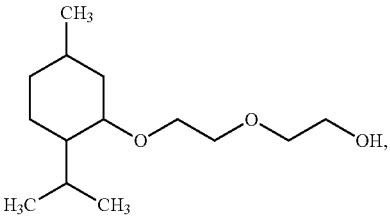
-continued
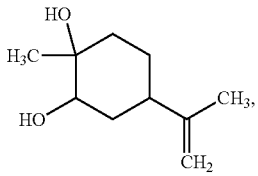
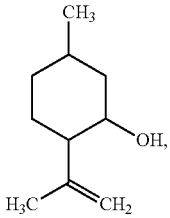
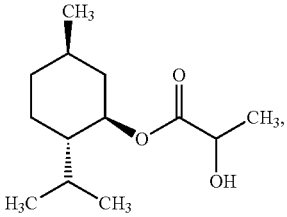
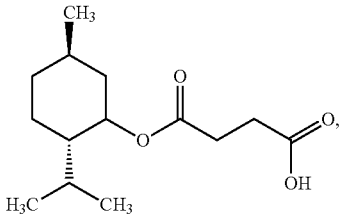
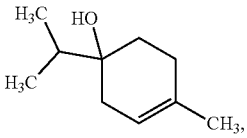
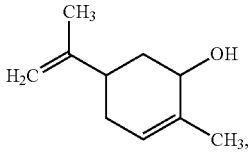
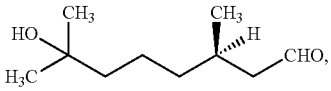
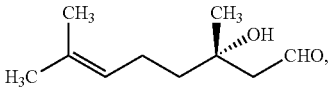
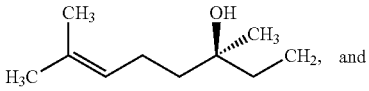
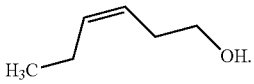
According to an embodiment of the present disclosure, the moiety A' may be selected from the following Formulas. Here, * corresponds to an oxygen site in the carbonate linkage.
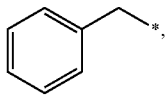
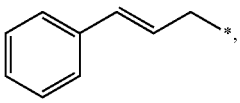
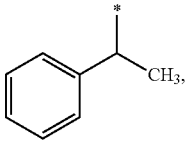
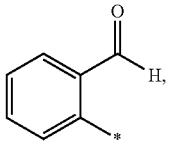

-continued

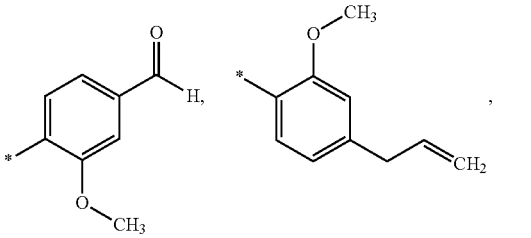

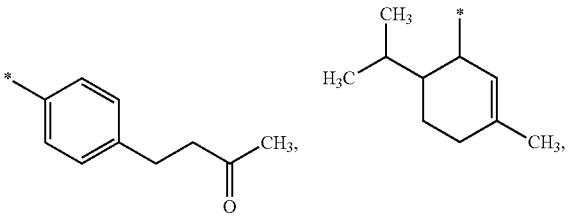

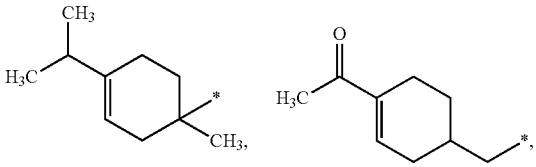

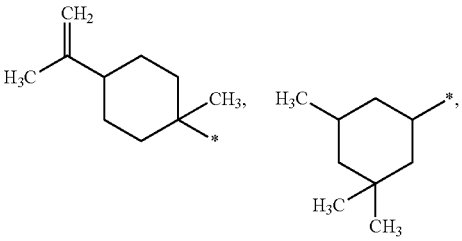

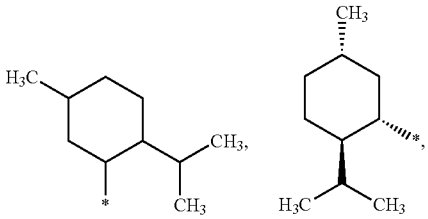

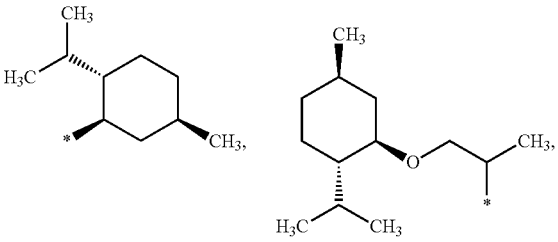

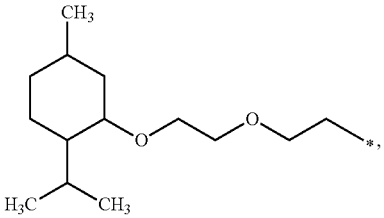

-continued

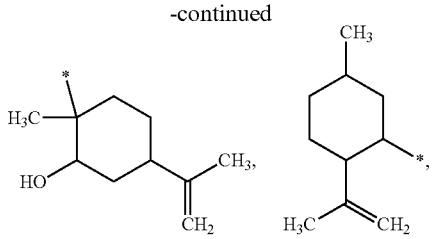

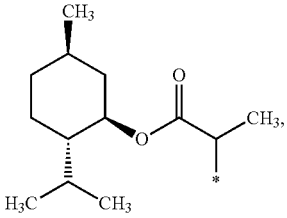

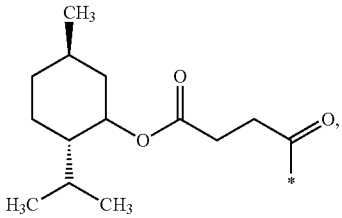

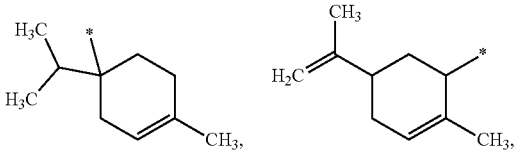

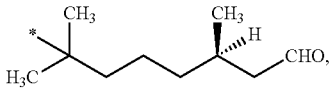

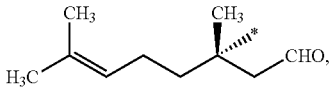

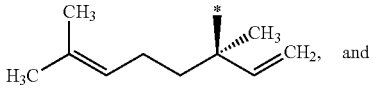

and

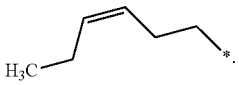

According to an embodiment of the present disclosure, the moiety G' is a moiety derived from the sugar compound, and generated when the hydroxyl group linked to the ring of the sugar compound participates in the ester linkage

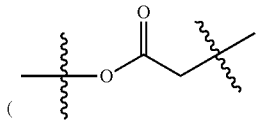

and the moiety G' may correspond to the sugar compound excluding the hydroxyl group. The compound of Formula 1 may maintain the structural stability by lowering volatility at room temperature by linkage of the sugar compound and increase solubility in organic solvents. The compound of Formula 1 may increase the compatibility and/or processability in various matrices (or substrates), and expand its application field to food and a smoking article.

According to an embodiment of the present disclosure, the sugar compound includes a 6-membered ring, a 5-membered ring, or both, and at least one; at least two; at least three; or the whole of hydroxyl groups linked to a ring constituting the sugar compound may participate in the ester linkage of Formula 1. For example, the ester linkage by a single or a plurality of hydroxyl groups may be formed so that a "[ ]" part in Formula 1, that is, a single or a plurality of

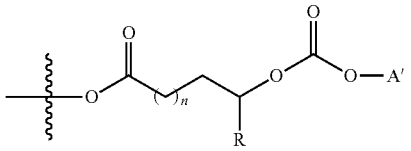

may be linked to the moiety G'.

According to an embodiment of the present disclosure, the m is the number of "[ ]" part, that is,

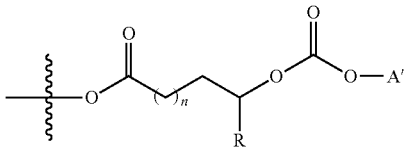

linked to moiety G' by the ester linkage, and may be an integer of 1 to 8; 1 to 7; 1 to 6; 1 to 5; 1 to 4; 1 to 3; or 1 to 2.

According to an embodiment of the present disclosure, the sugar compound may be selected from the group consisting of, for example, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, glucose, idose, talose, erythrurose, xylulose, psicose, turanose, cellobiose, amylopectin, glucosamine, mannosamine, fucose, glucuronic acid, glucosan, gluco-lactone, abequose, galactosamine, isomalto-oligosaccharide, xylo-oligosaccharide, gentio-oligosaccharide, sorbose, nigero-oligosaccharide, palatinose oligosaccharide, fructooligosaccharide, maltotetraol, maltotriol, malto-oligosaccharide, lactulose, melibiose, raffinose, rhamnose, and ribose. Preferably, the sugar compound may be glucose, lactose, maltose, galactose, sucrose, D-fructose, gulose, talose, and idose.

According to an embodiment of the present disclosure, the flavoring agent may be selected from Formulas 1-1 to 1-9 below.

[Formula 1-1]

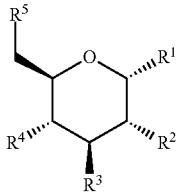

-continued

[Formula 1-2]

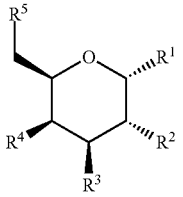

[Formula 1-3]

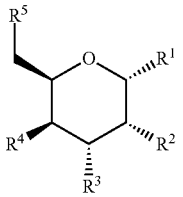

[Formula 1-4]

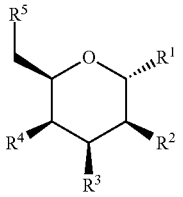

[Formula 1-5]

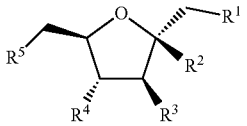

As an example of the present disclosure, in Formulas 1-1 to 1-5, $R^1$ to $R^5$ may be selected from a hydroxyl group (—OH) and 5 each

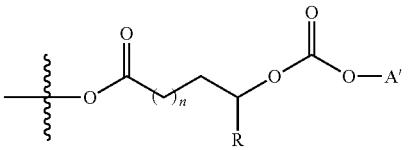

(n, R and A' are as defined in Formula 1.).

Preferably,

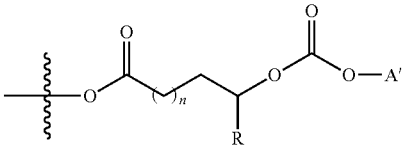

may correspond to at least one; at least two; at least three; at least four; or the whole of $R^1$ to $R^5$, more preferably at least one of $R^1$ and $R^5$; at least one of $R^1$ and $R^4$; and/or at least one of $R^3$ and $R^4$.

[Formula 1-6]

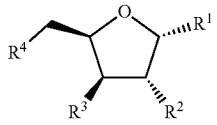

As an example of the present disclosure, in Formula 1-6, $R^1$ to $R^4$ may be each selected from a hydroxyl group (—OH) and

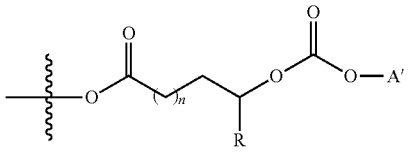

(n, R and A' are as defined in Formula 1.).

Preferably,

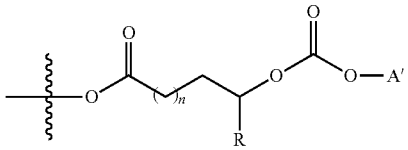

may correspond to at least one; at least two; at least three; or the whole of $R^1$ to $R^4$, more preferably at least one of $R^1$ and $R^4$; at least one of $R^2$ and $R^3$; and/or at least one of $R^1$ and $R^3$.

[Formula 1-7]

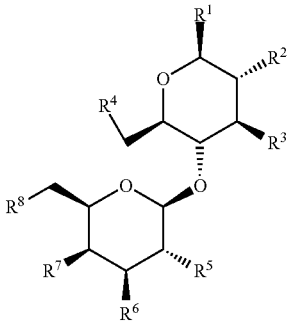

[Formula 1-8]

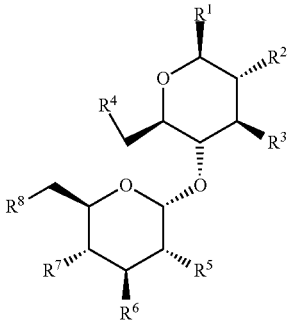

-continued

[Formula 1-9]

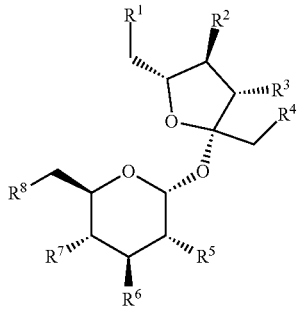

As an example of the present disclosure, in Formulas 1-7 to 1-9, $R^1$ to $R^8$ may be each selected from a hydroxyl group (—OH) and

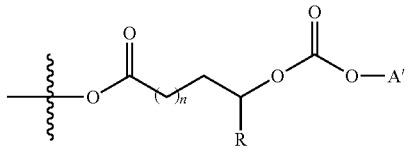

(n, R and A' are as defined in Formula 1.).

Preferably,

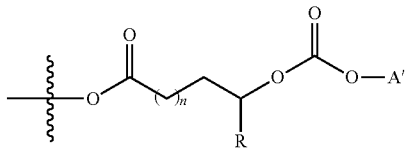

may correspond to at least one; at least two; at least three; at least four; or the whole of $R^1$ to $R^8$, more preferably at least one of $R^1$ to $R^3$; and/or at least one of $R^5$ and $R^8$, much more preferably at least one of $R^1$ and $R^2$; at least one of $R^1$ and $R^3$; at least one of $R^6$ and $R^8$; and/or at least one of $R^7$ and $R^5$.

According to an embodiment of the present disclosure, the flavoring agent may be selected from Formulas 1-1-a to 1-9-a below.

[Formula 1-1-a]

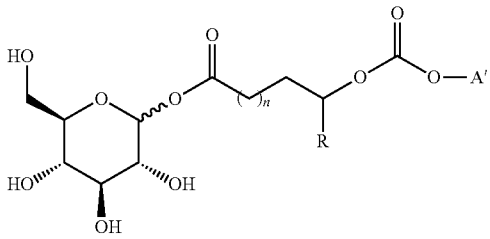

-continued

[Formula 1-2-a]

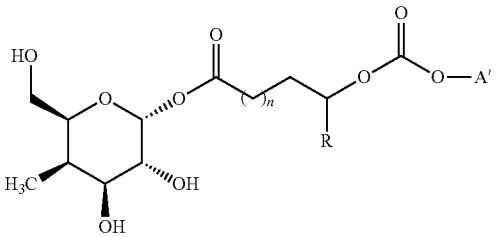

[Formula 1-3-a]

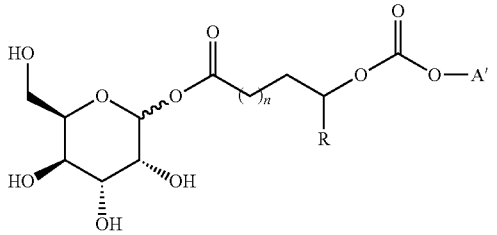

[Formula 1-4-a]

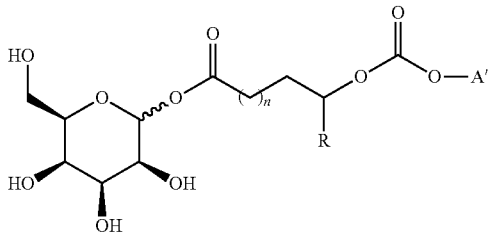

[Formula 1-5-a]

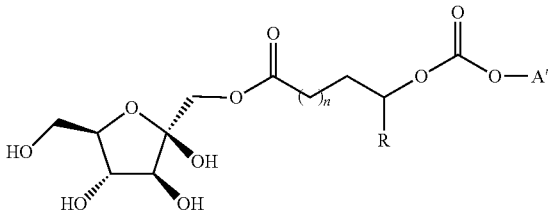

[Formula 1-6-a]

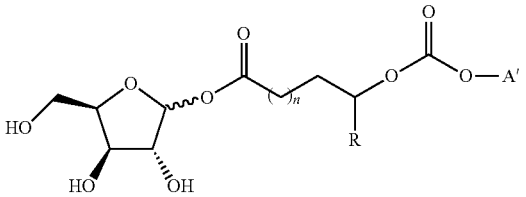

-continued

[Formula 1-7-a]

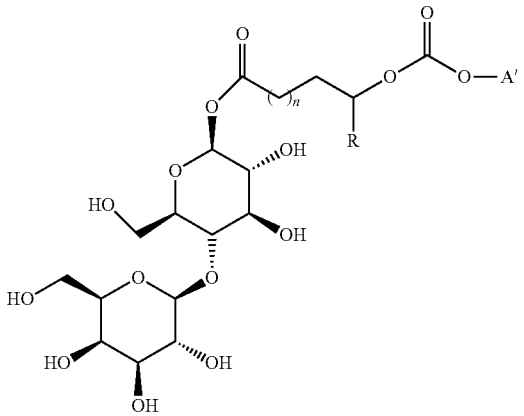

[Formula 1-8-a]

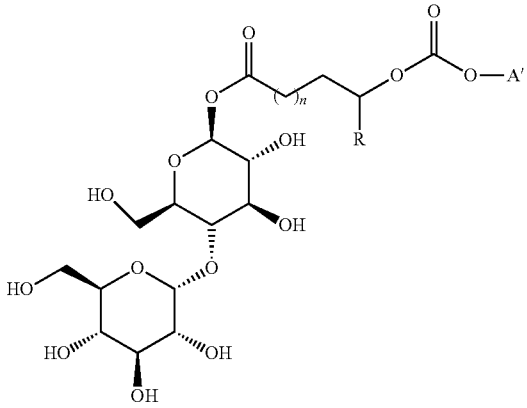

[Formula 1-9-a]

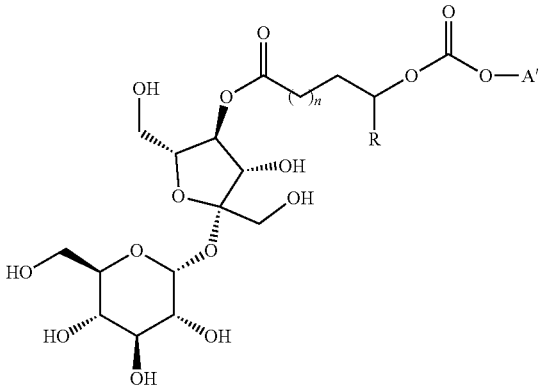

(In which, n, R, and A' are as those defined in Formula 1 above.)

According to an embodiment of the present disclosure, in Formula 1, n may be an integer of 1 or 2. R may be a straight-chain or branched-chain alkyl group having 1 to 30 carbon atoms; preferably a straight-chain or branched-chain alkyl group having 2 to 10 carbon atoms.

According to an embodiment of the present disclosure, the lactone compound may be gamma lactone of Formula 2 below or delta lactone of Formula 3 below.

[Formula 2]

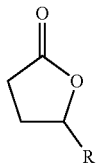

[Formula 3]

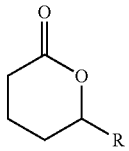

As an example of the present disclosure, in Formulas 1 and 2, R may be a straight-chain or branched-chain alkyl group having 1 to 30 carbon atoms, preferably a straight-chain or branched-chain alkyl group having 2 to 10 carbon atoms.

For example, the lactone compound may be selected from Formulas below.

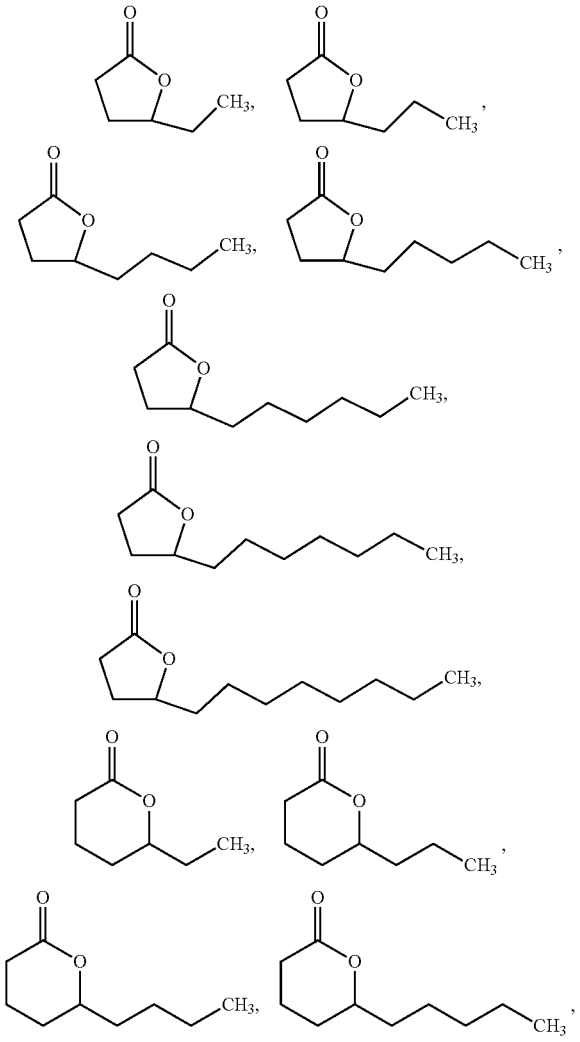

-continued

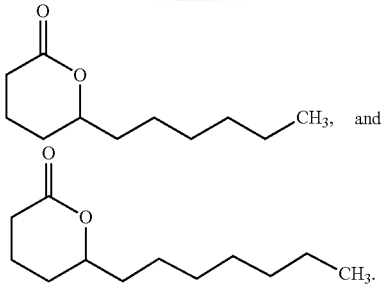

According to an embodiment of the present disclosure, the compound may be thermally decomposed at 70° C. or higher; 80° C. or higher; 90° C. or higher; or 100° C. or higher, preferably 120° C. or higher; 150° C. or higher; 200° C. or higher; or more preferably 200° C. to 300° C. In addition, the compound may be thermally decomposed in an environment containing oxygen and/or moisture.

According to an embodiment of the present disclosure, the smoking article may include at least one or more of the flavoring agent compounds represented by Formula 1 according to the present disclosure described above. When heating and/or burning the smoking article, flavor may be provided by pyrolysis of the flavoring agent. For example, when heating and/or burning the smoking article, flavors are developed in the mainstream smoke and/or sidestream smoke, which may provide an effect of improving the mainstream smoke and/or sidestream smoke. For example, FIG. 28 illustrates a migration process of flavoring components according to the present disclosure, and in FIG. 28, the flavoring agent compound may be applied to a heated and/or burnt portion and/or a proximal and/or heat-affected portion of the smoking article. When the flavoring agent compound is applied, an effect of improving sidestream smoke may be provided according to a migration process of the flavoring components to sidestream smoke/mainstream smoke.

Figure 28A:
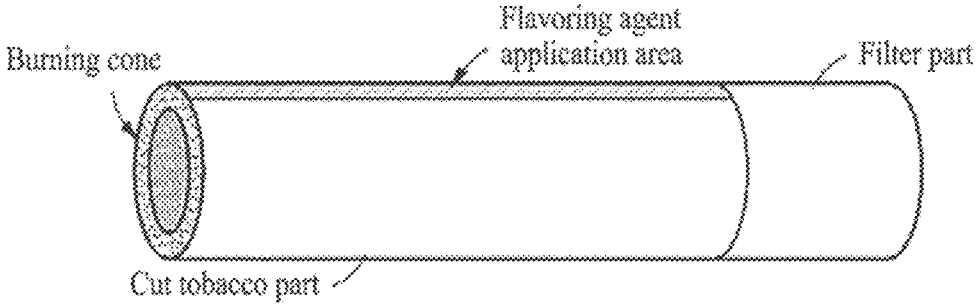
FIG. 28 illustratively illustrates a process of decomposition and migration of flavoring components upon burning and smoking of a smoking article, according to an embodiment of the present disclosure.
Figure 28B:
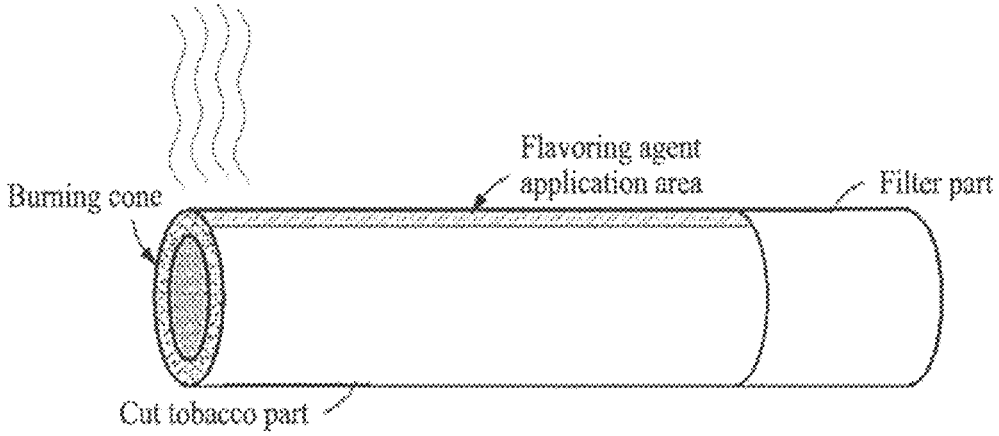
Figure 28C:
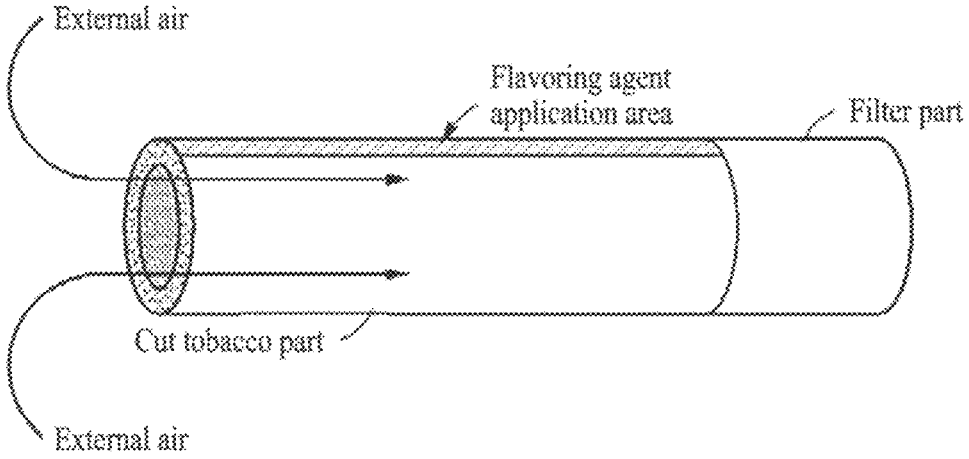

In FIGS. 28A and 28B, a burning cone is formed, and then sidestream smoke is produced during smouldering, and flavoring components loaded in the sidestream smoke are produced. This is because a sidestream smoke improving synthetic flavor coated on cigarette paper is thermally decomposed by the heat of the burning corn, so that flavoring components (e.g., gamma-undecalactone) are developed.

In FIG. 28B, some of the flavoring components thermally decomposed may be sucked into the mainstream smoke while external air is introduced during smoking.

According to an embodiment of the present disclosure, the compound represented by Formula 1 may be included in an amount of 0.0001 part by weight or more; 0.001 part by weight or more; 0.1 part by weight or more; 1 part by weight or more; 1 to 5 parts by weight; 1 to 10 parts by weight; or 1 to 20 parts by weight based on 100 parts by weight of the smoking medium in the smoking article. Accordingly, it is possible to provide effects of controlling and improving tobacco taste, atmosphere, and the like caused by sidestream smoke and/or mainstream smoke during smoking.

According to an embodiment of the present disclosure, the compound represented by Formula 1 may develop flavoring components, for example, lactone during smoking in an amount of 0.00001 part by weight or more; 0.0001 part by weight or more; 0.001 part by weight or more; 0.1 part by weight or more; 1 part by weight or more; 1 to 5 parts by weight; 1 to 10 parts by weight; or 1 to 20 parts by weight based on 100 parts by weight of the smoking medium in the smoking article. Accordingly, it is possible to provide effects of controlling and improving tobacco taste, atmosphere, and the like caused by sidestream smoke and/or mainstream smoke during smoking.

According to an embodiment of the present disclosure, the smoking article may include a slurry, paste, liquid, gel, powder, beads, sheet, film, fiber, or molded article containing the compound represented by Formula 1.

According to an embodiment of the present disclosure, the smoking article may be applied or prepared with the compound represented by Formula 1 or the composition containing the same. For example, the smoking article may correspond to components and/or parts of the smoking article. The smoking article may preferably be components and/or parts of a region to be heated in the smoking article. For example, the smoking article may be smoking media (e.g., liquids, gels, solids, slurries, pastes), paper tubes, tubes, filters (e.g., tube filters, fabric filters, woven fabric filters, paper filters, capsule filters), roll paper, cigarette paper, tip paper, wrappers, cartridges (e.g., heated cartridges), and the like, which include components known in the art of the present disclosure and are not specifically mentioned in the present disclosure, unless departing from the object of the present disclosure.

According to an embodiment of the present disclosure, the composition may include a flavoring agent (i.e., a flavoring agent compound represented by Formula 1 above) according to the present disclosure, and further include a carrier, an additive, or both depending on the use. The carriers and additives are acceptable carriers and additives for food or smoking articles, and may include, for example, solvents, binders, diluents, disintegrants, lubricants, flavoring agents, colorants, preservatives, antioxidants, emulsifiers, stabilizers, flavor enhancers, sweeteners, and the like, but are not limited thereto.

According to an embodiment of the present disclosure, the composition may further include a base matrix (or substrate) component depending on the use, and may be, for example, paper, pulp, wood, polymer resins (e.g., cellulose), fibers, vegetable oils, petroleum oils (e.g., paraffins), animal oils, waxes, fatty acids (e.g., animal fats, vegetable fats, saturated fatty acids, and unsaturated fatty acids (e.g., mono- or polyunsaturated fatty acids) having 1 to 50 carbon atoms), etc. Organic and/or inorganic or ceramic powders (e.g., chalk, perlite, vermiculite, diatomaceous earth, colloidal silica, magnesium oxide, magnesium sulfate, magnesium carbonate), wetting agents (e.g., glycerin or propylene glycol), acetate compounds, and the like may be further added in the base matrix component.

According to an embodiment of the present disclosure, the composition may further include a tobacco component depending on the use. The composition may develop flavors in the mainstream and/or sidestream smoke under smoking conditions when applied to the smoking article. The tobacco component may be a solid material based on tobacco raw materials such as tobacco sheet, cut tobaccos, and reconstituted tobacco, and may be selected from leaf tobacco, extruded tobacco, and bandcast tobacco. In addition, the composition may further include an aerosol generator that may be applied as a tobacco medium, and the aerosol generator may be sorbitol, glycerol, propylene glycol, triethylene glycol, lactic acid, diacetin, triacetin, triethylene glycol diacetate, triethyl citrate, ethyl myristate, isopropyl myristate, methyl stearate, dimethyl dodecane dioate, dimethyl tetradecanedioate, etc., but is not limited thereto.

According to an embodiment of the present disclosure, the flavoring agent may be included in an amount of 0.0001 wt % or more; 0.001 wt % or more; 0.01 wt % or more; 0.1 wt % to 80 wt %; 0.0001 wt % to 60 wt %; 0.001 wt % to 50 wt %; 0.1% to 30 wt %; 1 wt % to 20 wt %; 5 wt % to 20 wt %; or 5 wt % to 10 wt % of the composition. Within the range, it is possible to obtain a function of developing flavor of the flavoring agent according to pyrolysis, and to obtain an effect of improving tobacco taste when applied to the smoking article.

According to an embodiment of the present disclosure, the composition may be prepared in various phases, for example, solid (e.g., powder, crystal, flake, pulverized material), suspension, slurry, paste, gel, liquid, emulsion, or aerosol. For example, the composition may be molded, mixed into a desired product, or applied by a method known in the art such as printing, dipping, spraying, and/or coating, etc., which is not specifically mentioned in the present disclosure.

According to an embodiment of the present disclosure, the "smoking article" may mean any product capable of smoking or any product capable of providing a smoking experience regardless of whether it is based on tobacco, tobacco derivatives, expanded tobacco, reconstituted tobacco, or tobacco substitutes. For example, the smoking article may refer to a smokable article capable of generating aerosol, such as a cigarette, a cigar, a small cigarillo, or an electronic cigarette. The smoking article may include an aerosol generating material or an aerosol forming substrate. In addition, the smoking article may include solid materials based on tobacco raw materials, such as tobacco sheet, cut tobaccos, reconstituted tobacco, and the like. The smoking material may include a volatile compound.

According to an embodiment of the present disclosure, the smoking article may be a cigarette type tobacco, a liquid type tobacco, or a hybrid type tobacco, and may be a burned cigarette or heated tobacco. Alternatively, the smoking article may be an electronic cigarette (e.g., an electronically heated cigarette).

According to an embodiment of the present disclosure, the smoking article may include at least one of a sheet, a film, and a filter printed or coated with the compound represented by the Formula 1 on the entire surface or topically on at least a portion of at least one side. In addition, the compound represented by Formula 1 may be printed or coated on one surface or both surfaces thereof.

According to an embodiment of the present disclosure, the compound represented by Formula 1 is printed in a pattern according to an axial direction, a transverse direction, or both of the smoking article, and the pattern may be printed on the entire surface of at least one side or topically on at least a portion of the smoking article. For example, the smoking article includes a single or a plurality of pattern areas along an axial direction, a transverse direction, or both of the rod of the smoking article, which can control the tobacco taste, atmosphere, etc. of sidestream smoke and/or mainstream smoke during smoking. For example, the patterns may be arranged in the form of at least one of a straight line, a dotted line, a lattice, a polygon, a dot, a circle, and an ellipse. For example, the pattern may have a size of 0.01 mm or more; 0.1 mm or more; 1 mm to 10 mm; or 1 mm to 5 mm. The size may mean a thickness, a length, a diameter, etc., and may mean a pitch, an interval, etc. in a dot pattern. For example, the pitch may be 0.01 mm to 1 mm.

According to an embodiment of the present disclosure, the smoking article may include a smoking medium part and a filter part. The smoking medium part may include cigarette paper, a smoking medium, or both containing the compound represented by Formula 1.

According to an embodiment of the present disclosure, the flavoring agent is applied to the cigarette paper of a cigarette to provide the effect of improving the acrid smell of sidestream smoke by developing flavoring components (e.g., lactones and/or fragrance components) by heat during tobacco heating and/or burning, particularly smouldering.

According to an embodiment of the present disclosure, when applied to a medium of a heated tobacco stick, the flavoring agent may impart a lasting taste of the flavoring components. That is, in the heated tobacco, the flavoring components contained in the medium are exhausted in the initial puffing by static heating, but the flavoring agent is developed only when decomposed by heat, and thus even if the puffing is lasted, the flavoring component is generated even in the last puff, so that the tobacco taste may be maintained constant.

According to an embodiment of the present disclosure, the flavoring agent may be mixed with a substrate or base by itself or be applied by mixing, printing, dipping (or impregnating), coating, and/or spraying the substrate or base using the composition including the flavoring agent in the manufacture of the smoking article.

According to an embodiment of the present disclosure, the compound represented by Formula 1 may be applied to cigarette paper or added to a smoking medium (e.g., a tobacco medium).

As an example of the present disclosure, the method of adding the compound represented by Formula 1 to the smoking medium (e.g., tobacco medium) may be performed by dissolving and diluting the compound represented by Formula 1 in a solvent, and adding the compound to a tobacco medium (e.g., tobacco cut tobaccos) by spraying as a method of adding other flavoring agents in the tobacco manufacturing process. In addition, the compound represented by Formula 1 may be dissolved in water in the manufacturing process of a tobacco sheet and added in various methods during manufacture of the tobacco sheet.

As an example of the present disclosure, the method of applying the compound to cigarette paper may be applied in various ways, such as applying the entire portion of the cigarette rod part or locally applying at least a portion thereof. The compound may be applied to cigarette paper of tobacco or added to the manufacturing process of cigarette paper (paper) when manufacturing the cigarette paper.

For example, the cigarette paper includes a pattern area of the compound represented by Formula 1 locally distributed based on the front surface or the transverse and/or axial direction of the rod of the smoking article, and may control the tobacco taste and atmosphere included in sidestream smoke depending on the position of the pattern area.

For example, in the cigarette paper, the pattern area may be constituted in a single or in plural, and may consist of various parts in the cigarette rod, and may be distributed in the vicinity of the distal end (e.g., the end of the cigarette or the lighterning start portion), in the vicinity of the filter portion, in the middle portion, and the like from the cigarette rod. For example, the pattern area may be formed in a pattern in the form of a line (or transverse direction), a strip (or axial direction), or both in the cigarette rod.

For example, the pattern area in the cigarette paper may be distributed in an area of 5%, 10%, 20%; 30%; 50%, 70%; 90%; and 95% of the length (or rod, i.e., from the distal end) of the cigarette paper.

As an example of the present disclosure, in the method applied to the cigarette paper, the method for manufacturing the cigarette paper is, for example, paper manufacturing process, of raw material peeling→mill skin removal→cleaning→soaking→cooking→washing and cleaning→bleaching→beating→blending→stirring→paperdrafting→pressing→drying→completion, and the compound represented by Formula 1 may be added during soaking or paperdrafting.

As an example of the present disclosure, the compound represented by Formula 1 is mixed or dissolved in a solvent, and the solvent may include an organic solvent and/or water capable of dispersing and/or dissolving the compound, and has solubility to be easily applied when making paper, such as a drafting paper process using water or alcohol.

For example, when producing cigarette tobacco at a cigarette manufacturing plant (at high speed), the compound may be added to the cigarette rod portion as if ink is stamped.

For example, the compound may be added locally to the cigarette rod portion in a spray method in the manufacture of cigarette tobacco.

For example, the compound may be applied in an amount of 0.0001 parts by weight or more; 1 part by weight or more; 5 parts by weight or more; or 1 to 20 parts by weight with respect to 100 parts by weight of the smoking medium (or cut tobacco part).

According to an embodiment of the present disclosure, the smoking medium, for example, a flavoring agent and a tobacco raw material (e.g., medium raw material, tobacco leaves) may be included or additives may be further included. In another example, the flavoring agent is added as a flavoring agent when manufacturing components and/or parts of the smoking article, and may be mixed with a base material, a solvent, a flavoring substance, a smoking medium substance, and the like, which are applicable to the smoking article. Alternatively, the smoking medium may be liquid, gel, or solid.

Hereinafter, the present disclosure will be described in more detail with reference to examples and comparative examples. However, the following examples are just illustrative of the present disclosure, and the contents of the present disclosure are not limited to the following examples.

Example 1

[Reaction Formula 1]

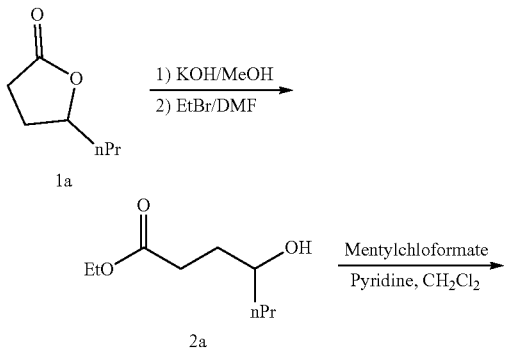

-continued

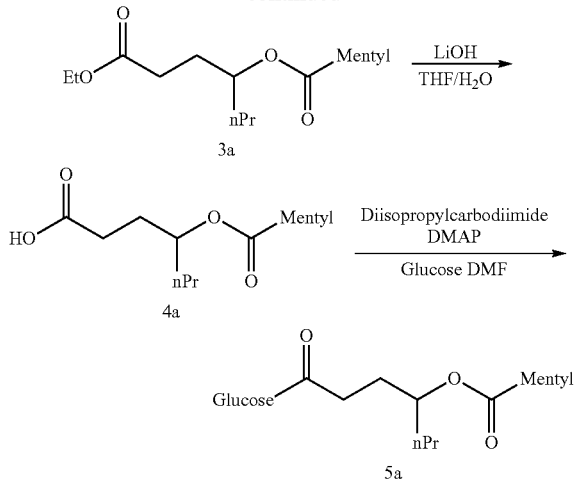

(1-1) Synthesis of ethyl 4-hydroxyheptanoate (2*a*)

20 g (0.15 mol) of γ-heptalactone was dissolved in 100 mL of methanol, slowly added with 11.17 g (0.16 mol, 1.05 eq.) of KOH while stirring, and reacted at room temperature for 12 hours. The reaction solution was concentrated under reduced pressure, added with 80 mL of DMF, added with 17 g (0.15 mol, 1 eq.) of bromoethane while stirring, and then reacted for 12 hours. The reaction solution was added with 100 mL of water, extracted with ethyl acetate, and washed with water and salt water. The organic layer was dried with $MgSO_4$ and then concentrated under reduced pressure to obtain 18.1 g (66.7%, 2 steps) of a target product 2*a*.

$^1$H NMR ($CDCl_3$, 400.13 MHz); δ 8.01 (s, 1H, —OH), 4.12 (oxy)h, 2H, J=8 Hz, COO—$CH_2$—), 3.63 (m, 1H, CH—O), 2.42 (m, 2H, CO—$CH_2$), 1.81 ~0.92 (m, 12H, alkyl)

(1-2) Synthesis of ethyl 4-(mentylcarbonyloxy)heptanoate (3*a*)

18 g (0.1 mol) of ethyl 4-hydroxyheptanoate (2*a*) was dissolved in 120 mL of THE, added with 16 g (0.2 mol, 2 eq.) of pyridine, cooled with ice water, and slowly dropped with 23 g (0.1 mol, 1 eq.) of mentyl chloroformate in a 20 mL of THE solution while stirring. After 1 hour, the reaction solution was heated to room temperature and reacted overnight, and then added with water and extracted with ethyl acetate. The organic layer was washed with dilute hydrochloric acid, a saturated sodium bicarbonate solution and salt water, and then dried with $MgSO_4$ and concentrated under reduced pressure to obtain 30 g (yield 81%) of a target object 3*a* as a yellow liquid.

$^1$H NMR ($CDCl_3$, 400.13 MHz); δ 4.74 (7tet, 1H, J=4 Hz, —COOCH—), 4.51 (td, 1H, J=9, 4 Hz, COO—CH—), 4.12 (q, 2H, J=8 Hz, COO—$CH_2$—), 2.36 (m, 2H, CO—$CH_2$—), 1.93 ~0.79 (m, 30H, alkyl)

(1-3) Synthesis of 4-(mentylcarbonyloxy)heptanoic acid (4*a*)

25 g (68.5 mmol) of ethyl 4-(mentylcarbonyloxy)heptanoate (3a) was dissolved in 100 mL of THF and 30 mL of distilled water, and added with 4.2 g (102.4 mmol, 1.5 eoxy)h.) of lithium hydroxide monohydrate and reacted at room temperature for 12 hours. The reaction solution was added with 50 mL of distilled water and extracted with ether. The water layer was adjusted to pH 3 by adding thick hydrochloric acid and then extracted with ethyl acetate. The organic layer was washed with salt water, dried with $MgSO_4$, and concentrated under reduced pressure to obtain 21.8 g (yield: 81%) of a target product 4*a* as a yellow liquid.

$^1$H NMR ($CDCl_3$, 400.13 MHz); δ 4.76 (m, 1H, —COOCH—), 4.52 (td, 1H, J=9, 4 Hz, COO—CH—), 4.11 (oxy)h, 2H, J=8 Hz, COO—$CH_2$—), 2.42 (m, 2H, CO—$CH_2$—), 1.99 ~0.82 (m, 27H, alkyl)

(1-4) Synthesis of Glucosyl-(4-mentylcarbonyloxy)heptanoate (5*a*)

3 g (9.1 mmol) of 4-(methylcarbonyloxy)heptanoic acid (4a) was dissolved in 20 mL of DMF, and added with 3.7 g (20.5 mmol, 2.2 eq.) of glucose. While stirring at room temperature, 1.7 g (13.4 mmol, 1.5 eq.) of diisopropylcarbodiimide and 0.05 g (cat.) of DMAP were sequentially added thereto, and then reacted at room temperature for 12 hours. The reactant was added with distilled water and extracted with ethyl acetate. The organic layer was washed with dilute hydrochloric acid, saturated sodium bicarbonate solution and salt water, dried with $MgSO_4$, and concentrated under reduced pressure. The mixture was subjected to silica gel column chromatography using a mixed solvent (6:1) of methylene chloride and methanol to obtain 0.6 g (yield: 13%) of a target product 5*a*.

$^1$H NMR ($CDCl_3$, 400.13 MHz); δ 5.30 ~3.54 (m, 13H, glucose, —COOCH, —COOCH), 2.45 (m, 2H, CO—$CH_2$—), 2.03 ~0.78 (m, 27H, alkyl)

2. Synthesis of Glucosyl-(4-mentylcarbonyloxy)nonanoate (5*b*)

[Reaction Formula 2]

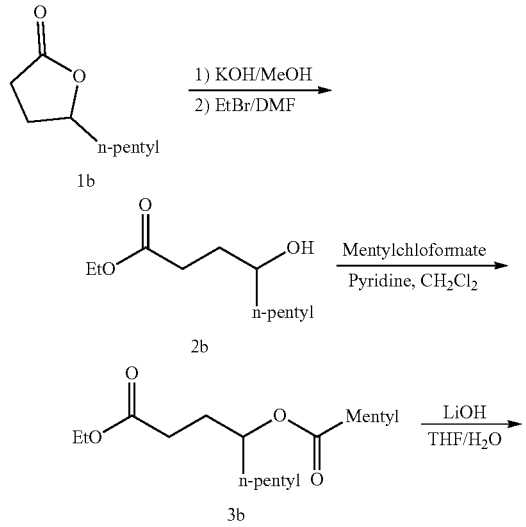

-continued

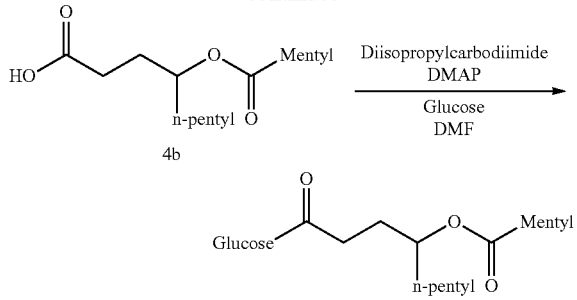

(2-1) Synthesis of ethyl 4-hydroxynonanoate (2*b*)

20 g (0.13 mol) of γ-nonalactone was dissolved in 100 mL of methanol, slowly added with 9.18 g (0.14 mol, 1.05 eq.) of KOH while stirring, and reacted at room temperature for 12 hours. The reaction solution was concentrated under reduced pressure, added with 80 mL of DMF, added with 14 g (0.13 mol, 1 eq) of bromoethane while stirring, and then reacted for 12 hours. The reaction solution was added with 100 mL of water, extracted with ethyl acetate, and washed with water and salt water. The organic layer was dried with $MgSO_4$ and then concentrated under reduced pressure to obtain 24 g (93%, 2 steps) of a target product 2*b*.

(2-2) Synthesis of ethyl 4-(mentylcarbonyloxy)nonanoate (3*b*)

24 g (0.12 mol) of ethyl 4-hydroxynonanoate 2 was dissolved in 120 mL of THF, added with 18 g (0.42 mol, 2 eq.) of pyridine, cooled with ice water, and slowly dropped with 26 g (0.12 mol, 1 eq.) of mentyl chloroformate in a 30 mL of THE solution while stirring. After 1 hour, the reaction solution was heated to room temperature and reacted overnight, and then added with water and extracted with ethyl acetate. The organic layer was washed with dilute hydrochloric acid, a saturated sodium bicarbonate solution and salt water, and then dried with $MgSO_4$ and concentrated under reduced pressure to obtain 34 g (yield 74.5%) of a target object 3 as a yellow liquid.

$^1$H NMR ($CDCl_3$, 400.13 MHz); δ 4.74 (7tet, 1H, J=4 Hz, —COOCH—), 4.51 (td, 1H, J=9, 4 Hz, COO—CH—), 4.12 (oxy)h, 2H, J=8 Hz, COO—$CH_2$—), 2.36 (m, 2H, CO—$CH_2$—), 1.93 ~0.79 (m, 23H, alkyl)

(2-3) Synthesis of 4-(mentylcarbonyloxy)nonanoic acid (4*b*)

11.5 g (29.9 mmol) of ethyl 4-(mentylcarbonyloxy) nonanoate was dissolved in 50 mL of THF and 20 mL of distilled water, and added with 2 g (48.7 mmol, 1.6 eq.) of lithium hydroxide monohydrate and reacted at room temperature for 12 hours. The reaction solution was added with 50 mL of distilled water and extracted with ether. The water layer was adjusted to pH 3 by adding thick hydrochloric acid and then extracted with ethyl acetate. The organic layer was washed with salt water, dried with $MgSO_4$, and concentrated under reduced pressure to obtain 8.6 g (yield: 80%) of a target product 4*b* as a yellow liquid.

$^1$H NMR ($CDCl_3$, 400.13 MHz); δ 4.75 (m, 1H, —COOCH—), 4.49 (m, 1H, COO—CH—), 2.04 (m, 2H, CO—$CH_2$—), 1.93 ~0.79 (m, 31H, alkyl)

(2-4) Synthesis of Glucosyl-(4-mentylcarbonyloxy)nonanoate (5*b*)

6.6 g (24.1 mmol) of 4-(mentylcarbonyloxy)nonanoic acid 4*b* was dissolved in 30 mL of DMF, and added with 13 g (72.1 mmol, 3 eq.) of glucose. While stirring at room temperature, 3.4 g (26.9 mmol, 1.2 eq.) of diisopropylcarbodiimide and 0.05 g (cat.) of DMAP were sequentially added thereto, and then reacted at room temperature for 12 hours. The reactant was added with distilled water and extracted with ethyl acetate. The organic layer was washed with dilute hydrochloric acid, saturated sodium bicarbonate solution and salt water, dried with $MgSO_4$, and concentrated under reduced pressure. The mixture was subjected to silica gel column chromatography using a mixed solvent (8:1) of methylene chloride and methanol to obtain 2 g (yield 16%) of a target product 5*b*.

$^1$H NMR ($CDCl_3$, 400.13 MHz); δ 5.57 ~3.35 (m, 13H, glucose, —COOCH, —COOCH), 2.43 (m, 2H, CO—$CH_2$—), 2.03 ~0.78 (m, 31H, alkyl)

3. Synthesis of Glucosyl-(5-mentylcarbonyloxy) decanoate (6*c*)

[Reaction Formula 3]

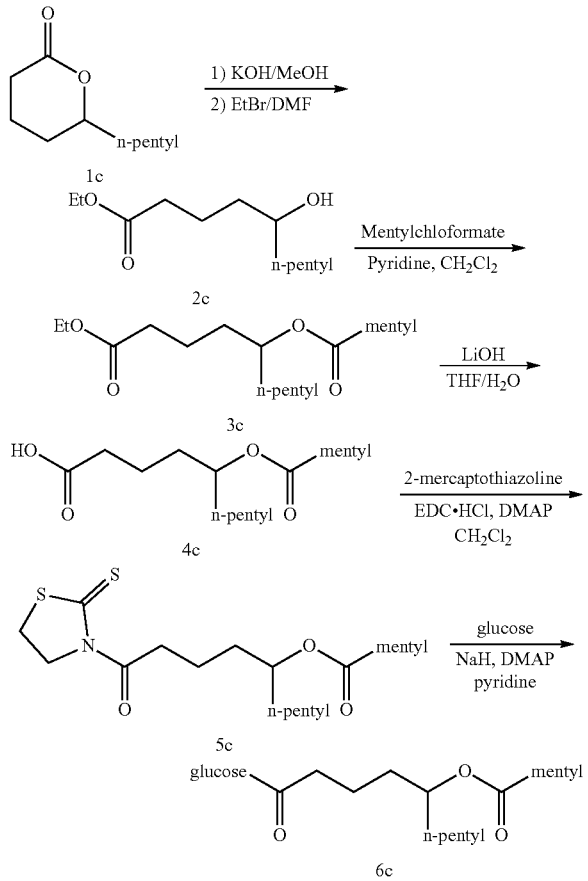

(3-1) Synthesis of ethyl 5-hydroxydecanoate (2*c*)

10 g (858.7 mmol) of δ decalactone was dissolved in 50 mL of methanol, slowly added with 4.2 g (64.7 mmol, 1.05 eq.) of KOH while stirring, and reacted at room temperature for 12 hours. The reaction solution was concentrated under reduced pressure, added with 40 mL of DMF, added with 6.4 g (58.7 mmol, 1 eq.) of bromoethane while stirring, and then reacted for 12 hours.

The reaction solution was added with 100 ml of water, extracted with ethyl acetate, and washed with water and salt water. The organic layer was dried with $MgSO_4$ and then concentrated under reduced pressure to obtain 7.6 g (60%, 2 steps) of a target product 2*c*.

(3-2) Synthesis of ethyl 5-(mentylcarbonyloxy) decanoate (3*c*) 7.5 g (34.6 mmol) of ethyl 4-hydroxynonanoate 3*c* was dissolved in 50 mL of THF, added with 5.3 g (69.2 mmol, 2 eq.) of pyridine, cooled with ice water, and slowly dropped with 8.3 g (37.9 mmol, 1.1 eq.) of mentyl chloroformate in a 20 mL of THF solution while stirring. After 1 hour, the reaction solution was heated to room temperature and reacted overnight, and then added with water and extracted with ethyl acetate. The organic layer was washed with dilute hydrochloric acid, a saturated sodium bicarbonate solution and salt water, dried with $MgSO_4$, and concentrated under reduced pressure. The mixture was subjected to silica gel column chromatography using a mixed solvent (7:1) of n-hexane and ethyl acetate to obtain 4.5 g (yield 32.6%) of a target product 3*c*.

$^1$H NMR ($CDCl_3$, 400.13 MHz); δ 4.72 (m, 1H, —COOCH—), 4.52 (m, 1H, COO—CH—), 4.12 (oxy)h, 2H, J=8 Hz, COO—$CH_2$—), 2.31 (t, 2H, J=8 Hz, CO—$CH_2$—), 2.08 ~0.86 (m, 27H, alkyl), 0.79 (d, 6H, J=8 Hz, —$CH_3$)

(3-3) Synthesis of 5-(mentylcarbonyloxy) decanoic acid (4*c*)

2.7 g (6.8 mmol) of ethyl 4-(mentylcarbonyloxy)nonanoate (3) was dissolved in 20 mL of THF and 10 mL of distilled water, and added with 0.42 g (10.2 mmol, 1.5 eq.) of lithium hydroxide monohydrate and reacted at room temperature for 12 hours. The reaction solution was added with 10 mL of distilled water and extracted with ether. The water layer was adjusted to pH 3 by adding thick hydrochloric acid and then extracted with ethyl acetate. The organic layer was washed with salt water, dried with $MgSO_4$, and concentrated under reduced pressure to obtain 2.1 g (yield: 78%) of a target product 4*b* as a yellow liquid.

$^1$H NMR ($CDCl_3$, 400.13 MHz); δ 4.72 (m, 1H, —COOCH—), 4.51 (td, 1H, J=8, 4 Hz, COO—CH—), 4.11 (oxy)h, 2H, J=8 Hz, COO—$CH_2$—), 2.38 (m, 2H, CO—$CH_2$—), 2.06 ~0.78 (m, 33H, alkyl)

(3-4) Synthesis of 5-isopropyl-2-methylcyclohexyl (1-oxo-1-(2-thioxothiazolidin-3-yl) decan-5-yl) carbonate (5*c*)

1.9 g (5.1 mmol) of 5-(mentylcarbonyloxy) decanoic acid (4*c*) was dissolved in 20 mL of dried dichloromethane, added with 0.73 g (6.1 mmol, 1.2 eq.) of 2-mercaptothiazoline, cooled with ice water, and slowly added with 1.2 g (6.1 mmol, 1.2 eoxy)h.) of EDC.HCl and 50 mg of DMAP while stirring and reacted. After 1 hour, the reaction solution was heated to room temperature and reacted overnight, and then added with water and extracted with dichloromethane. The organic layer was washed with dilute hydrochloric acid, a saturated sodium bicarbonate solution and salt water, respectively, dried with $MgSO_4$, and concentrated under reduced pressure. The mixture was subjected to silica gel column chromatography using a mixed solvent (3:1) of n-hexane and ethyl acetate to obtain 2.1 g (yield 87.5%) of a target product 5*c*.

$^1$H NMR ($CDCl_3$, 400.13 MHz); δ 4.71 (m, 1H, —COOCH—), 4.57 (t, 2H, J=8 Hz, N—$CH_2$), 4.51 (m, 1H, COO—CH—), 4.11 (oxy)h, 2H, J=8 Hz, COO—$CH_2$—), 3.28 (t, 2H, J=8 Hz, S—$CH_2$), 3.21 (m, 2H, CO—$CH_2$—), 2.04 ~0.79 (m, 33H, alkyl)

(3-5) Synthesis of Glucosyl-(5-mentylcarbonyloxy) decanoate (6*c*)

2.2 g (4.7 mmol) of 5-isopropyl-2-methylcyclohexyl (1-oxo-1-(2-thioxothiazolidin-3-yl) decan-5-yl) carbonate (5*c*) was dissolved in 20 mL of pyridine and added with 2.5 g (14.1 mmol, 3 eq.) of glucose. While stirring at room temperature, 93 mg (2.4 mmol, 0.5 eq.) of sodium hydride (60%) and 0.03 g (cat.) of DMAP were sequentially added thereto, and then reacted at room temperature for 12 hours. The reactant was added with 0.5 mL of acetic acid, added with saturated salt water, and then extracted with ethyl acetate. The organic layer was dried with $MgSO_4$ and concentrated under reduced pressure. The mixture was subjected to silica gel column chromatography using a mixed solvent (8:1) of methylene chloride and methanol to obtain 0.55 g (yield 22%) of a target product 6*c*.

$^1$H NMR ($CDCl_3$, 400.13 MHz); δ 5.57 ~3.15 (m, 13H, glucose, —COOCH, —COOCH), 2.36 (m, 2H, CO—$CH_2$—), 2.05 ~0.80 (m, 33H, alkyl)

4. Synthesis of Glucosyl-(4-mentylcarbonyloxy)undecanoate (6*d*)

[Reaction Formula 4]

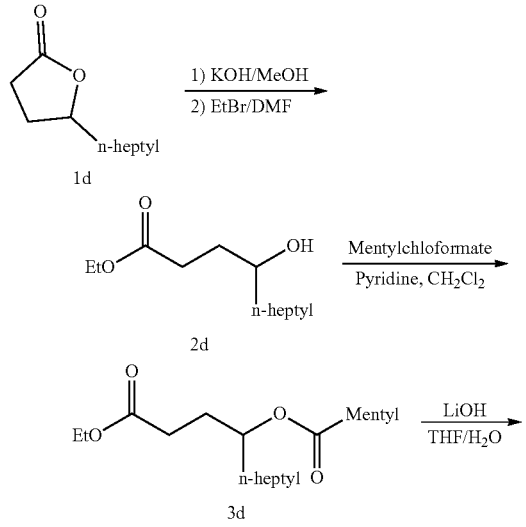

-continued

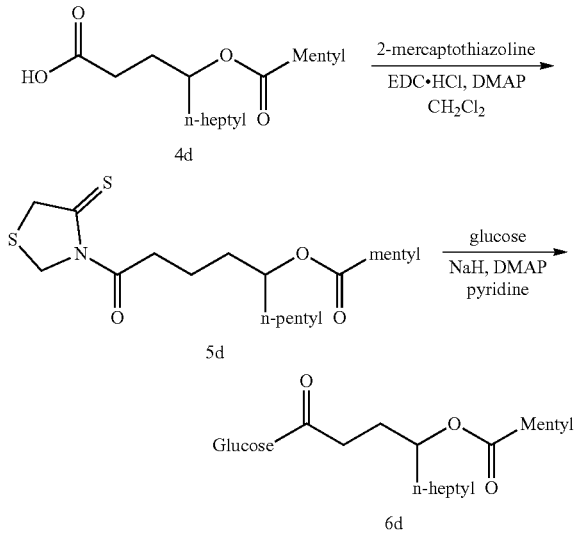

(4-1) Synthesis of ethyl 4-hydroxyundecanoate (2*d*)

10 g (54.2 mmol) of γ-undecalactone was dissolved in 50 mL of methanol, slowly added with 3.9 g (56.9 mmol, 1.05 eq.) of KOH while stirring, and reacted at room temperature for 12 hours. The reaction solution was concentrated under reduced pressure, added with 50 mL of DMF, added with 5.9 g (54.2 mmol, 1 eq.) of bromoethane while stirring, and then reacted for 12 hours.

The reaction solution was added with 80 mL of water, extracted with ethyl acetate, and washed with water and salt water. The organic layer was dried with $MgSO_4$ and then concentrated under reduced pressure to obtain 10.7 g (85.6%, 2 steps) of a target product 2*d*.

$^1$H NMR ($CDCl_3$, 400.13 MHz); δ 4.12 (oxy)h, 2H, J=8 Hz, COO—$CH_2$—), 3.59 (m, 1H, CH—O), 2.43 (m, 2H, CO—$CH_2$), 1.81 ~0.92 (m, 20H, alkyl)

(4-2) Synthesis of ethyl 4-(mentylcarbonyloxy)undecanoate (3*d*)

11 g (47.7 mmol) of ethyl 4-hydroxyundecanoate (2*d*) was dissolved in 60 mL of THF, added with 6.8 g (95.5 mmol, 2 eq.) of pyridine, cooled with ice water, and slowly dropped with 10.5 g (47.7 mmol, 1 eq.) of mentyl chloroformate in a 20 mL of THF solution while stirring. After 1 hour, the reaction solution was heated to room temperature and reacted overnight, and then added with water and extracted with ethyl acetate. The organic layer was washed with dilute hydrochloric acid, a saturated sodium bicarbonate solution, and salt water, respectively, and then dried with $MgSO_4$ and concentrated under reduced pressure to obtain 8.3 g (yield 42.1%) of a target object 3*d* as a yellow liquid.

$^1$H NMR ($CDCl_3$, 400.13 MHz); δ 4.74 (7tet, 1H, J-4 Hz, —COOCH—), 4.51 (td, 1H, J=9, 4 Hz, COO—CH—), 4.12 (oxy)h, 2H, J=8 Hz, COO—$CH_2$—), 2.36 (m, 2H, CO—$CH_2$—), 1.93 ~0.79 (m, 23H, alkyl)

(4-3) Synthesis of 4-(mentylcarbonyloxy)undecanoic acid (4*d*)

8.3 g (19.4 mmol) of ethyl 4-(mentylcarbonyloxy)undecanoate (3*d*) was dissolved in 30 mL of THF and 20 mL of distilled water, and added with 1.2 g (29.1 mmol, 1.5 eq.) of lithium hydroxide monohydrate and reacted at room temperature for 12 hours. The reaction solution was added with 20 mL of distilled water and extracted with ether. The water layer was adjusted to pH 3 by adding thick hydrochloric acid and then extracted with ethyl acetate. The organic layer was washed with salt water, dried with $MgSO_4$ and concentrated under reduced pressure. The mixture was subjected to silica gel column chromatography using a mixed solvent (8:1) of n-hexane and ethyl acetate to obtain 6.8 g (yield 91.8%) of a target product 4*d*.

$^1$H NMR ($CDCl_3$, 400.13 MHz); δ 4.75 (m, 1H, —COOCH—), 4.51 (m, 1H, COO—CH—), 2.43 (m, 2H, CO—$CH_2$—), 2.17 ~0.78 (m, 35H, alkyl)

(4-4) Synthesis of 5-isopropyl-2-methylcyclohexyl (1-oxo-1-(2-thioxothiazolidin-3-yl) dodecan-5-yl) carbonate (5*d*)

9.1 g (23.6 mmol) of 5-(mentylcarbonyloxy)undecanoic acid (4*d*) was dissolved in 20 mL of dried dichloromethane, added with 3 g (24.8 mmol, 1.05 eq.) of 2-mercaptothiazoline, cooled with ice water, and slowly added with 5 g (25.9 mmol, 1.1 eq.) of EDC.HCl and 20 mg of DMAP, respectively, while stirring and reacted. After 1 hour, the reaction solution was heated to room temperature and reacted overnight, and then added with water and extracted with dichloromethane. The organic layer was washed with dilute hydrochloric acid, a saturated sodium bicarbonate solution, and salt water, respectively, and then dried with $MgSO_4$ and concentrated under reduced pressure to obtain 10.9 g (yield 92%) of a target object 5*d*.

$^1$H NMR ($CDCl_3$, 400.13 MHz); δ 4.71 (m, 1H, —COOCH—), 4.57 (t, 2H, J=8 Hz, N—$CH_2$), 4.51 (m, 1H, COO—CH—), 4.11 (oxy)h, 2H, J=8 Hz, COO—$CH_2$—), 3.28 (t, 2H, J=8 Hz, S—$CH_2$), 3.21 (m, 2H, CO—$CH_2$—), 2.04 ~0.79 (m, 33H, alkyl)

(4-5) Synthesis of Glucosyl-(4-mentylcarbonyloxy)undecanoate (6*d*)

4.9 g (12.7 mmol) of 4-(mentylcarbonyloxy)undecanoic acid was dissolved in 30 mL of dichloromethane, added with 3 g (25.2 mmol, 2 eoxy)h) of thionyl chloride, and then refluxed for 2 hours. 6.9 g (3 eoxy)h) of glucose and 4.9 g (5 eq) of pyridine were added to a DMF solvent in another flask, and the reaction solution was slowly added dropwise while stirring at room temperature, and then reacted for 12 hours. The reaction solution was added with water and extracted with dichloromethane. The organic layer was washed with dilute hydrochloric acid, a saturated sodium bicarbonate solution, and salt water, respectively, dried with $MgSO_4$, concentrated under reduced pressure, and subjected to silica gel column chromatography (MC/MeOH, 10:1) to obtain 2.6 g of a target product 6*d* (37.7% yield).

$^1$H NMR ($CDCl_3$, 400.13 MHz); δ 5.23 ~3.35 (m, 13H, glucose, —COOCH, —COOCH), 2.43 (m, 2H, CO—$CH_2$—), 2.03 ~0.78 (m, 35H, alkyl)

5. Synthesis of Glucosyl-(4-benzyloxycarbonyloxy)undecanoate (5*e*)

[Reaction Formula 5]

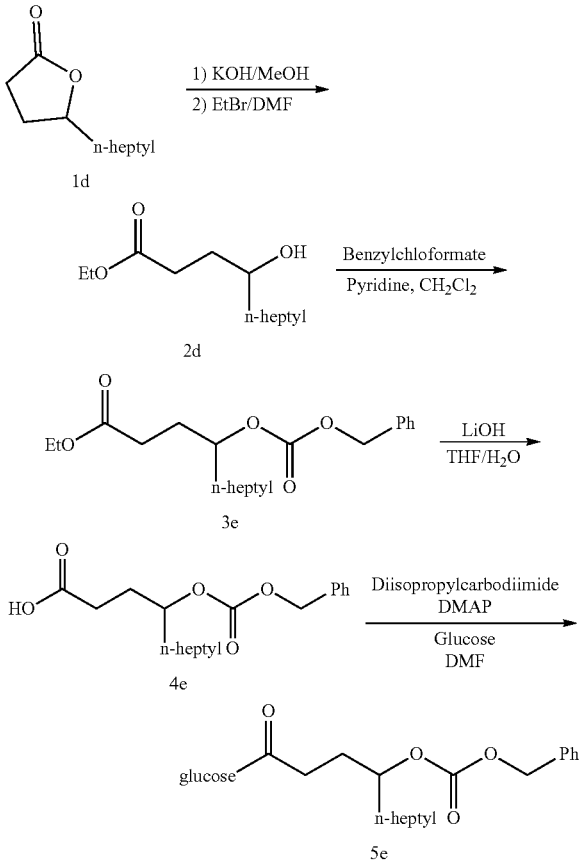

(5-1) Synthesis of ethyl 4-hydroxyundecanoate (2*d*)

10 g (54.2 mmol) of γ-undecalactone was dissolved in 50 mL of methanol, slowly added with 3.9 g (56.9 mmol, 1.05 eq.) of KOH while stirring, and reacted at room temperature for 12 hours. The reaction solution was concentrated under reduced pressure, added with 50 mL of DMF, added with 5.9 g (54.2 mmol, 1 eq.) of bromoethane while stirring, and then reacted for 12 hours.

The reaction solution was added with 80 mL of water, extracted with ethyl acetate, and washed with water and salt water. The organic layer was dried with $MgSO_4$ and then concentrated under reduced pressure to obtain 10.7 g (85.6%, 2 steps) of a target product 2*d*.

$^1$H NMR ($CDCl_3$, 400.13 MHz); δ 4.12 (oxy)h, 2H, J=8 Hz, COO—$CH_2$—), 3.59 (m, 1H, CH—O), 2.43 (m, 2H, CO—$CH_2$), 1.81 ~0.92 (m, 20H, alkyl)

(5-2) Synthesis of ethyl 4-(benzyloxycarbonyloxy)undecanoate (3*e*)

8.3 g (36 mmol) of ethyl 4-hydroxyundecanoate (2*d*) was dissolved in 50 mL of THF, added with 5.5 g (72.3 mmol, 2 eq.) of pyridine, cooled with ice water, and slowly dropped with 6.1 g (35.3 mmol, 1 eq.) of benzylchloroformate in a 20 mL THF solution while stirring. After 1 hour, the reaction solution was heated to room temperature and reacted overnight, and then added with water and extracted with ethyl acetate. The organic layer was washed with dilute hydrochloric acid, a saturated sodium bicarbonate solution, and salt water, respectively, and then dried with $MgSO_4$ and concentrated under reduced pressure to obtain 9.9 g (yield 75.6%) of a target object 3*e* as a yellow liquid.

Figure 24:
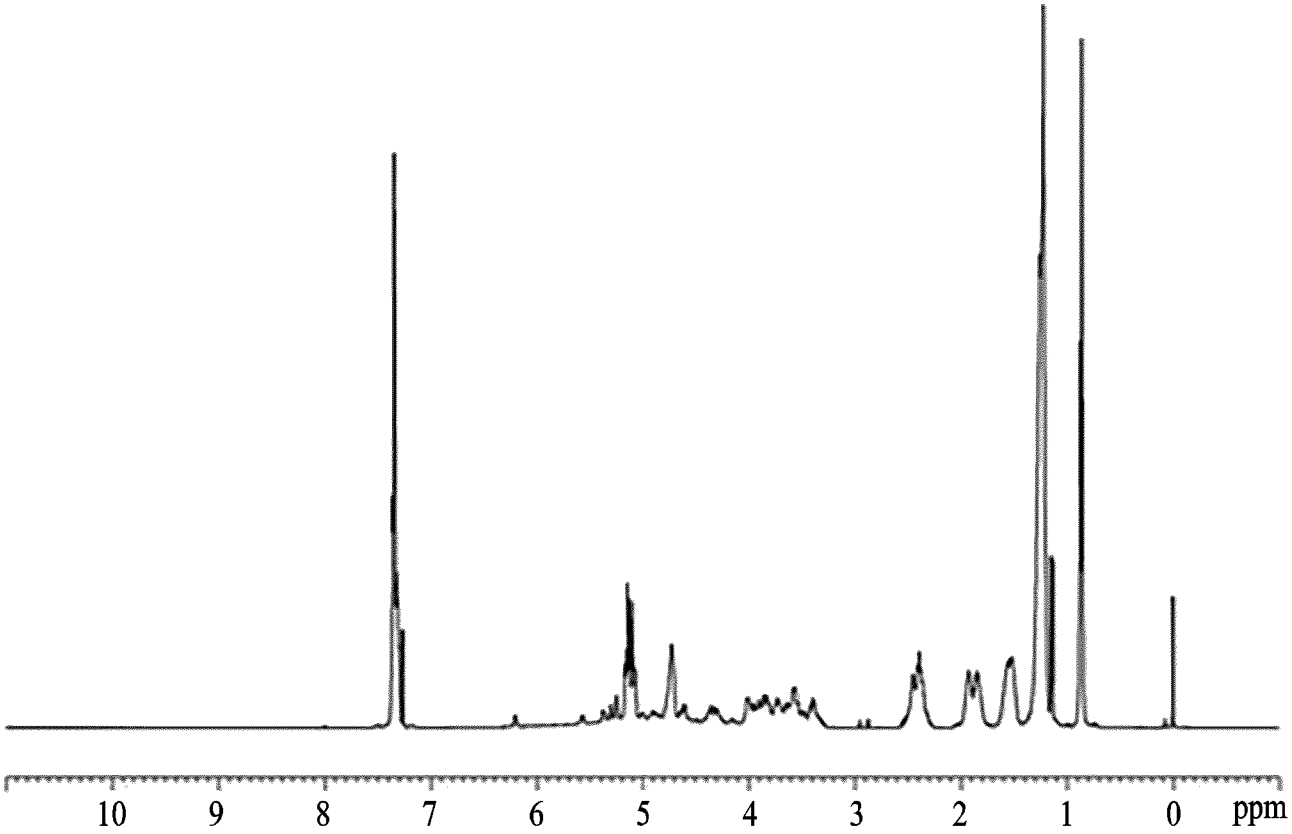
FIG. 24 illustrates results of NMR analysis of glucosyl-(4-benzyloxycarbonyloxy)nonanoate (5*e*) prepared in examples, according to an embodiment of the present disclosure.

$^1$H NMR ($CDCl_3$, 400.13 MHz); δ 7.37 ~7.34 (m, 5H, ph), 5.14 (m, 2H, O—$CH_2$-Ph), 4.12 (brs, 1H, O—CH—), 2.42 (m, 2H, CO—$CH_2$—), 1.90 ~0.79 (m, 21H, alkyl) (FIG. 24)

(5-3) Synthesis of 4-(benzyloxycarbonyloxy)undecanoic acid (4*e*)

10 g (27.5 mmol) of ethyl 4-(benzyloxycarbonyloxy) undecanoate (3*e*) was dissolved in 30 mL of THF and 20 mL of distilled water, and added with 1.7 g (41.4 mmol, 1.5 eq.) of lithium hydroxide monohydrate and reacted at room temperature for 12 hours.

The reaction solution was added with 20 mL of distilled water and extracted with ether. The water layer was adjusted to pH 3 by adding thick hydrochloric acid and then extracted with ethyl acetate. The organic layer was washed with salt water, dried with $MgSO_4$, and concentrated under reduced pressure to obtain 8.2 g (yield: 89%) of a target product 4*e*.

$^1$H NMR ($CDCl_3$, 400.13 MHz); δ 7.37 ~7.35 (m, 5H, ph), 5.14 (m, 2H, O—$CH_2$-Ph), 4.48 (m, 1H, O—CH—), 2.47 (m, 2H, CO—$CH_2$—), 1.90 ~0.79 (m, 21H, alkyl)

(5-4) Synthesis of Glucosyl-(4-benzyloxycarbonyloxy)nonanoate (5*e*)

8 g (23.8 mmol) of 4-(benzyloxycarbonyloxy)undecanoic acid (4*e*) was dissolved in 30 mL of DMF, and added with 13 g (72.1 mmol, 3 eq.) of glucose. While stirring at room temperature, 3.4 g (26.9 mmol, 1.1 eq.) of diisopropylcarbodiimide and 0.05 g (cat.) of DMAP were sequentially added thereto, and then reacted at room temperature for 12 hours. The reactant was added with distilled water and extracted with ethyl acetate. The organic layer was washed with dilute hydrochloric acid, a saturated sodium bicarbonate solution, and salt water, respectively, dried with $MgSO_4$, and concentrated under reduced pressure. The mixture was subjected to silica gel column chromatography using a mixed solvent (8:1) of methylene chloride and methanol to obtain 0.3 g (yield 2.5%) of a target product 5*e*.

$^1$H NMR ($CDCl_3$, 400.13 MHz); δ 7.37 ~7.34 (m, 5H, ph), 5.30 ~3.37 (m, 13H, glucose, —COOCH, —COOCH), 2.39 (m, 2H, CO—$CH_2$—), 1.92 ~0.84 (m, 17H, alkyl)

Experimental Example

A pyrolysis test was performed to confirm the pyrolytic behavior of the 6*d* compound (2C) when exposed to heat, which was observed by a commonly known pyrolysis-gas chromatography/mass spectrometry [Py-GC/MS]. A pyrolyzer performed the [Double-Shot Pyrolyzer 2020iDs (Frontier Lab, Japan) in a system connected to the GC/MS (Agilent 6890 GC, USA/Aginelt 7890 MSD, USA) equipment. 2C was diluted in an ethyl alcohol solution at a concentration of 2.5%, and then 10 μl was loaded into a pyrolyzer sample cup and pyrolyzed. The pyrolysis temperature was specified as a temperature of the furnace of a double-shot pyrolyzer to control a temperature experienced by the sample, but a first pyrolysis temperature allowed a target compound (2*c*) in the sample cup to undergo pyrolysis by exposing a sample cup in which the sample was placed to the furnace at 80° C. for 30 seconds. Components generated by heat or volatilized by heat were immediately injected into an injector of GC/MS and separated. During GC/MS analysis after pyrolysis, the sample cup was removed from the furnace so as not to be affected by the pyrolysis temperature, and after the GC/MS analysis by the first pyrolysis was completed, the first used sample cup was subjected to pyrolysis again without injecting a new compound, and at this time, the pyrolysis temperature was 90° C. higher by 10° C. and the pyrolysis was performed for 30 seconds. Also, after the pyrolysis was completed, the sample cup was removed from the furnace so as not to be affected by the pyrolysis temperature. In this way, the pyrolysis test was performed while the temperature rose from 80° C., 90° C., and 100° C. to final 320° C. at the time of pyrolysis after loading the first sample into the sample cup. As a result, the pyrolytic characteristics of the compounds experienced while the pyrolysis temperature increased were separately observed for each temperature range. The results were illustrated in FIGS. 25 to 27.

[Pyrolysis Mechanism]

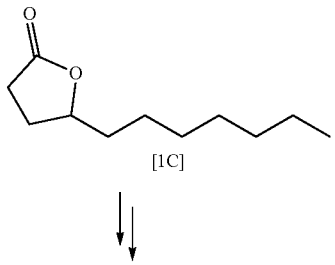

-continued

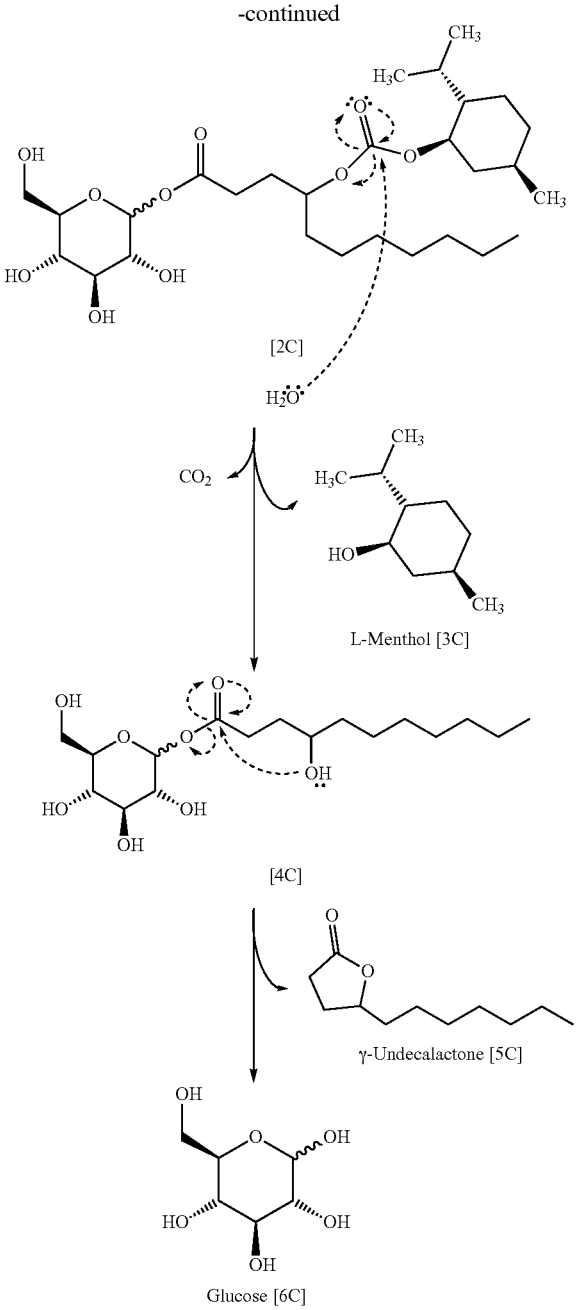

Figure 25:
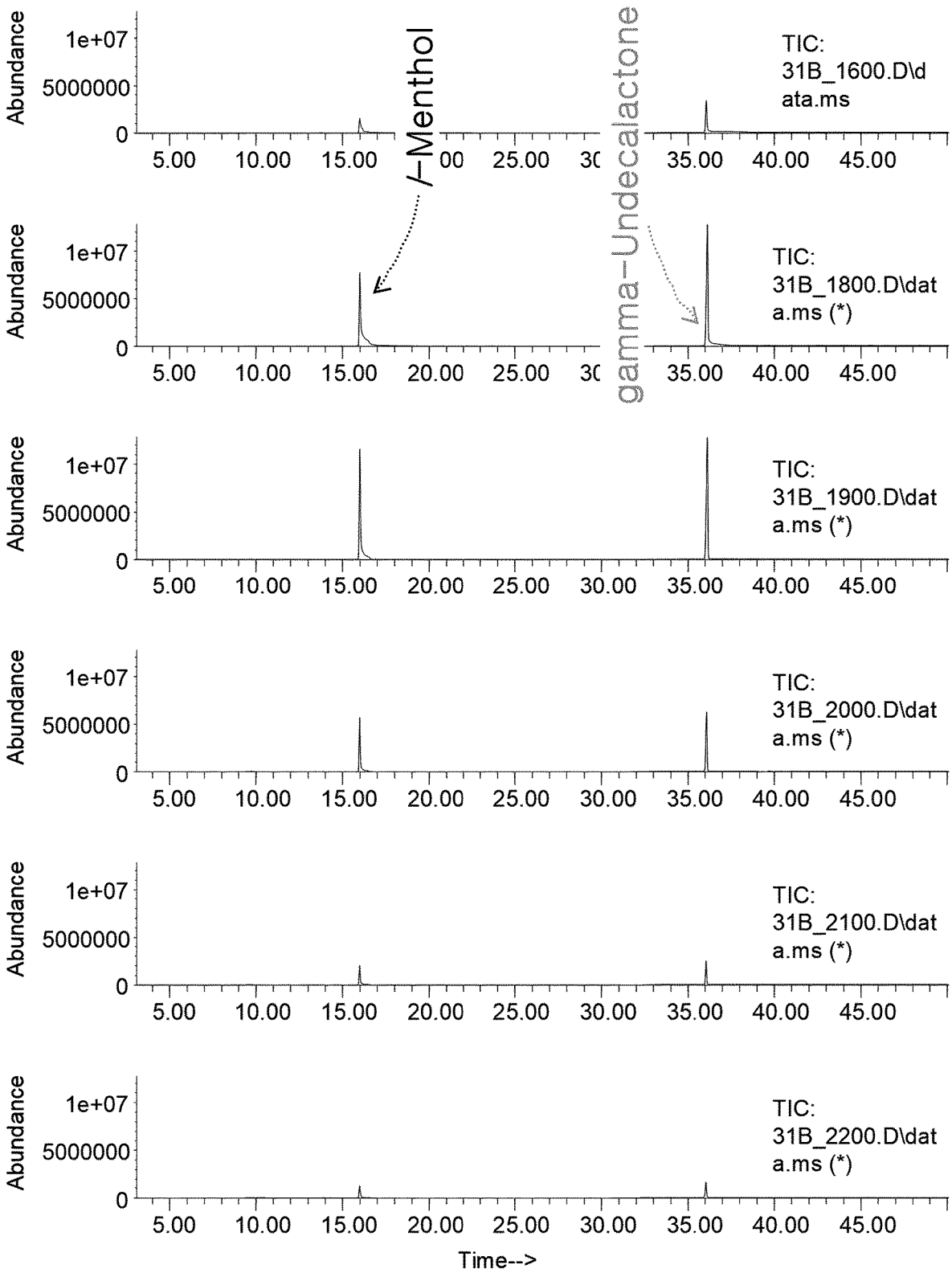
FIG. 25 illustrates thermal analysis results of the compounds prepared in an examples, according to an embodiment of the present disclosure.
Figure 26:
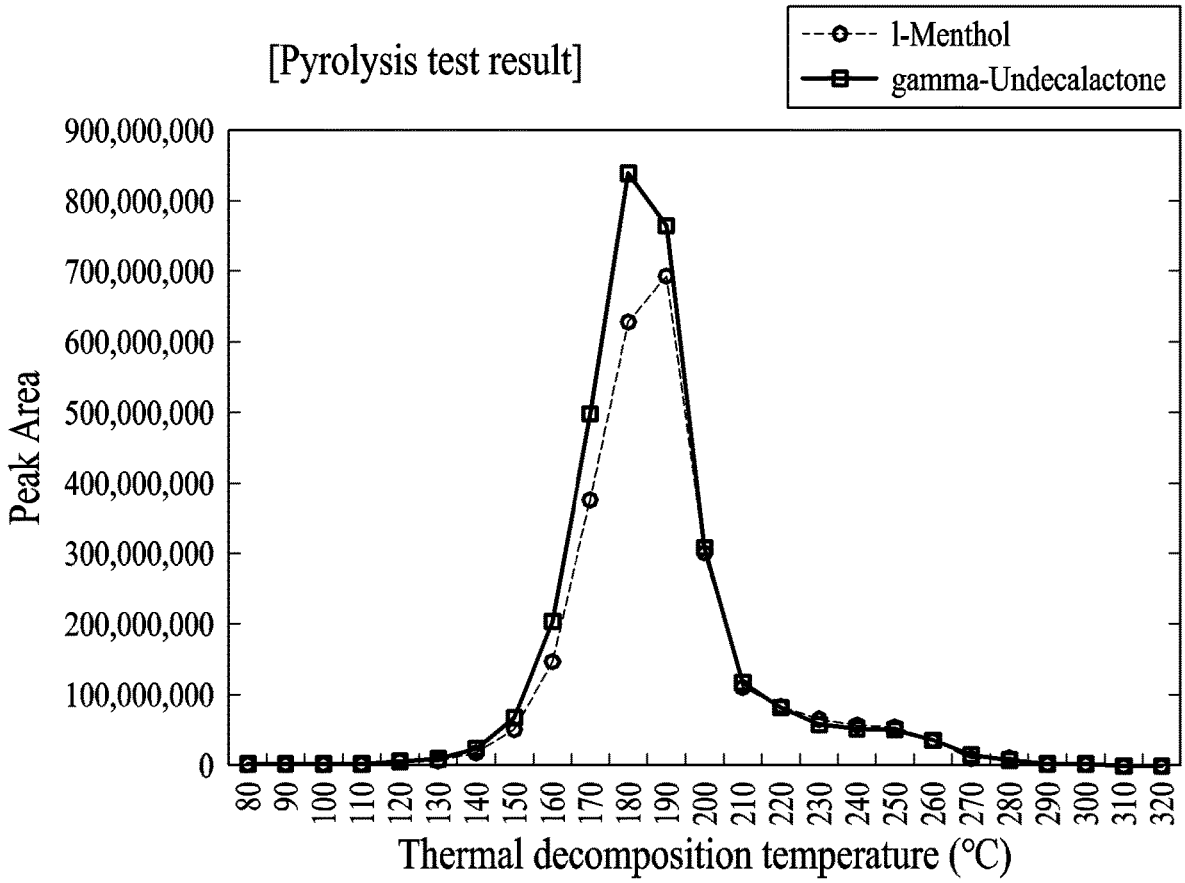
FIG. 26 illustrates a distribution of components according to a pyrolysis temperature of the compounds prepared in an examples, according to an embodiment of the present disclosure.
Figure 27:
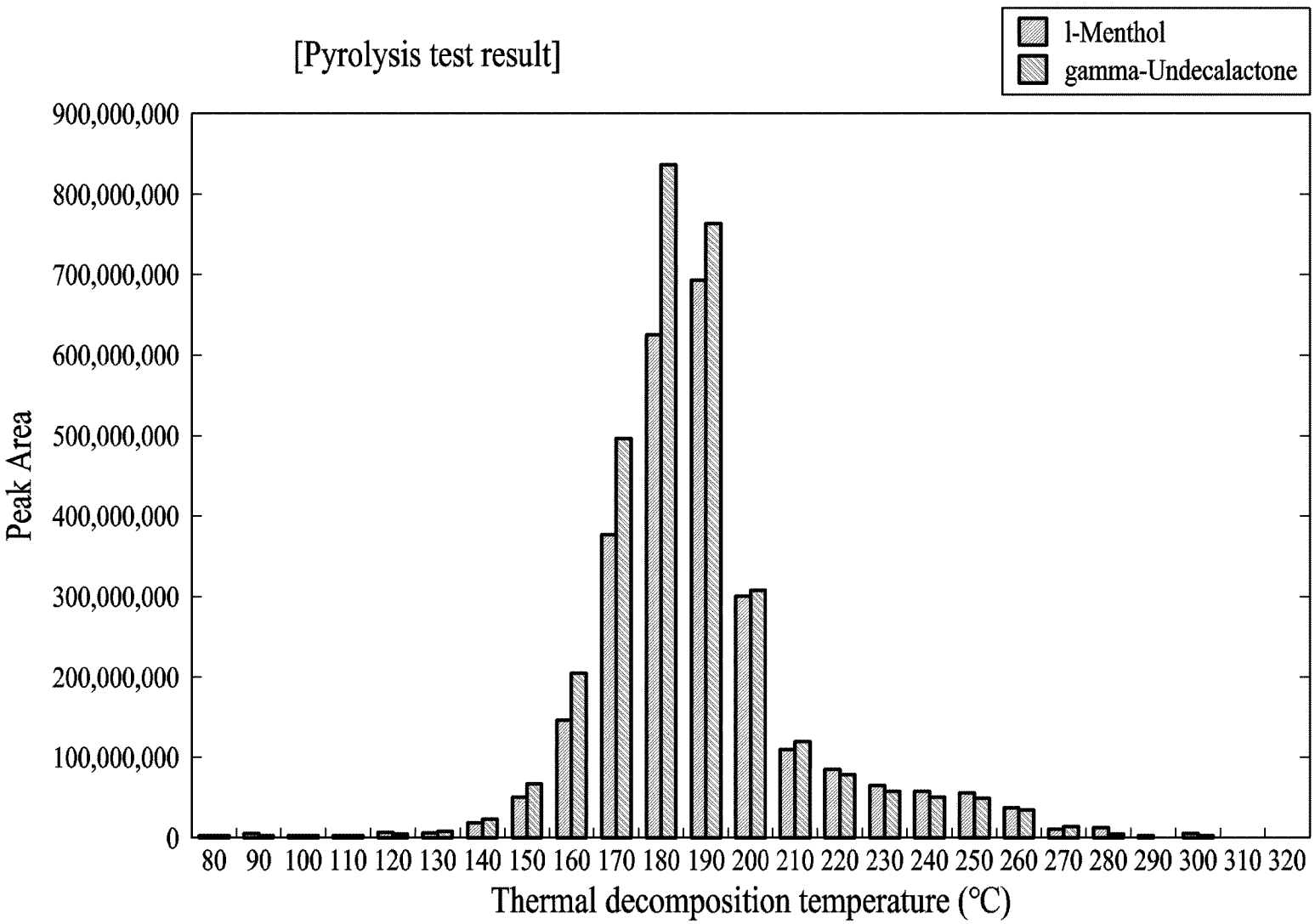
FIG. 27 illustrates a distribution of components according to a pyrolysis temperature of the compounds prepared in an examples, according to an embodiment of the present disclosure.

In FIGS. 25 to 27, it can be confirmed that menthol and gamma-undecanolactone are decomposed at 120° C. as a result of the pyrolysis test of the 2C compound.

That is, in the pyrolysis mechanism, lactone [1C, gamma-undecalactone] was ring-opened, and a hydroxyl group was linked with L-menthol by a carbonate linkage, and then linked with sugar (glucose) by ester to prepare the [2C] compound. After the [2C] compound was applied to a product matrix, while L-menthol ([3C]) and $CO_2$ were generated by heat, a [4C] compound with exposed hydroxyl groups was generated. The [4C] compound was also ring-closed (intramolecular esterification) by heat to generate gamma-undecalactone [5C]. In the [2C] state, the hydroxyl group was protected with a methyl carbonate group, so that ring-closing (intramolecular esterification) may be prevented from occurring at room temperature. In addition, as a result of the pyrolysis test, it was confirmed that menthol was pyrolyzed and a lactone ring was generated at the same time.

Since compounds developing the pyrolytic flavor components of the present disclosure are as follows and the temperature range in which lactone is produced by a pyrolytic behavior is known, when applied to heated tobacco, the heating temperature is appropriately adjusted to control the degree and rate at which menthol and lactone were released from the compound 2C added to the medium and control uniform taste and aroma to be released even if the puffing is lasted under an optimal temperature condition.

Example 2

The target product (synthesized glucosyl-(4-mentylcarbonyloxy)heptanoate, 5b, 0.01 to 5 wt %) of a preparation example, a base substrate (pulp, 95 to 99 wt %), and other additives (residue) were mixed to be prepared into a sheet (about 2 mm thick) using a roll-to-roll, and dried at room temperature. The sheet was smelled at room temperature, but there was no smell of the flavoring compound used in the synthesis of the target product. Next, it was confirmed that the sheet was applied as cigarette paper to produce a conventional cigarette, and the cigarette was smoked, and flavors (e.g., lactone flavor and menthol flavor used in synthesizing the target substance) were developed during smoking.

Example 3

The target product (synthesized glucosyl-(5-mentylcarbonyloxy) decanoate, 6c, 0.003 to 0.02 wt %) of a preparation example, tobacco powder (90 to 99 wt %, average particle size of 0.03 mm to about 0.12 mm), and other additives (residue) were mixed, and then a tobacco composition was prepared in a conventional manner. After applying the tobacco composition to the smoking medium and wrapping the smoking medium on cigarette paper, a filter and cigarette paper were formed to prepare a conventional cigarette. It was confirmed that the cigarette was smoked, and flavors were developed during smoking in mainstream smoke and sidestream smoke.

Example 4

Figure 29A:
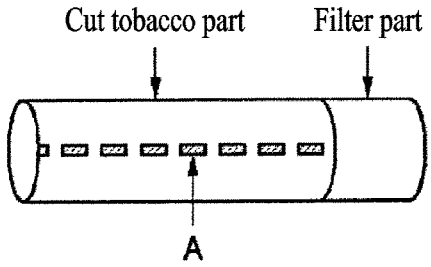
FIG. 29A illustrates an application site of a flavoring agent in a cigarette rod of Example 4, according to an embodiment of the present disclosure.
Figure 29A:
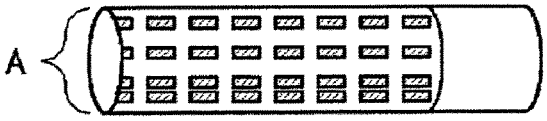
Figure 29A:
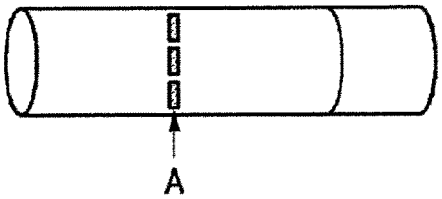
Figure 29A:
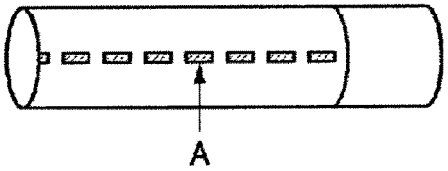
Figure 29A:
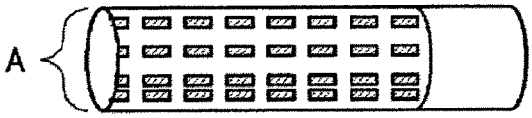
Figure 29A:
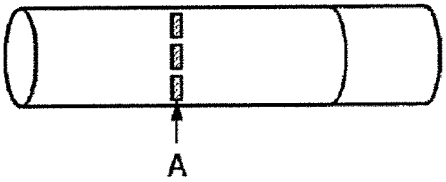
Figure 29B:
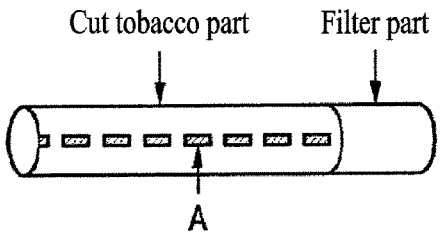
FIG. 29B illustrates an application site of a flavoring agent in a cigarette rod of Example 4, according to an embodiment of the present disclosure.
Figure 29B:
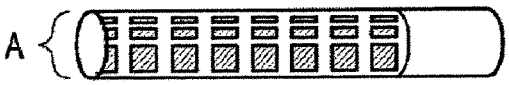
Figure 29B:
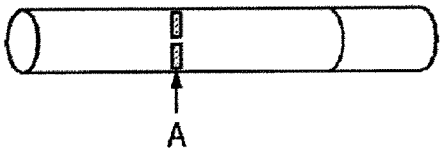
Figure 29B:
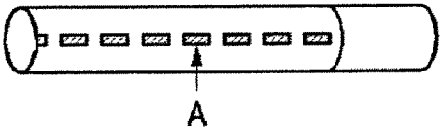
Figure 29B:
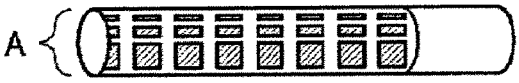
Figure 29B:
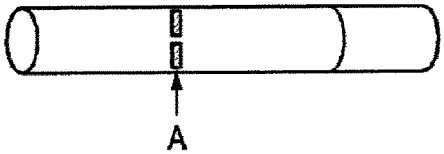

An ink composition was prepared by mixing the target product (synthesized glucosyl-(4-mentylcarbonyloxy)heptanoate, 5a) of a preparation example and solvents (water and ethanol). In the ink composition, a single or a plurality of dotted lines having a thickness (line thickness) of about 0.1 mm to 1 mm were printed on one surface of cigarette paper of the cut tobacco part by a stamp method. In each sample, the amount of application of the synthetic flavoring was target product g/cut tobacco 100 kg. As shown in FIGS. 29A and 29B, different effects can be given depending on the application site when applied on the cigarette paper, and the ink composition was applied to various parts according to the cigarette rod.

Example 5

In the same manner as in Example 4, the ink composition (applied with the *6d* compound) was applied to various parts of the cigarette paper to evaluate effects of cigarette product application parts of a sidestream smoke-improved synthetic flavoring (flavoring agent).

Figure 30:
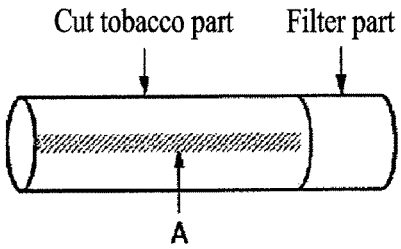
FIG. 30 illustrates an application site of a flavoring agent in a cigarette product of Example 5, according to an embodiment of the present disclosure.
Figure 30:
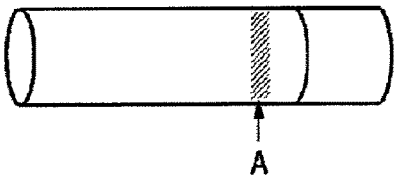

In FIG. 30, Sample 5-1 was γ-undecalactone 2.56 g which was developed when pyrolyzed/cut tobacco 100 kg, and may be evaluated as follows.

Appearance: There was no difference from a control (no smell).

Mainstream smoke: The lactone smell was not greatly expressed, but a weakly felt level, and had no significant difference in terms of users, but gave a soft feel.

Sidestream smoke: The acridness of sidestream smoke of a control cigarette was slightly reduced, but had no significant difference, but gave a weak feeling in terms of users.

Sample 5-2 was γ-undecalactone 12.51 g which was developed when pyrolyzed/cut tobacco 100 kg, and may be evaluated as follows.

Appearance: There was no difference from a control (no smell).

Mainstream smoke: The lactone flavor rose subtly during smoking, and the lactone flavor became stronger as getting closer to the application part (strip shape). When burning the application part, the flavor development increased, and the feeling of disgust and greasiness was reduced.

Sidestream smoke: There was a lot of flavor development in the application site, and there was an excessive flavor feeling, but it was not negative. It was necessary to change the position of the application part to give the feeling of change more quickly by moving the position of the application part from the end to the middle portion. The flavor of sidestream smoke was expressed positively, and gave a feeling that there was some effect of reducing hand odor.

Example 6

In the same manner as in Example 4, the ink composition (applied with the *6d* compound) was applied to various parts of the cigarette paper to evaluate effects of cigarette product application parts of the sidestream smoke-improved synthetic flavoring. The cigarette product application parts of the sidestream smoke-improved synthetic flavoring were as shown in FIG. 31.

According to the present disclosure, it is possible to provide an effect of improving the acrid smell of sidestream smoke by applying the novel compound developing the flavoring components during pyrolysis to cigarette paper of a traditional cigarette to develop the flavoring components (e.g., lactones or menthol) by heat during tobacco burning, particularly smouldering. In addition, it is possible to improve flavor retention by applying the novel compound to a medium, for example, tobacco cut tobacco of a traditional cigarette.

In addition, it is possible to impart the taste persistence of the flavoring components by applying the novel compound to a medium of a heated cigarette stick (NGP). That is, in the heated cigarette, the flavoring components contained in the medium are exhausted from initial puffing by static heating, but synthetic compounds that develop the flavoring components upon pyrolysis are developed only when decomposed by heat. Accordingly, even if the puffing is lasted, the flavoring components are generated even in the last puffing, so that the tobacco taste may be maintained constantly.

As described above, although the embodiments have been described by the restricted embodiments and the drawings, various modifications and variations can be made from the above description by those skilled in the art. For example, even if the described techniques are performed in a different order from the described method, and/or components described above are coupled or combined in a different form from the described method, or replaced or substituted by other components or equivalents, an appropriate result can be achieved. Therefore, other implementations, other embodiments, and equivalents to the appended claims fall within the scope of the claims to be described below.

The invention claimed is:

1. A smoking article comprising a flavoring agent that is a compound represented by Formula 1 below:

[Formula 1]

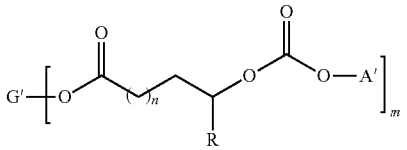

(in Formula 1, n is an integer of 1 or 2,

R is a straight-chain or branched-chain alkyl group having 1 to 30 carbon atoms, a moiety A' is a moiety derived from a flavoring compound having at least one of an aromatic ring, an aliphatic ring, and an aliphatic chain having a hydroxyl group (—OH), wherein the hydroxyl group participates s in a carbonate linkage

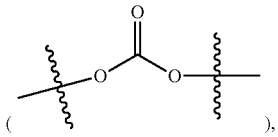

and the moiety A' corresponds to a flavoring compound excluding the hydroxyl group participating in the carbonate linkage, and a moiety G' is a moiety derived from a sugar compound, wherein at least one of hydroxyl groups (—OH) linked to a ring of the sugar compound participates in an ester linkage

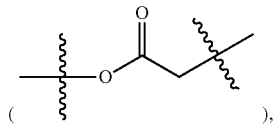

G' corresponds to a sugar compound excluding the hydroxyl group participating in the ester linkage, and m is the number of

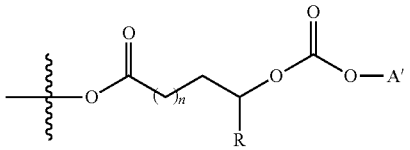

linked to the moiety G' by the ester linkage, and an integer of 1 to 8).

2. The smoking article of claim 1, wherein the flavoring compound is selected from a cyclic monoterpene-based compound having a hydroxyl group, an acyclic monoterpene-based compound having a hydroxyl group, an aromatic compound of 6 to 10 carbon atoms having a hydroxyl group, and a non-aromatic ring compound of 5 to 6 carbon atoms having a hydroxyl group.

3. The smoking article of claim 1, wherein the flavoring compound is selected from the following Formulas:

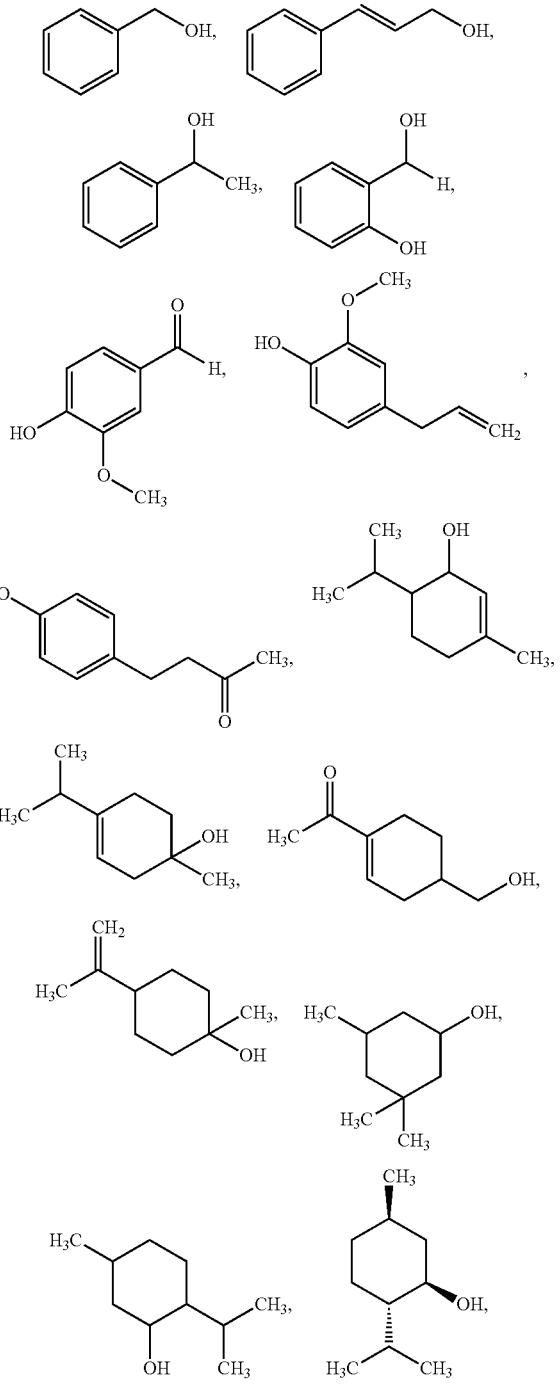

-continued
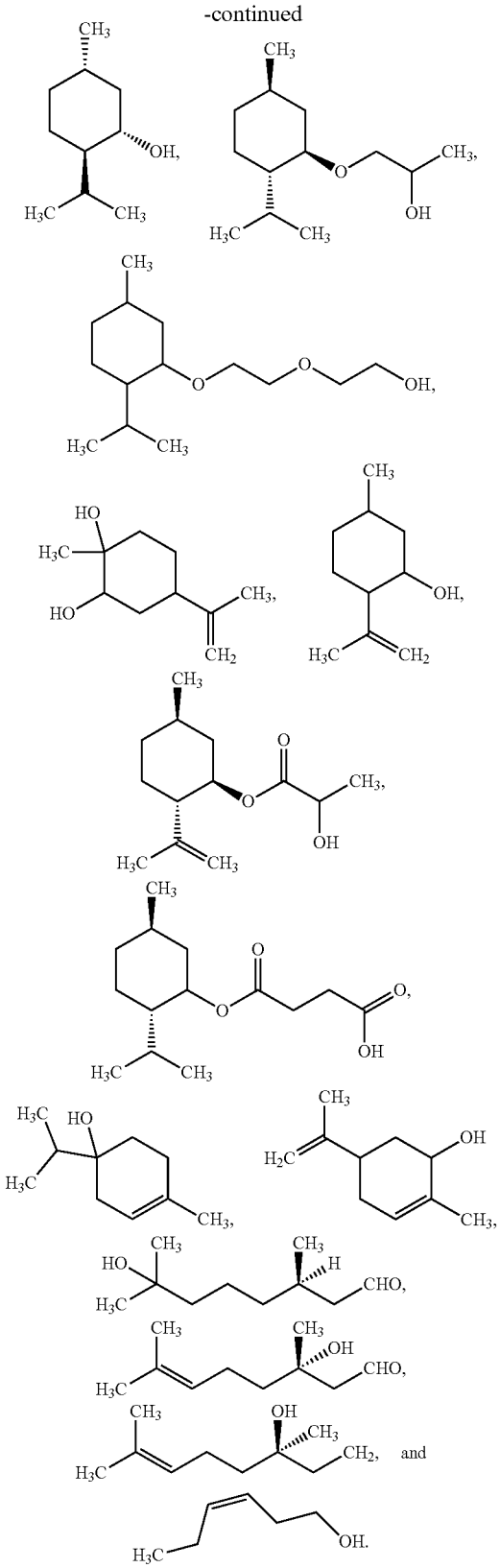
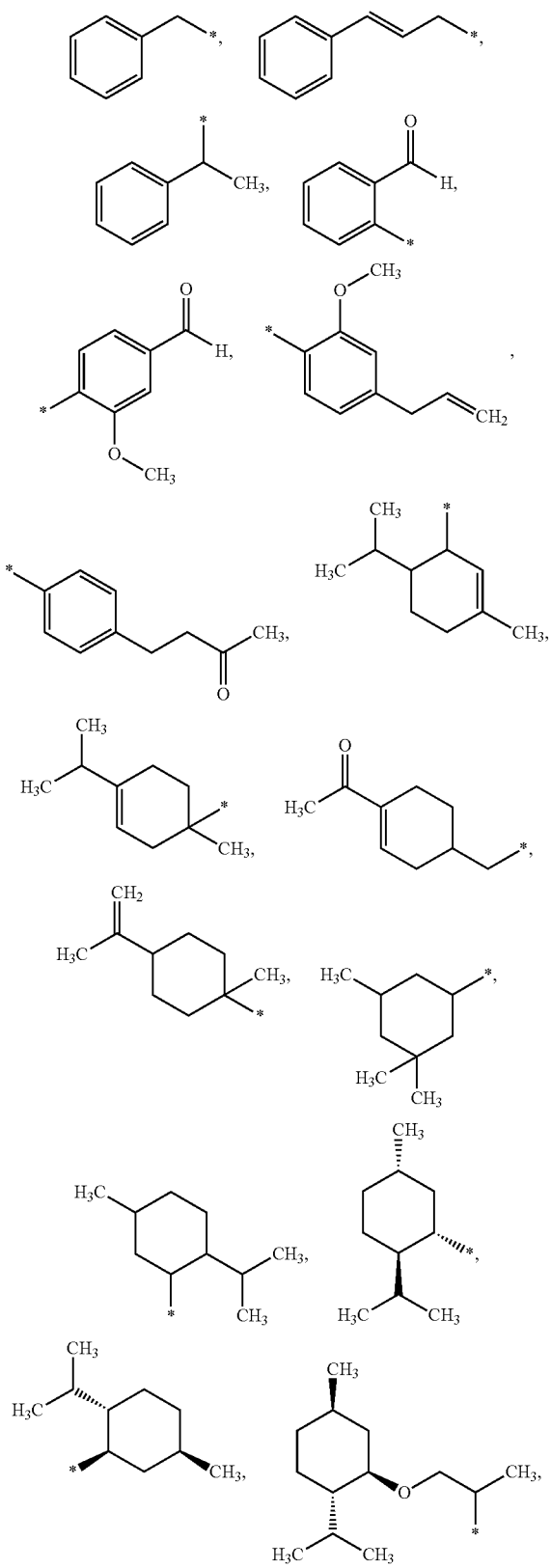
4. The smoking article of claim 1, wherein the moiety A' is selected from the following Formulas:
(* is an oxygen binding site in the carbonate linkage in Formula 1 above).

-continued

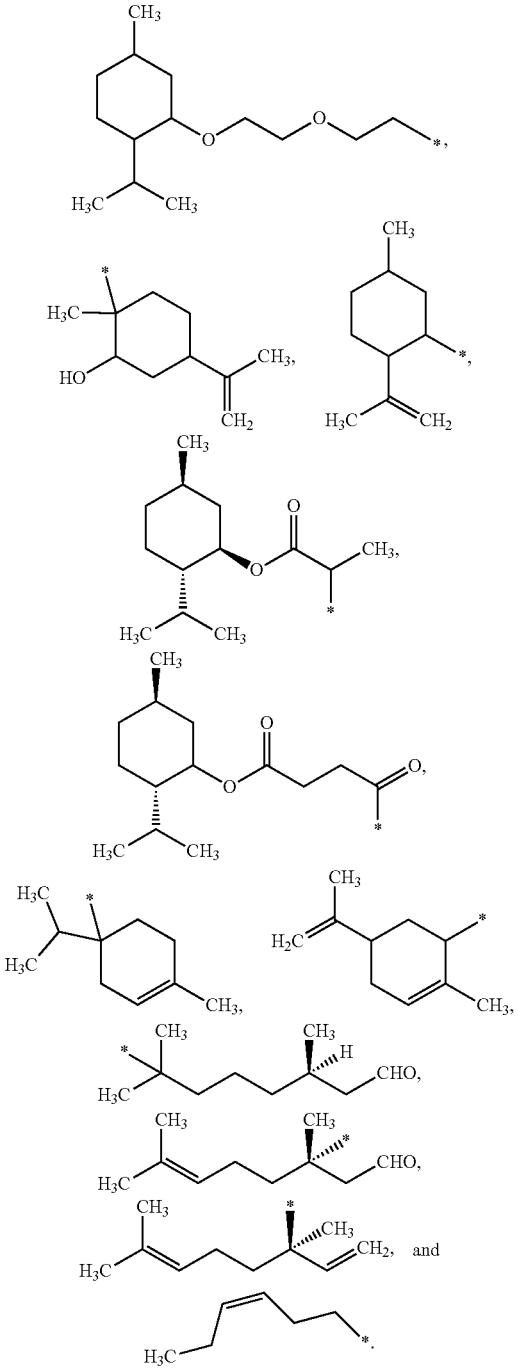

5. The smoking article of claim 1, wherein the sugar compound is selected from the group consisting of tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, glucose, idose, talose, erythrurose, xylulose, psicose, turanose, cellobiose, amylopectin, glucosamine, mannosamine, fucose, glucuronic acid, glucosan, gluco-lactone, abeoxy)huose, galactosamine, isomalto-oligosaccharide, xylo-oligosaccharide, gentio-oligosaccharide, sorbose, nigero-oligosaccharide, palatinose oligosaccharide, fructooligosaccharide, maltotetraol, maltotriol, malto-oligosaccharide, lactulose, melibiose, raffinose, rhamnose, and ribose.

6. The smoking article of claim 1, wherein the flavoring agent is selected from Formulas 1-1 to 1-9 below:

[Formula 1-1]

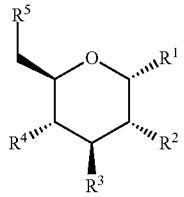

[Formula 1-2]

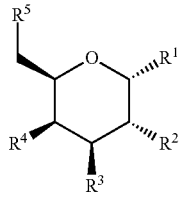

[Formula 1-3]

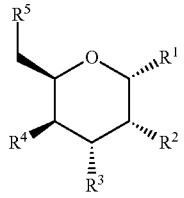

[Formula 1-4]

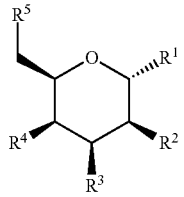

[Formula 1-5]

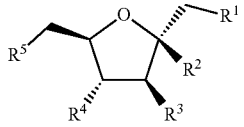

(in Formulas 1-1 to 1-5, $R^1$ to $R^5$ are each selected from a hydroxyl group (—OH)

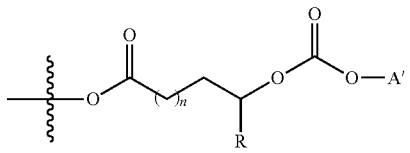

and (n, R, and A' are as those defined in Formula 1).

[Formula 1-6]

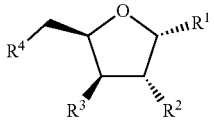

(wherein, $R^1$ to $R^4$ are each selected from a hydroxyl group (—OH) and

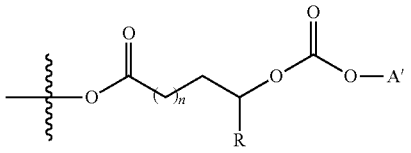

(n, R, and A' are as those defined in Formula 1).

[Formula 1-7]

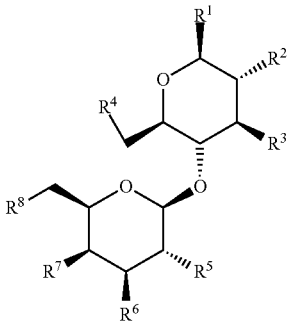

[Formula 1-8]

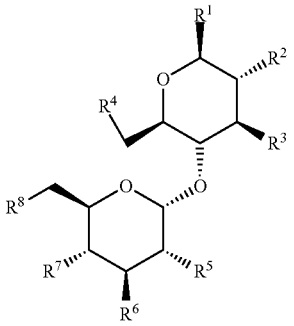

[Formula 1-9]

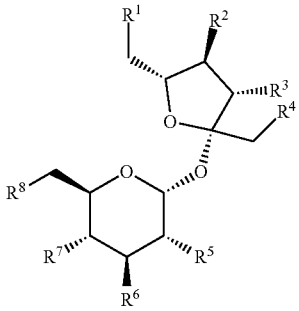

(wherein, in Formulas 1-7 to 1-9, $R^1$ to $R^8$ are each selected from a hydroxyl group (—OH) and

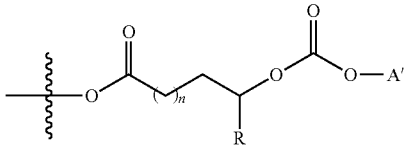

(n, R, and A' are as those defined in Formula 1).

7. The smoking article of claim 1, wherein the flavoring agent is selected from Formulas 1-1-a to 1-9-a below:

[Formula 1-1-a]

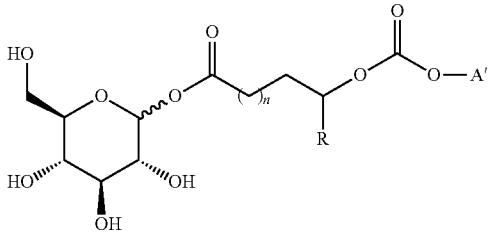

[Formula 1-2-a]

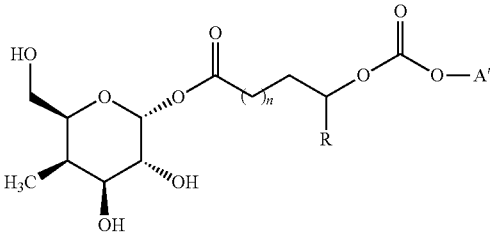

[Formula 1-3-a]

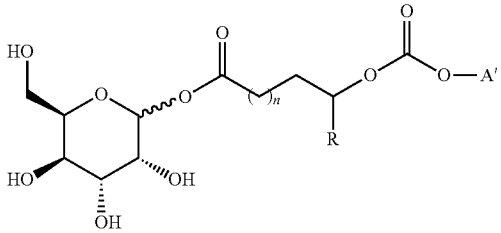

[Formula 1-4-a]

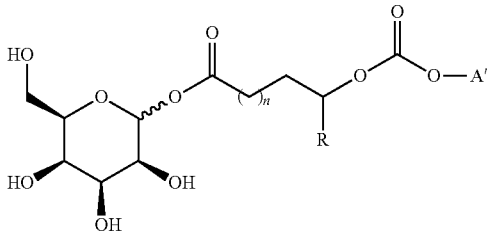

[Formula 1-5-a]

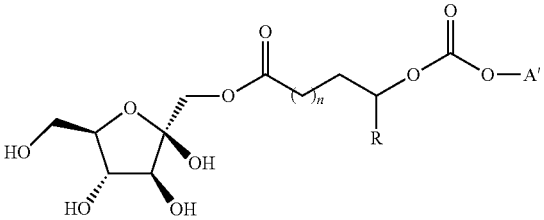

[Formula 1-6-a]

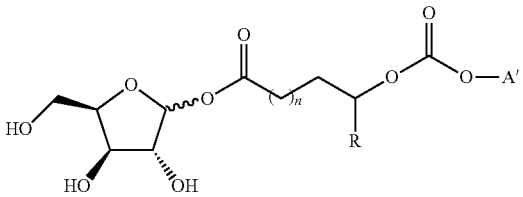

-continued

[Formula 1-7-a]

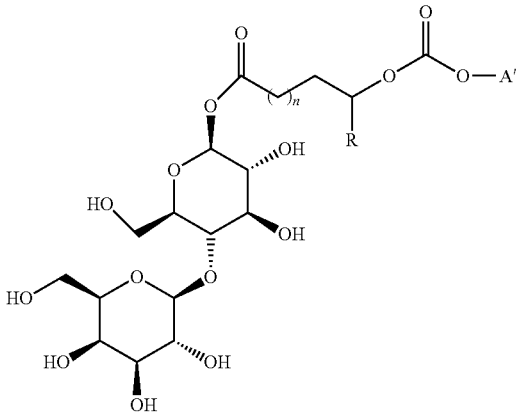

[Formula 1-8-a]

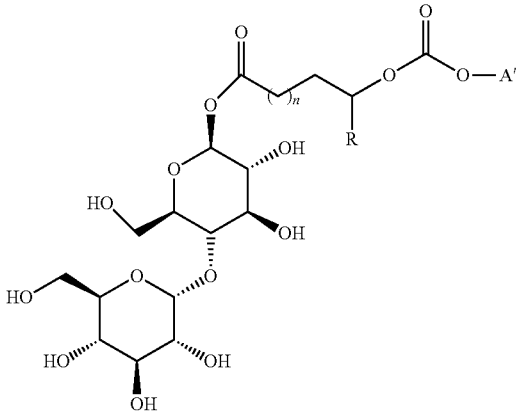

[Formula 1-9-a]

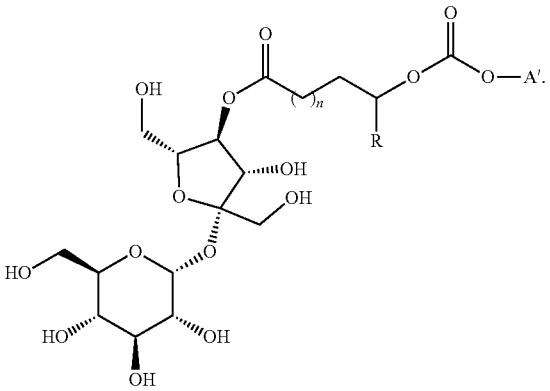

8. The smoking article of claim 1, wherein the flavoring agent develops flavor upon pyrolysis and is pyrolyzed into the sugar compound, the flavoring compound, a lactone compound, and carbon dioxide during pyrolysis.

9. The smoking article of claim 1, wherein the flavoring agent is pyrolyzed at a temperature of 80° C. or higher.

10. The smoking article of claim 8, wherein the lactone compound is decomposed into gamma lactone of Formula 2 or delta lactone of Formula 3:

[Formula 2]

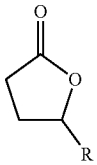

[Formula 3]

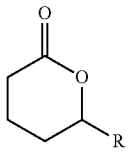

(wherein, R is a straight-chain or branched-chain alkyl group having 1 to 30 carbon atoms.).

11. The smoking article of claim 8, wherein the lactone compound is selected from Formulas below:

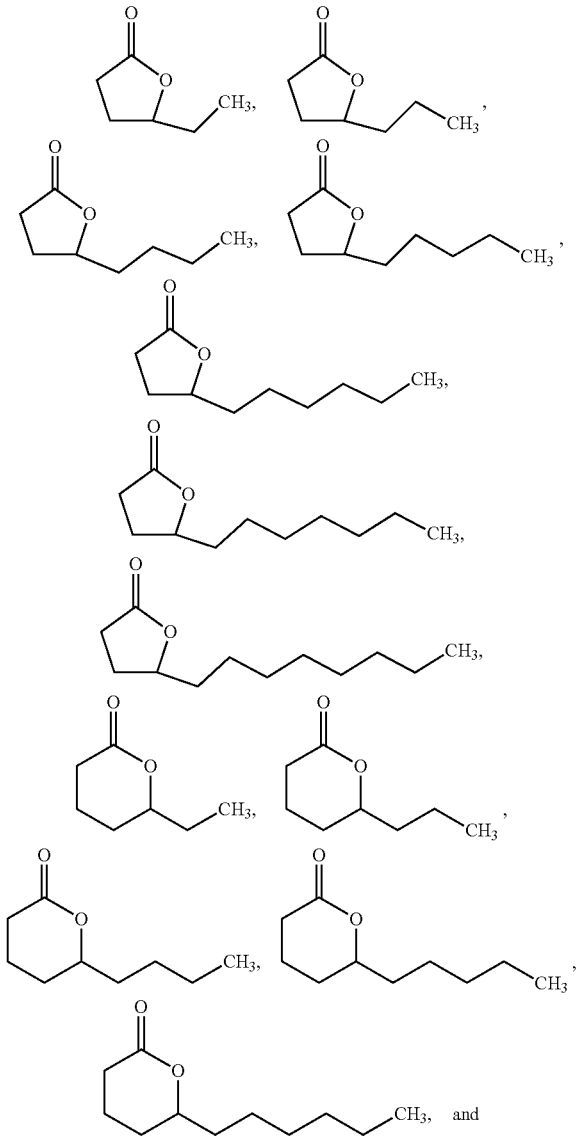

-continued

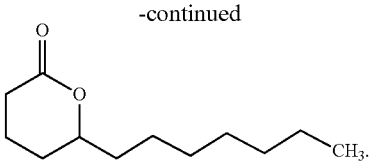

12. The smoking article of claim 1, wherein the smoking article includes slurry, paste, liquid, gel, powder, beads, sheet, film, fiber, or molded article containing the compound represented by Formula 1.

13. The smoking article of claim 1, wherein the smoking article includes at least one of a sheet, a film, and a filter printed or coated with the compound represented by the Formula 1 on the entire surface or topically on at least a portion.

14. The smoking article of claim 1, wherein the compound represented by Formula 1 is printed in a pattern according to an axial direction, a transverse direction, or both of a rod of the smoking article, and wherein the pattern is arranged in a form of at least one of a straight line, a dotted line, a lattice, a polygon, a dot, a circle, and an ellipse.

15. The smoking article of claim 1, wherein the compound represented by Formula 1 is included in an amount of 0.0001 part by weight or more with respect to 100 parts by weight of a smoking medium.

16. The smoking article of claim 1, wherein the smoking article includes a filter part and a smoking medium part, and wherein the smoking medium part includes cigarette paper, a smoking medium, or both containing the compound represented by Formula 1.

17. The smoking article of claim 15, wherein the cigarette paper includes a pattern area of the compound represented by Formula 1 locally distributed based on the front surface of at least one side or an axial direction, a transverse direction or both of the cigarette rod, and controls a tobacco taste included in sidestream smoke depending on a position of the pattern area.

* * * * *